US008976030B2

(12) United States Patent
Cunningham et al.

(10) Patent No.: US 8,976,030 B2
(45) Date of Patent: Mar. 10, 2015

(54) POINT OF SALE (POS) BASED CHECKOUT SYSTEM SUPPORTING A CUSTOMER-TRANSPARENT TWO-FACTOR AUTHENTICATION PROCESS DURING PRODUCT CHECKOUT OPERATIONS

(71) Applicant: Metrologic Instruments, Inc., Blackwood, NJ (US)

(72) Inventors: Charles Cunningham, Havertown, PA (US); Timothy Good, Clementon, NJ (US); Sean Philip Kearney, Marlton, NJ (US); Michael Miraglia, Hamilton, NJ (US); Thomas Amundsen, Turnersville, NJ (US); Patrick Giordano, Glassboro, NJ (US); Yujiun Paul Wang, Cupertino, CA (US); Xiaoxun Zhu, Suzhou (CN)

(73) Assignee: Metrologic Instruments, Inc., Blackwood, NJ (US)

( * ) Notice: Subject to any disclaimer, the term of this patent is extended or adjusted under 35 U.S.C. 154(b) by 23 days.

(21) Appl. No.: 13/867,386

(22) Filed: Apr. 22, 2013

(65) Prior Publication Data

US 2013/0278425 A1 Oct. 24, 2013

Related U.S. Application Data

(60) Provisional application No. 61/741,779, filed on Apr. 24, 2012.

(51) Int. Cl.
*G08B 13/14* (2006.01)
*G08B 13/24* (2006.01)
(Continued)

(52) U.S. Cl.
CPC ..... *G08B 13/246* (2013.01); *G08B 13/242* (2013.01); *G07G 3/003* (2013.01); *G07G 1/0054* (2013.01)
USPC ..... 340/572.1; 235/385

(58) Field of Classification Search
CPC ..... G08B 13/246; G08B 13/2417; G08B 13/2448; G08B 13/242
USPC ..... 340/572.1, 572.3; 235/375, 385
See application file for complete search history.

(56) References Cited

U.S. PATENT DOCUMENTS 761,742 A 6/1904 Woodward
6,114,961 A 9/2000 Denholm et al.
(Continued)

FOREIGN PATENT DOCUMENTS

WO 03003322 A 1/2003

OTHER PUBLICATIONS

Beth Bacheldor. Turkish Retailer Uses Hybrid EAS-RFID Tags to Stop Theft, Improve Inventory Management. Aug. 15, 2008. 2 pages. <http://www.rfidjournal.com/article/view/4263>. Copyright 2002-2011RFID Journal LLC.

*Primary Examiner* — John A Tweel, Jr.
(74) *Attorney, Agent, or Firm* — Additon, Higgins & Pendleton, P.A.

(57) ABSTRACT

A checkout system is provided for carrying out a two-factor authentication process where coded products are purchased and theft activity might be pursued. The system typically includes an identification code reader for reading product identification codes (e.g. UPC bar code symbols or EPC-encoded RFID tags) on products that are passed through the point of sale (POS) and a security code detector/reader for automatically detecting/reading a security code (e.g. implemented as an EAS tag or an RFID tag) at the POS. During product checkout operations, the identification code reader reads identification codes, and the security code detector/reader detects or reads security codes applied to products. Collected identification and security data is automatically processed using identification and security data stored in a database to determine whether or not each product being purchased at the POS is in compliance or not in compliance with a two-factor authentication process supported by the checkout system.

20 Claims, 39 Drawing Sheets

(51) Int. Cl.
*G07G 3/00* (2006.01)
*G07G 1/00* (2006.01)

(56) References Cited

U.S. PATENT DOCUMENTS

| | | | | |
|---|---|---|---|---|
| 6,169,483 | B1 | 1/2001 | Ghaffari et al. | |
| 6,237,604 | B1 | 5/2001 | Burnside et al. | |
| 6,281,796 | B1 | 8/2001 | Canipe et al. | |
| 6,398,112 | B1 | 6/2002 | Li et al. | |
| 6,507,279 | B2 * | 1/2003 | Loof | 340/572.1 |
| 6,619,549 | B2 | 9/2003 | Zhu et al. | |
| 6,724,895 | B1 | 4/2004 | Turner et al. | |
| 6,764,010 | B2 | 7/2004 | Collins, Jr. et al. | |
| 6,783,072 | B2 | 8/2004 | Acosta et al. | |
| 6,788,205 | B1 | 9/2004 | Mason et al. | |
| 6,802,452 | B2 | 10/2004 | Lebaschi et al. | |
| 6,837,428 | B2 | 1/2005 | Lee et al. | |
| 6,854,647 | B2 | 2/2005 | Collins, Jr. et al. | |
| 6,898,184 | B1 | 5/2005 | Anderson et al. | |
| 6,913,199 | B2 | 7/2005 | He | |
| 6,942,145 | B1 | 9/2005 | Collins et al. | |
| 6,954,533 | B2 | 10/2005 | Turner et al. | |
| 6,957,769 | B2 | 10/2005 | Hepworth et al. | |
| 7,007,912 | B1 | 3/2006 | Giuliani et al. | |
| 7,017,818 | B2 | 3/2006 | Lebaschi et al. | |
| 7,028,899 | B2 | 4/2006 | Tsikos et al. | |
| 7,066,388 | B2 | 6/2006 | He | |
| 7,128,266 | B2 | 10/2006 | Zhu et al. | |
| 7,170,414 | B2 | 1/2007 | Clifford et al. | |
| 7,172,123 | B2 | 2/2007 | Acosta et al. | |
| 7,221,638 | B2 | 5/2007 | Rapp | |
| 7,273,181 | B2 | 9/2007 | White | |
| 7,275,682 | B2 | 10/2007 | Excoffier et al. | |
| 7,284,703 | B2 | 10/2007 | Powell et al. | |
| 7,288,433 | B2 | 10/2007 | Haba et al. | |
| 7,290,717 | B2 | 11/2007 | Schuessler | |
| 7,298,240 | B2 | 11/2007 | Lamar | |
| 7,307,530 | B2 | 12/2007 | Fabian et al. | |
| 7,374,092 | B2 | 5/2008 | Acosta et al. | |
| 7,411,508 | B2 | 8/2008 | Harazin et al. | |
| 7,464,877 | B2 | 12/2008 | Kotlarsky et al. | |
| 7,490,774 | B2 | 2/2009 | Zhu et al. | |
| 7,495,564 | B2 | 2/2009 | Harold et al. | |
| 7,504,948 | B2 | 3/2009 | Wulff et al. | |
| 7,510,110 | B2 | 3/2009 | Pietrzyk et al. | |
| 7,607,581 | B2 | 10/2009 | Kotlarsky et al. | |
| 7,626,488 | B2 | 12/2009 | Armstrong et al. | |
| 7,642,543 | B2 | 1/2010 | Kobayashi et al. | |
| 7,667,602 | B2 | 2/2010 | Ulrich | |
| 7,669,766 | B2 | 3/2010 | Ahmadi et al. | |
| 7,679,511 | B2 | 3/2010 | Lauper | |
| 7,690,568 | B2 | 4/2010 | Shimura et al. | |
| 7,692,543 | B2 | 4/2010 | Copeland et al. | |
| 7,696,882 | B1 | 4/2010 | Rahimi et al. | |
| 7,708,205 | B2 | 5/2010 | Kotlarsky et al. | |
| 7,841,533 | B2 | 11/2010 | Kotlarskey et al. | |
| 8,042,740 | B2 | 10/2011 | Knowles et al. | |
| 8,381,979 | B2 | 2/2013 | Franz | |
| 2004/0000591 | A1 | 1/2004 | Collins et al. | |
| 2004/0189472 | A1 | 9/2004 | Acosta et al. | |
| 2005/0145694 | A1 | 7/2005 | Collins et al. | |
| 2008/0283611 | A1 | 11/2008 | Knowles et al. | |
| 2008/0314985 | A1 | 12/2008 | Kotlarsky et al. | |
| 2009/0045955 | A1 | 2/2009 | Ulrich | |
| 2009/0150246 | A1 | 6/2009 | Meenakshi et al. | |
| 2009/0157516 | A1 | 6/2009 | Babu et al. | |

* cited by examiner

Two-Factor Authentication Scenarios Considered
When Using The POS-Based Checkout System Of Present Disclosure

| Scenario No. | Product Classification (i.e. Special or Non-Special) | Product Identification Code (e.g. Bar Code) Classification (i.e. Special or Non-Special) | Product Security Code Classification (i.e. Special or Non-Special) | Generation of Two-Factor Compliance Indication? |
|---|---|---|---|---|
| 1 | Special | Special | Special | Yes |
| 2 | Special | Special | Non-Special (no tag) | No |
| 3 | Special | Non-Special | Special | No |
| 4 | Special | Non-Special | Non-Special (no tag) | Yes |
| 5 | Non-Special | Non-Special | Non-Special (no tag) | Yes |
| 6 | Non-Special | Special | Special | Yes |
| 7 | Non-Special | Special | Non-Special (no tag) | No |
| 8 | Non-Special | Non-Special | Special | No |

FIG. 1

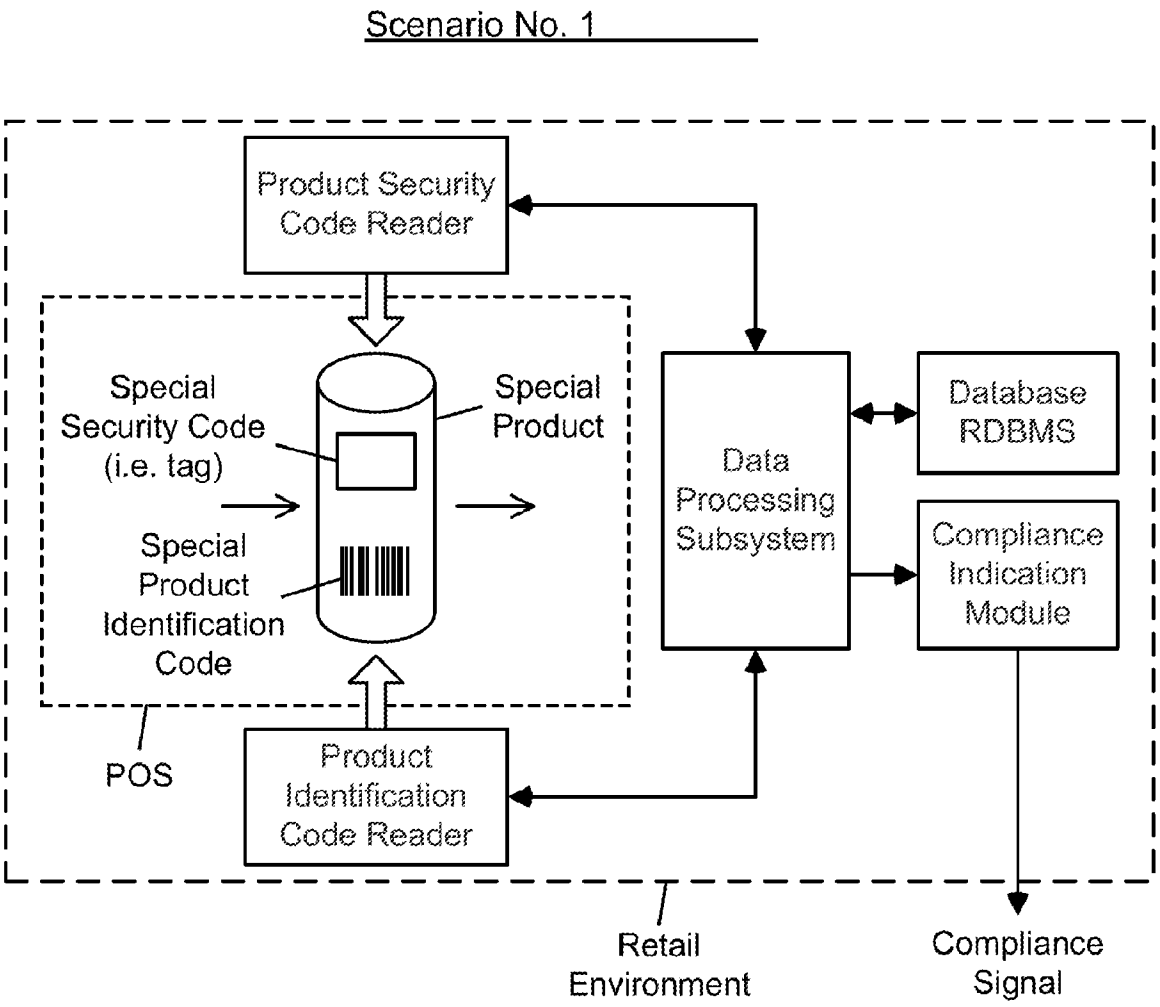
FIG. 1A1

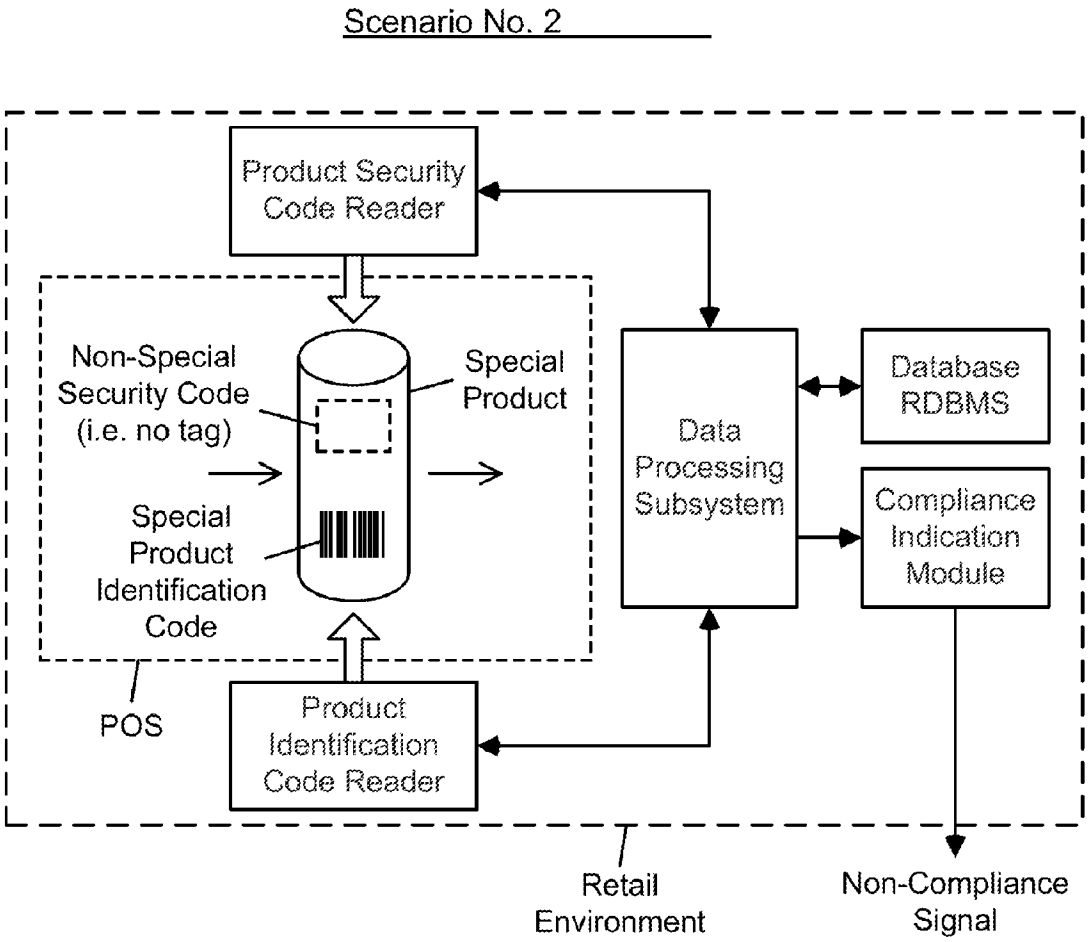
FIG. 1A2

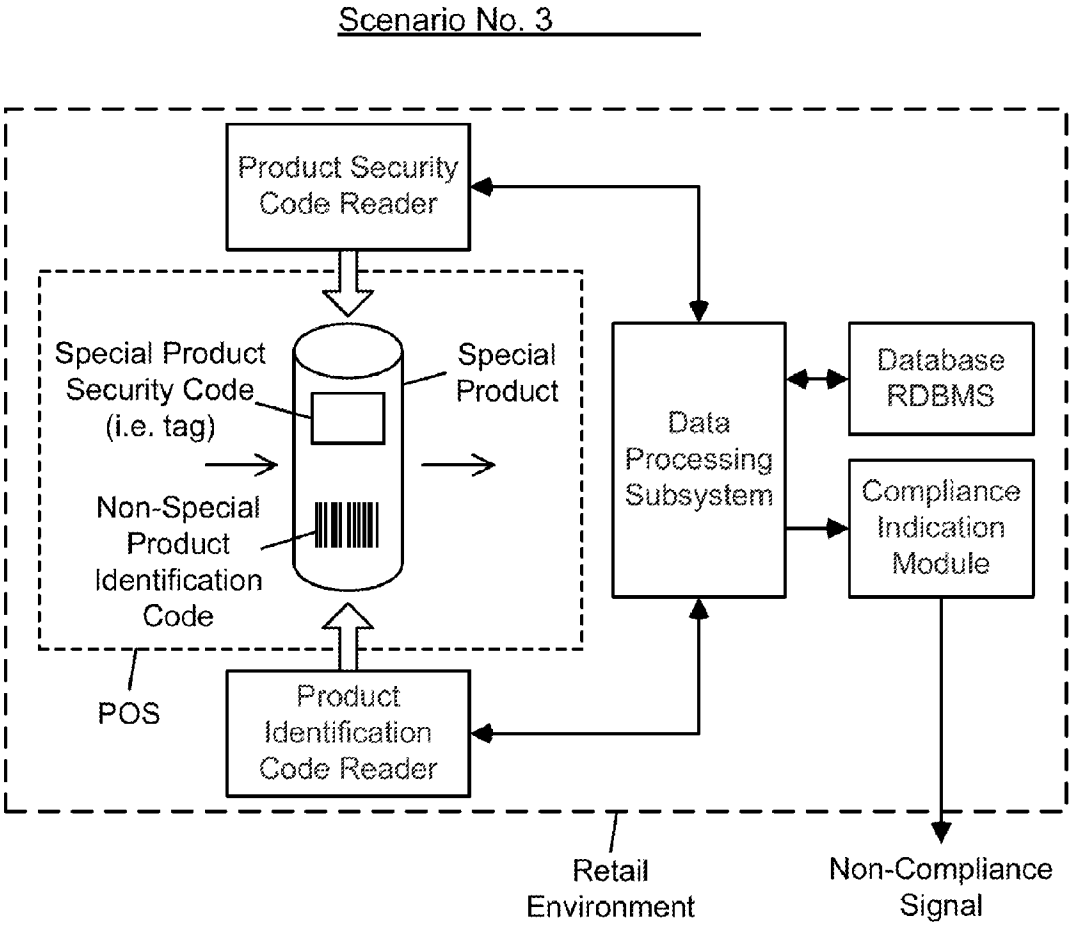
FIG. 1A3

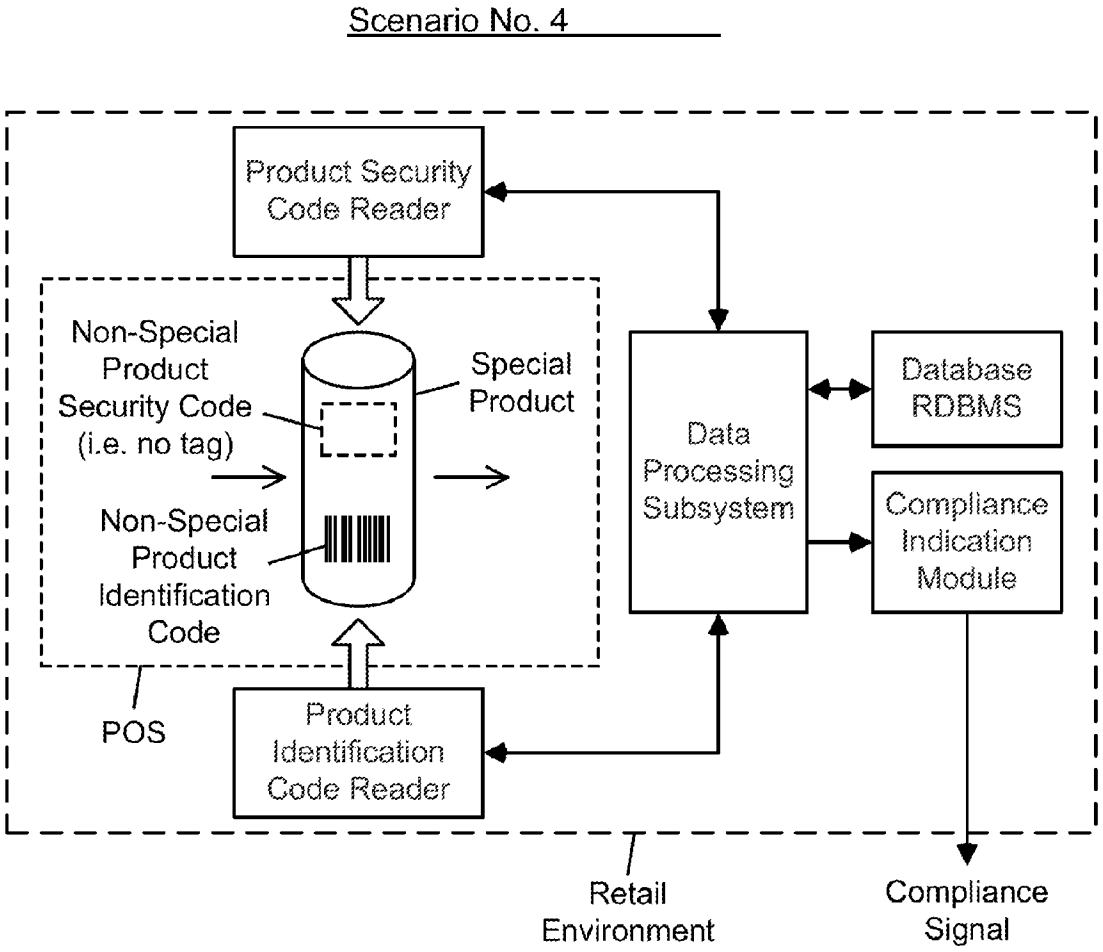
FIG. 1A4

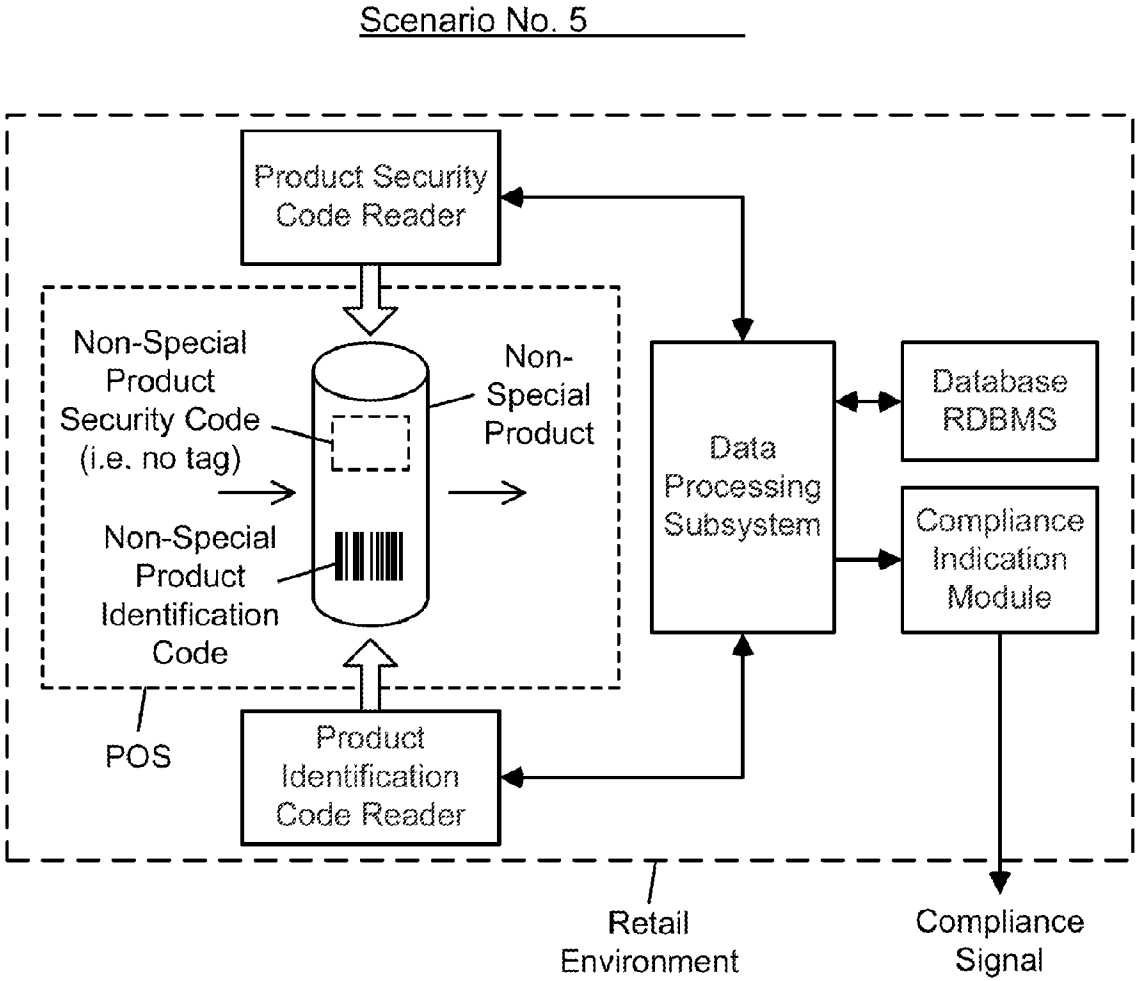
FIG. 1A5

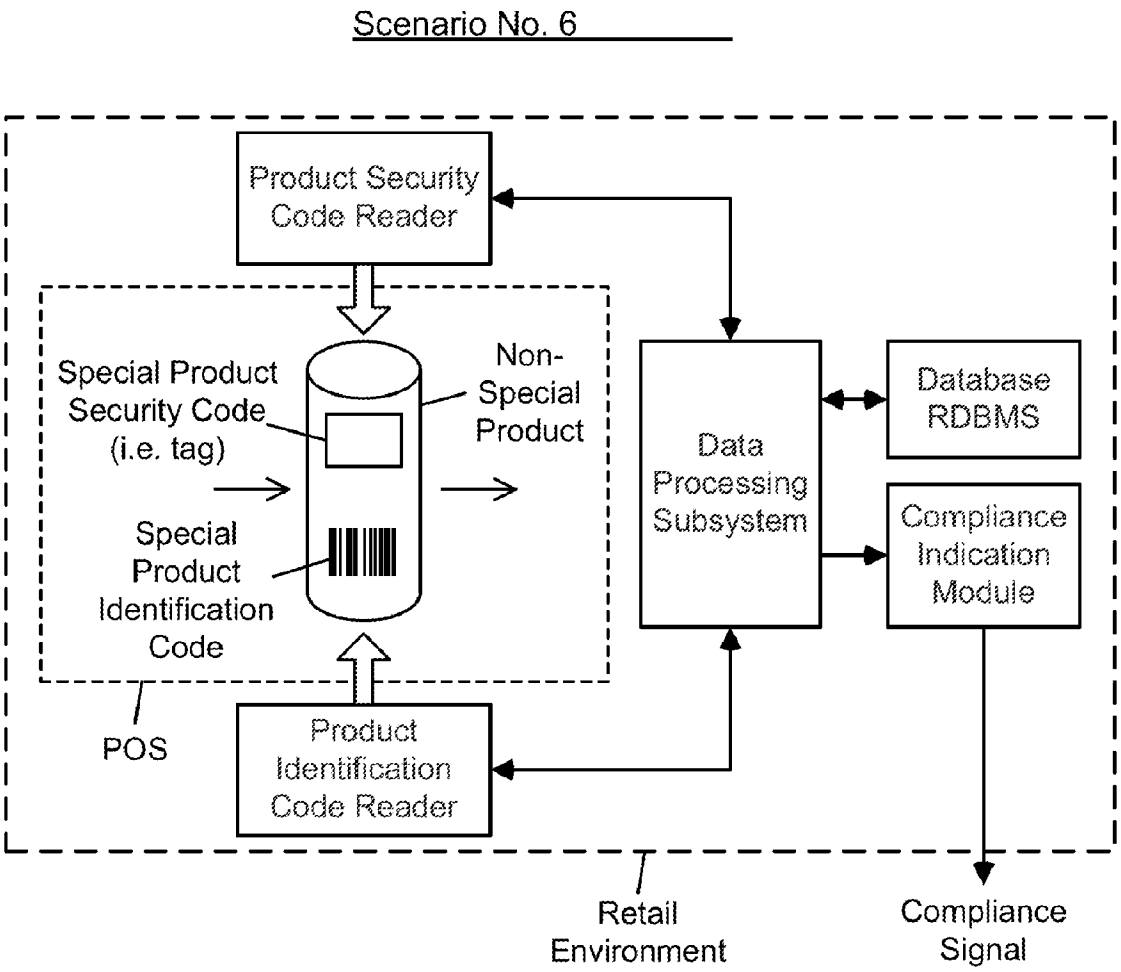
FIG. 1A6

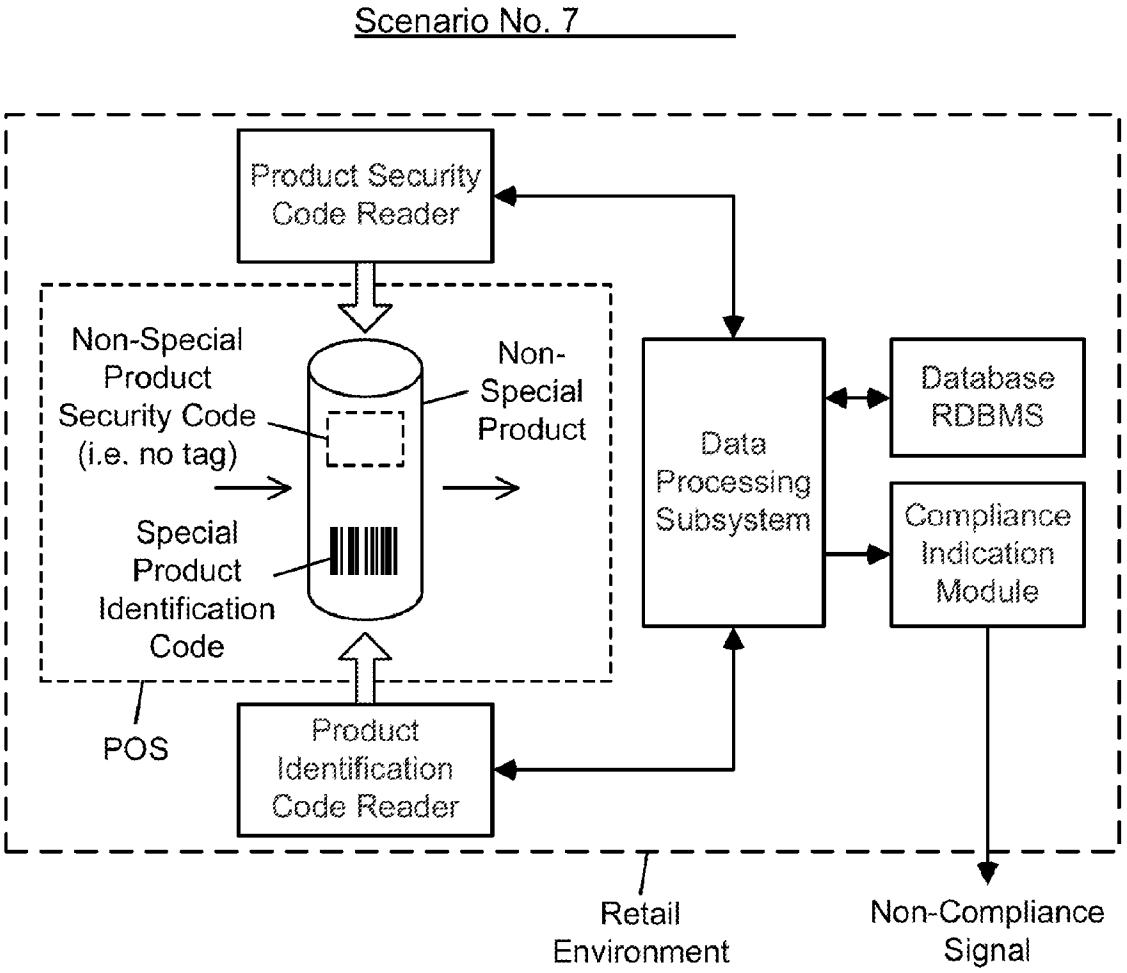
FIG. 1A7

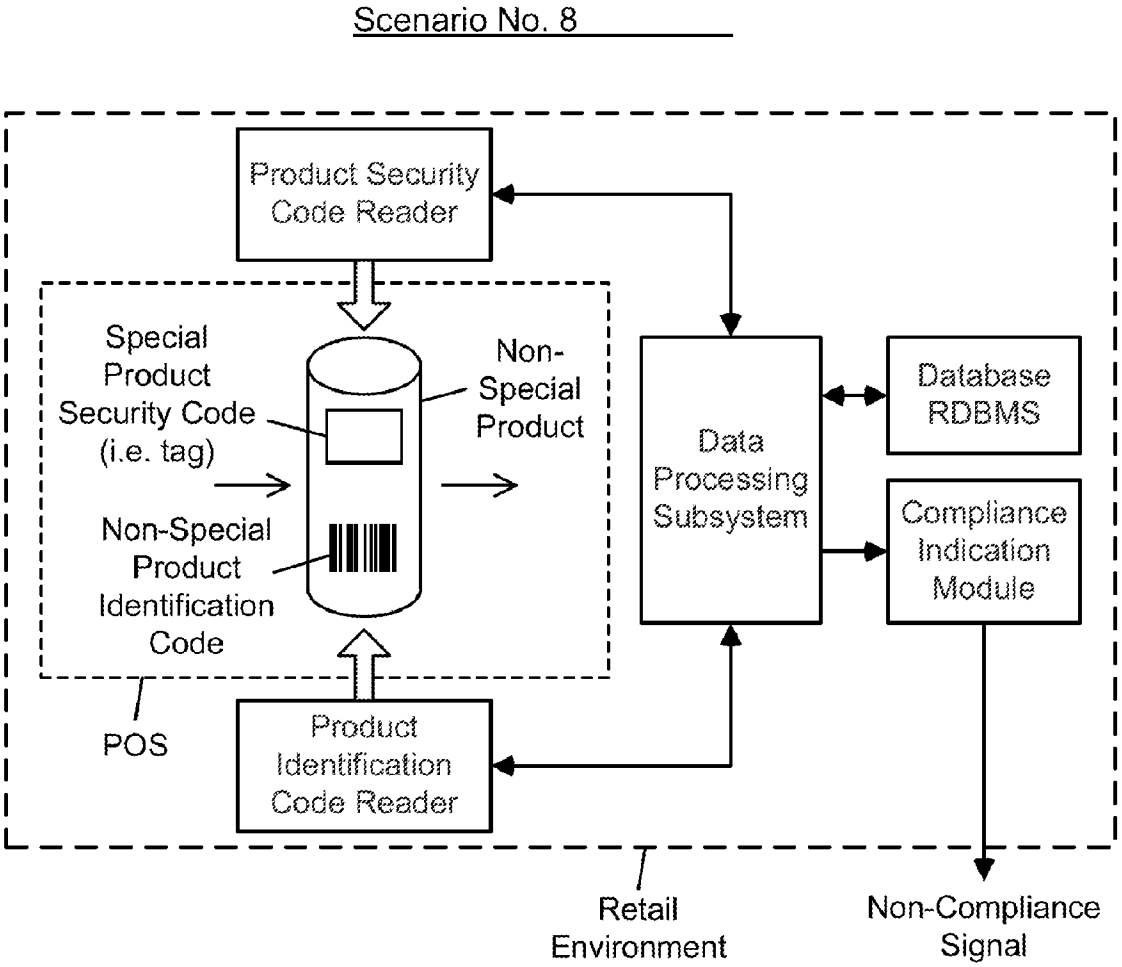
FIG. 1A8

METHOD OF CHECKING OUT CODED PRODUCTS AT A POINT OF SALE (POS) IN A RETAIL ENVIRONMENT WHILE CHECKING FOR TWO-FACTOR AUTHENTIFICATION COMPLIANCE
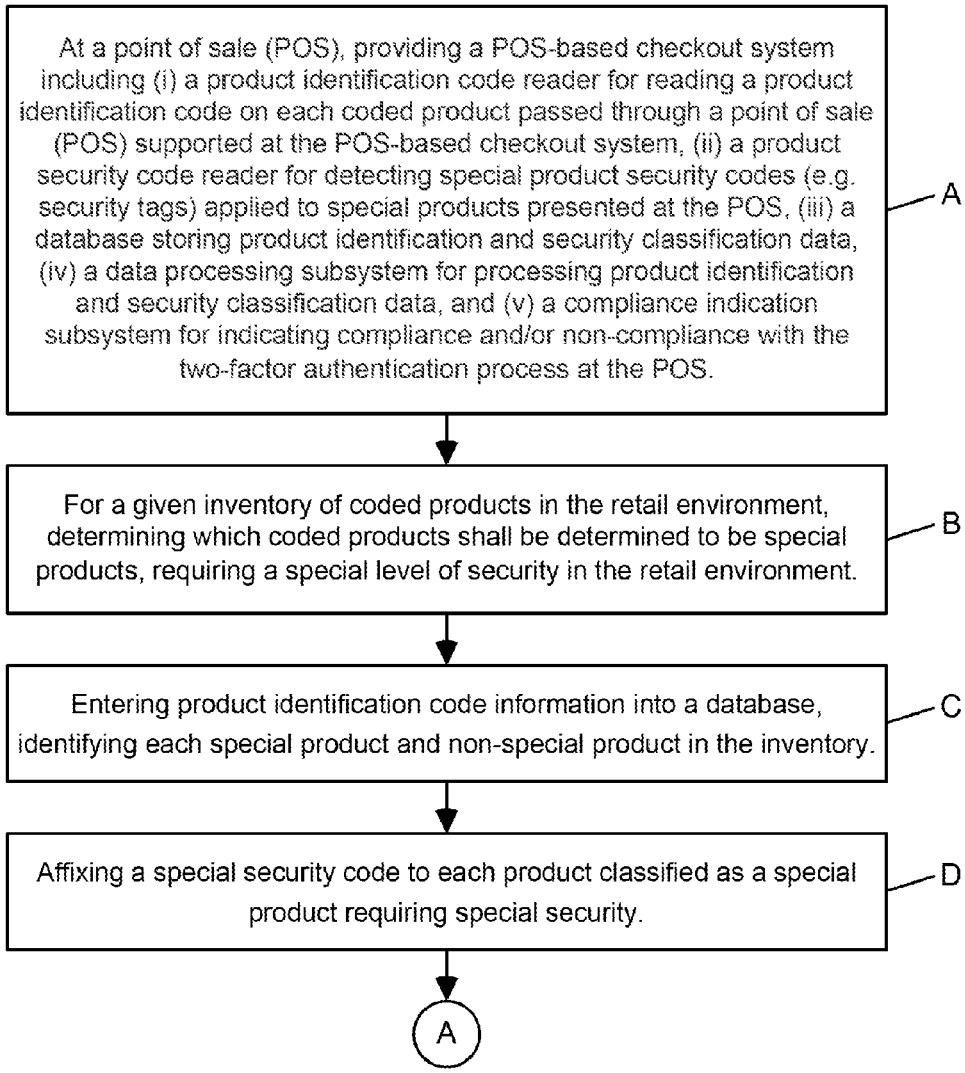
FIG. 1B1

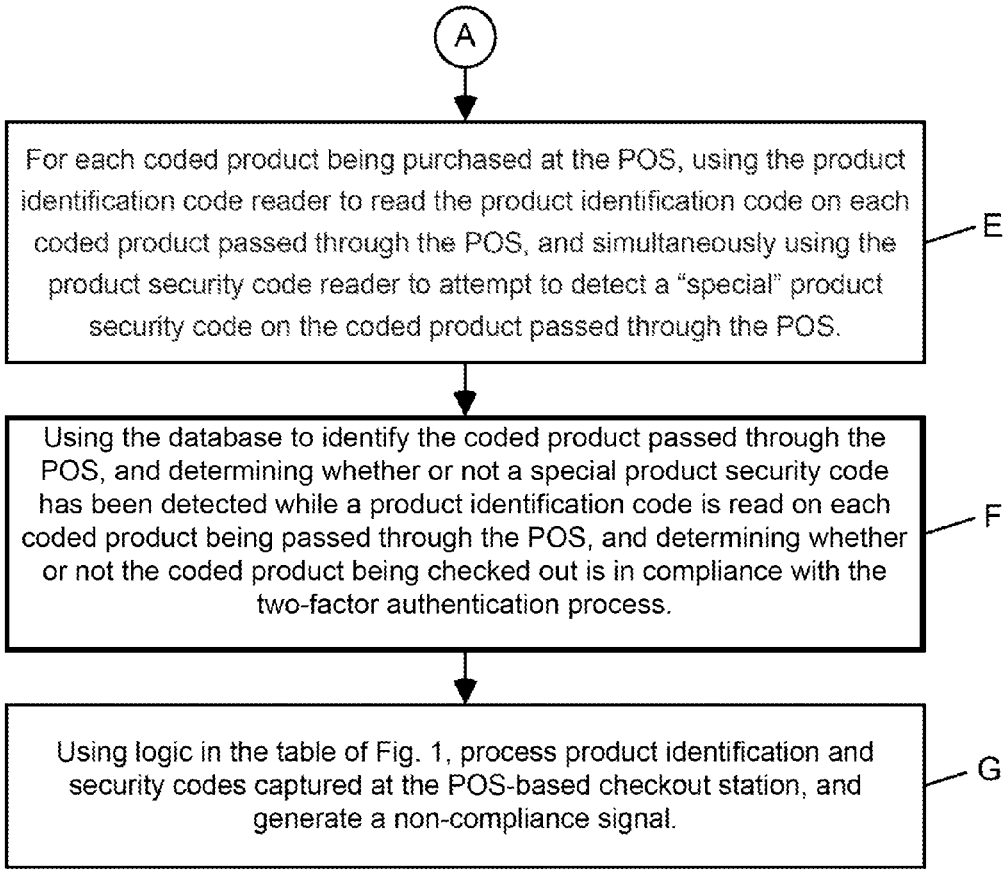
FIG. 1B2

Digital-Imaging POS-Based Checkout System

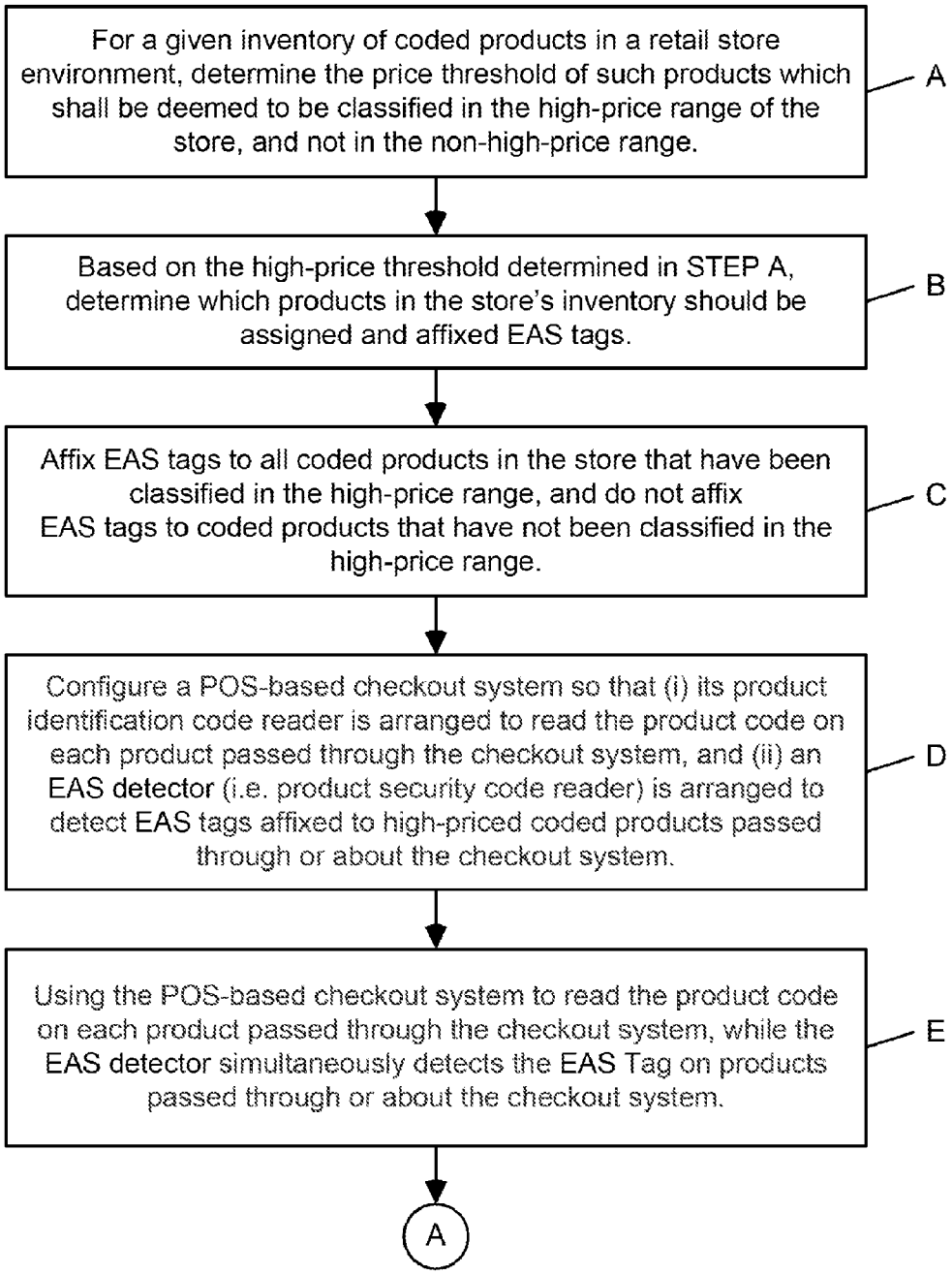
FIG. 2G1

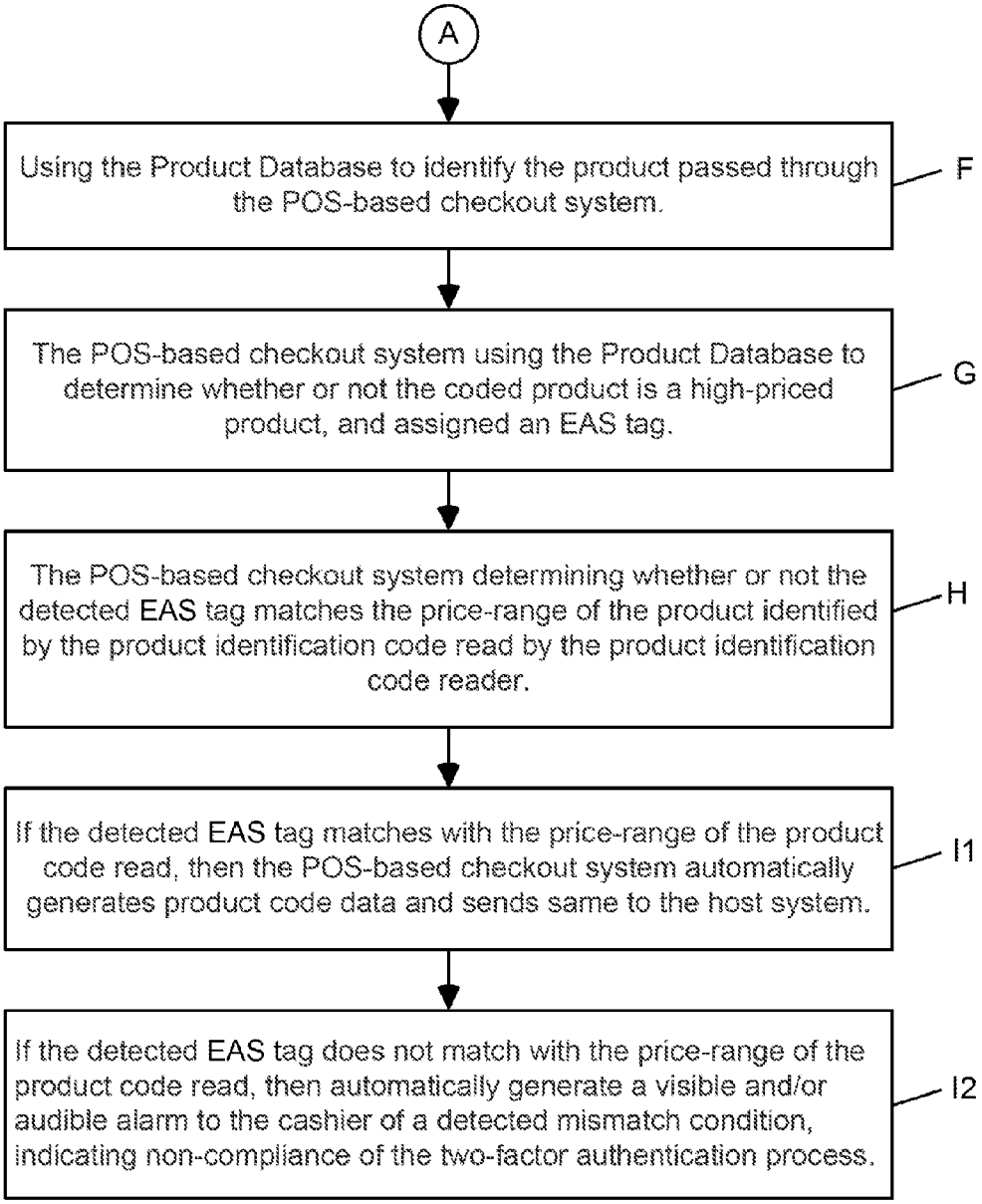
FIG. 2G2

POS-Based Laser Scanning
Checkout System

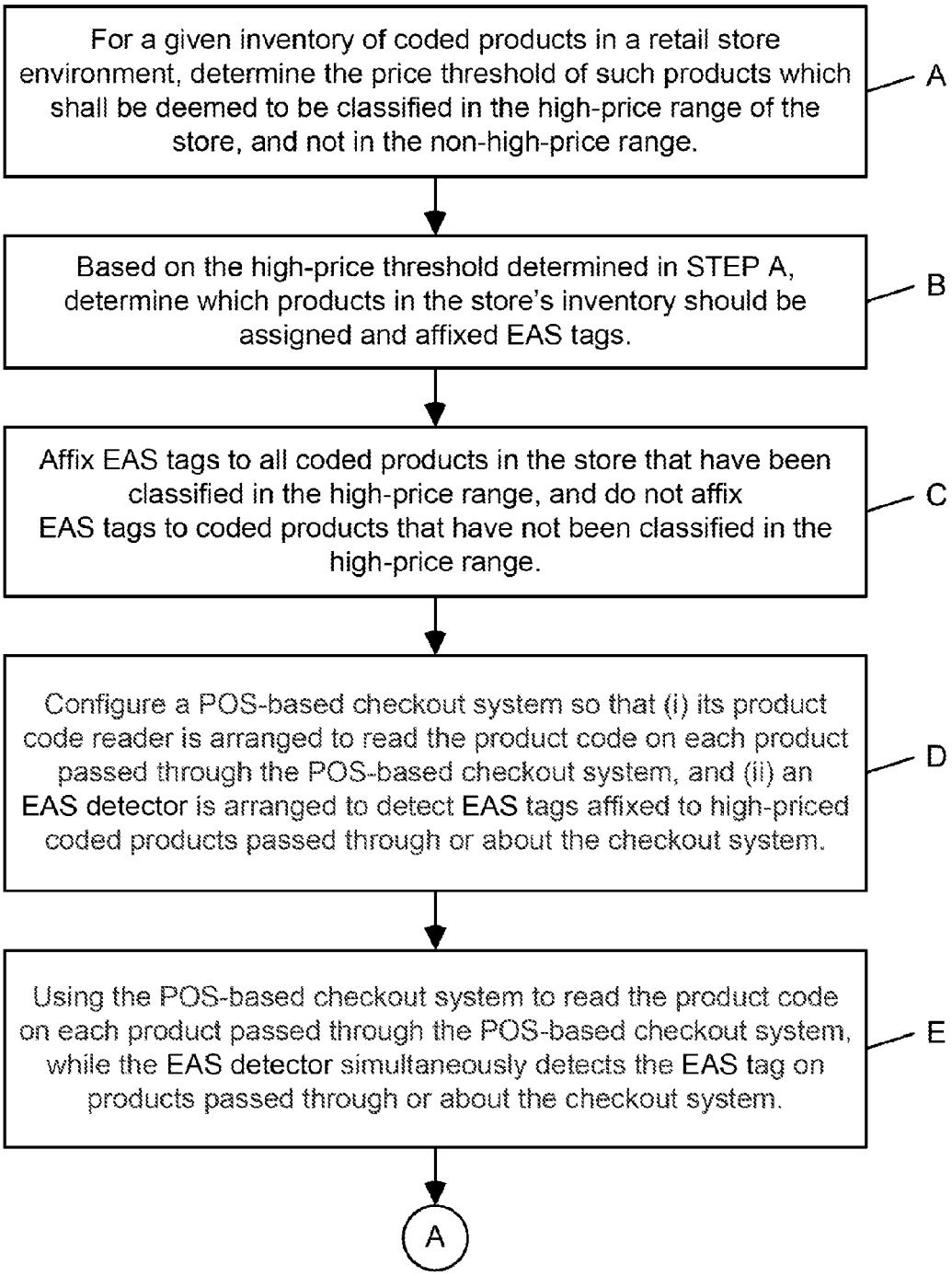
FIG. 3E1

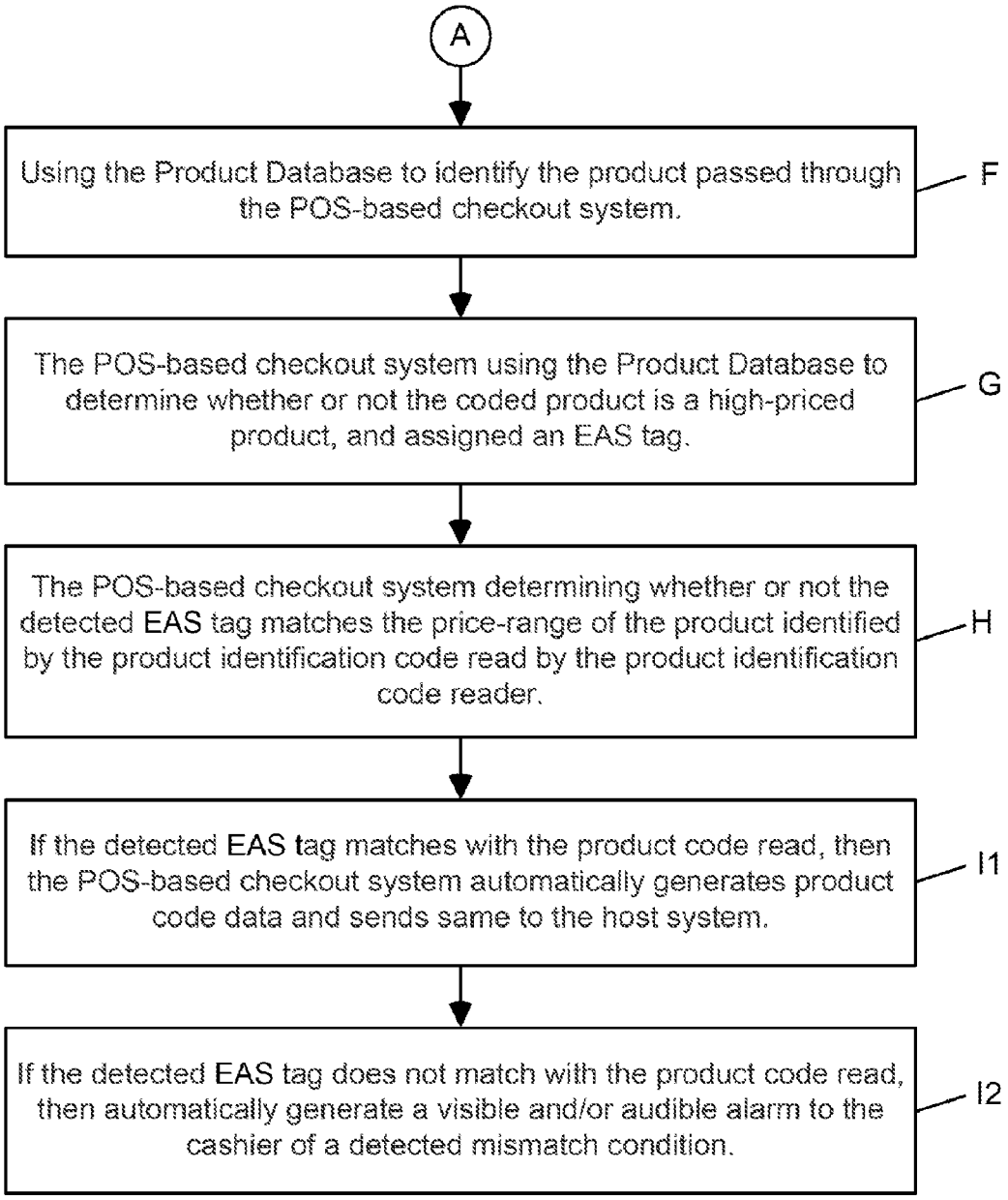
FIG. 3E2

Digital-Imaging POS-Based Checkout System

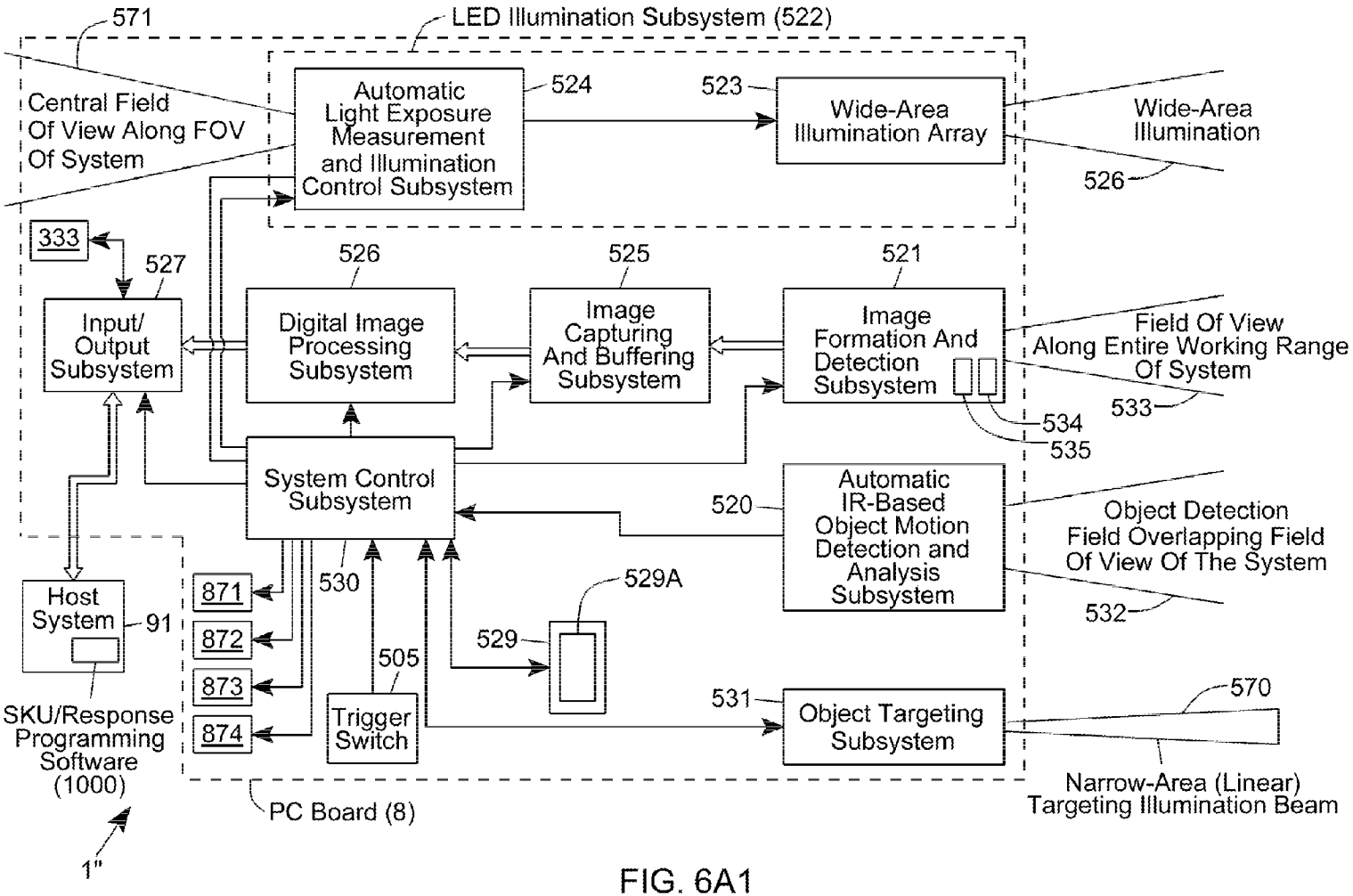
FIG. 6A1

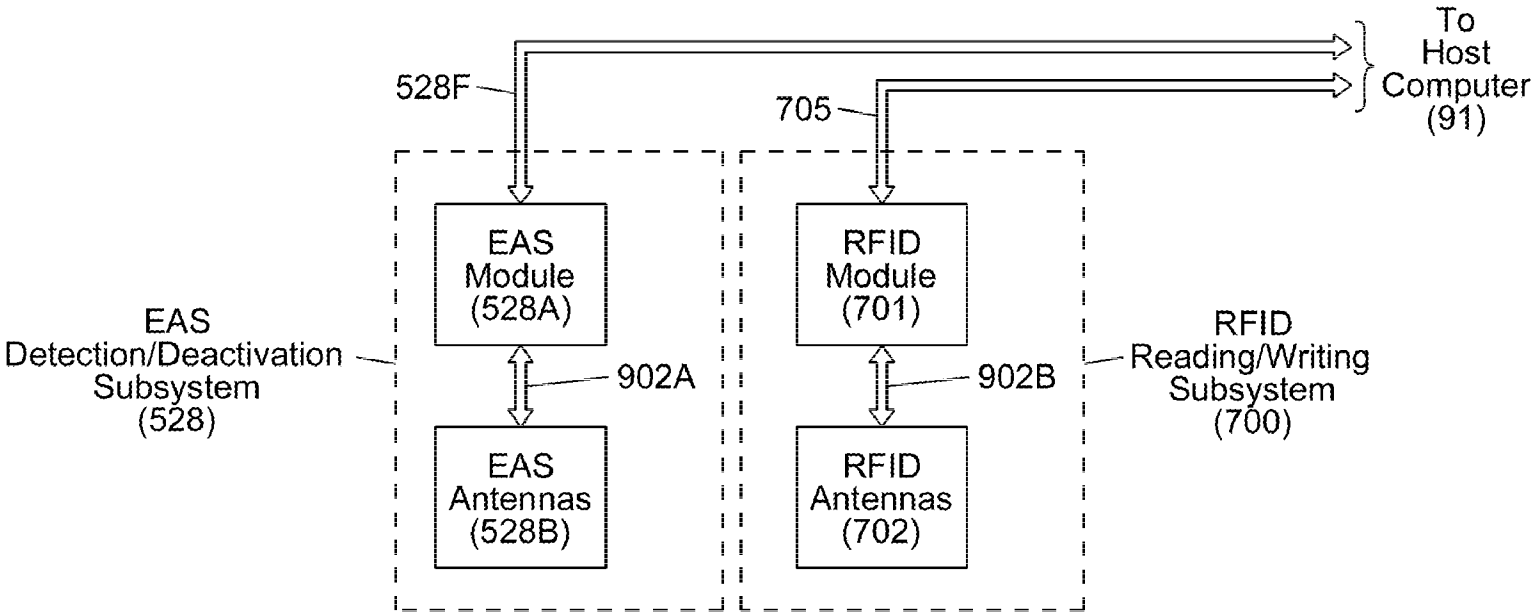
FIG. 6A2

Portable Digital-Imaging POS-Based Checkout System

POINT OF SALE (POS) BASED CHECKOUT SYSTEM SUPPORTING A CUSTOMER-TRANSPARENT TWO-FACTOR AUTHENTICATION PROCESS DURING PRODUCT CHECKOUT OPERATIONS

CROSS-REFERENCE TO PRIORITY APPLICATION

The present application claims the benefit of U.S. Patent Application No. 61/741,779 for a Point Of Sale (POS) Based Checkout System Supporting a Customer-Transparent Two-Factor Authentication Process During Product Checkout Operations, filed Apr. 24, 2012, which is hereby incorporated by reference in its entirety.

BACKGROUND OF DISCLOSURE

1. Field of Disclosure

The present disclosure relates generally to improvements in methods of and apparatus for checking out products in point-of-sale (POS) environments.

2. Brief Description of the State of Knowledge in the Art

The use of bar code symbols for product and article identification is well known in the art. Presently, various types of bar code symbol scanners have been developed for reading bar code symbols at retail points of sale (POS).

Also, over the years, electronic article surveillance (EAS) methods have been developed to prevent shoplifting in retail stores or pilferage of books from libraries. Special tags are fixed to merchandise or books. These tags are removed or deactivated by the clerks when the item is properly bought or checked out at a POS station. At the exits of the store, a detection system sounds an alarm or otherwise alerts the staff when it senses "active" tags. For high-value goods that are to be manipulated by the patrons, wired alarm clips may be used instead of tags.

Currently, several major types of electronic article surveillance (EAS) systems have been developed, namely: magnetic-based EAS systems, also known as magneto-harmonic; acousto-magnetic based EAS systems, also known as magnetostrictive; radio-frequency based EAS systems; and microwave-based EAS systems.

Magnetic-Based EAS Systems

In magnetic-based EAS systems, the tags are made of a strip of amorphous metal (metglas), which has a very low magnetic saturation value. Except for permanent tags, this strip is also lined with a strip of ferromagnetic material with a moderate coercive field (magnetic "hardness"). Detection is achieved by sensing harmonics and sum or difference signals generated by the non-linear magnetic response of the material under a mixture of low-frequency (in the 10 Hz to 1000 Hz range) magnetic fields. When the ferromagnetic material is magnetized, it biases the amorphous metal strip into saturation, where it no longer produces harmonics. Deactivation of these tags is therefore done with magnetization. Activation requires demagnetization. This type of EAS system is suitable for items in libraries since the tags can be deactivated when items are borrowed and re-activated upon return. It is also suitable for low value goods in retail stores, due to the small size and very low cost of the tags.

Acousto-Magnetic Based EAS Systems

These EAS systems are similar to magnetic-based EAS systems, in that the tags are made of two strips of metal, namely: a strip of magnetostrictive, ferromagnetic amorphous metal, and a strip of a magnetically semi-hard metallic strip, which is used as a biasing magnet (to increase signal strength) and to allow deactivation. These strips are not bound together, but are free to oscillate mechanically. Amorphous metals are used in such systems due to their good magneto-elastic coupling, which imply that they can efficiently convert magnetic energy to mechanical vibrations. The detectors for such tags emit periodic tonal bursts at about 58 kHz, the same resonance frequency as of the amorphous strips [3]. This causes the strip to vibrate longitudinally by magnetostriction, and to continue to oscillate after the burst is over. The vibration causes a change in magnetization in the amorphous strip, which induces an AC voltage in the receiver antenna. If this signal meets the required parameters (correct frequency, repetition etc.) the alarm is activated.

When the semi-hard magnet is magnetized, the tag is activated. The magnetized strip makes the amorphous strip respond much more strongly to the detectors, because the DC magnetic field given off by the strip offsets the magnetic anisotropy within the amorphous metal. The tag can also be deactivated by demagnetizing the strip, making the response small enough so that the detectors will not detect it. These tags are thicker than magnetic tags and are thus seldom used for books. However they are relatively inexpensive and have better detection rates (fewer false positives and false negatives) than magnetic tags.

Radio-Frequency Based EAS Systems

The Series 304 RF EAS label is essentially an LC tank circuit that has a resonance peak anywhere from 1.75 MHz to 9.5 MHz. The most popular frequency is 8.2 MHz. Sensing is achieved by sweeping around the resonant frequency and detecting the dip. Deactivation for 8.2 MHz label tags is achieved by detuning the circuit by partially destroying the capacitor. This is done by submitting the tag to a strong electromagnetic field at the resonant frequency that will induce voltages exceeding the capacitor's breakdown voltage, which is artificially reduced by puncturing the tags.

Microwave Based EAS systems

These permanent tags are made of a non-linear element (a diode) coupled to one microwave and one electrostatic antenna. At the exit, one antenna emits a low-frequency (about 100 kHz) field, and another one emits a microwave field. The tag acts as a mixer remitting a combination of signals from both fields. This modulated signal triggers the alarm. These tags are permanent and somewhat costly. They are mostly used in clothing stores.

Over the past decade, Radio-frequency identification (RFID) technology has become increasingly popular in retail environments. A primary reason for this increase in popularity is it allows for the unique identification of product items, and the writing of data to RFID tags or labels, allowing the collection of item-level intelligence provider great visibility. RFID technology uses communication via radio waves to exchange data between a reader and an electronic tag attached to an object, for the purpose of identification and tracking Some RFID tags can be read from several meters away and beyond the line of sight of the reader. The application of bulk reading enables an almost parallel reading of tags.

Radio-frequency identification involves the use of interrogators (also known as readers), and tags (also known as labels) applied to objects. Most RFID tags contain at least two components. One component is an integrated circuit for storing and processing information, modulating and demodulating a radio-frequency (RF) signal, and other specialized functions. The other component is an antenna for receiving and transmitting the signal.

There are three types of RFID tags: passive RFID tags, which have no power source and require an external electromagnetic field to initiate a signal transmission; active RFID tags, which contain a battery and can transmit signals once an external source ('Interrogator') has been successfully identified; and battery-assisted passive (BAP) RFID tags, which require an external source to wake up, but have a significantly higher forward link capability providing greater range.

Today, there are UHF-based RFID hang tags, compliant with the EPC Gen 2 standard, that can be clipped or otherwise embedded within apparel items, and tracked quickly so that all the information about the garment (e.g. the product name, model number, place of origin to its location, etc) can be detected by an RFID (UHF) antenna and displayed on the host computer. The UHF EPC Gen 2 hangtag offers password protection to protect important data in the RFID tag. Using EPC Gen 2 tags, it is possible to better manage processes along the supply chain, in the distribution center, and at the point of sale. Currently, RFID tag products are sold by Checkpoint Systems, and Sensormatic/TYCO, and other vendors described at http://www.rfidtags.com In an effort to exercise greater control over its supply chain operations, some large retailers, including Walmart, are seeking to require its vendors to apply low-cost RFID tags, encoded with the Electronic Product Code (EPC), to their products in accordance with the EPCglobal Tag Data Standard.

Also, some retail-based systems are now supporting dual or hybrid EAS-RFID tags, that include both (i) an EAS component for item-level security and (ii) an RFID component for real-time inventory control (i.e. visibility). The EAS component, which includes an electromagnetically detectable element, helps prevent theft in the retail store environment. The Item-level RFID component, which stores an electronic product code (EPC) within the tag, drives item level information/intelligence back into the supply chain—to improve existing store operations, increase product availability, and enhance the customer shopping experience.

While EAS tags, RFID tags and hybrid EAS-RFID tags (i.e. Electro-Magnetically Sensible or EMS tags) are often applied to products at the retail side of the value chain, EAS and RFID tags can be applied to products at the source, i.e. the supplier or manufacturer. This is called "source tagging" which, for the retailer, eliminates the labor expense needed to apply the EMS tags themselves, and reduces the time between receipt of merchandise and when the merchandise is ready for sale. For the supplier, the main benefit of source tagging is the preservation of the retail packaging aesthetics by easing the application of security tags within product packaging. Source tagging allows the EM tags to be concealed and more difficult to remove.

Unsolved Problems at the POS Station

U.S. Pat. Nos. 7,172,123; 7,170,414; 6,788,205; 6,764,010 and 6,942,145 describe a number of POS-based checkout systems employing primarily EAS tag deactivation methods.

However, despite recent advances in EAS, RFID and hybrid EAS/RFID systems, shoplifters today can still easily steal an item by the 'replacing' or "switching" the barcode of a high-priced item with the barcode taken from a low-priced item, during product checkout operations at the POS station. This can be accomplished in one of several possible ways.

One way to switch prices at the POS station is by taking both a high-priced item and a low priced item to the self-checkout, or a cooperating cashier, and reading the barcode label on the low priced item, while simultaneously passing the high-priced item into the shopping bag (i.e. sweet-hearting).

Another way to switch prices at the POS station is to remove the barcode label from the low-priced item, and place it on the high-priced item, so that when the high-priced item is scanned, the low-priced item barcode will be scanned and read by the POS station.

In both cases described above, the thief is only charged for the low-priced item, and the retail merchant sustains a loss.

While U.S. Pat. No. 7,374,092 to Acosta et al., U.S. Pat. No. 7,495,564 to Harold et al. and U.S. Pat. No. 6,788,205 to Mason et al. each disclose the deployment of EAS tag deactivation coils (i.e. antennas) at the POS station, so that a product's EAS tag can be automatically deactivated upon the successful reading of its barcode label, such POS-based EAS systems fail to provide any way of preventing the above-described theft schemes described above.

Therefore, there still remains a great need in the art for an improved POS-based bar code symbol reading checkout system which is capable of supporting improved levels of electronic article surveillance at the POS station, while avoiding the shortcomings and drawbacks of prior art systems and methodologies.

OBJECTS AND SUMMARY

Accordingly, a primary object of the present disclosure is to provide an improved POS-based checkout system and method that supports improved levels of product checkout and electronic article surveillance while products are being purchased in POS environments, while avoiding the shortcomings and drawbacks of prior art systems and methodologies.

Another object is to provide a POS-based system for carrying out a two-factor authentication process which involves the use of first and second factors for authentication purposes at the POS checkout system, wherein the first factor is a product identification code classification (i.e. special or non-special) applied to each product being sold in the retail environment, and wherein the second factor is a product security code classification (e.g. special or non-special) applied to each product being sold in the retail environment, and is used to carry out a security function in the retail environment.

Another object is to provide a POS-based checkout system that supports a two-factor authentication process using a database, a product identification code reading subsystem, a product security code reading subsystem, a data processing subsystem, and an information indication module.

Another object is to provide a POS-based system, wherein the database is a relational database management system (RDBMS) that maintains information relating to the price of coded products offered for said retail environment and scanned at the POS-based checkout system, and also relating to whether or not any scanned coded product has been classified as a special product and applied a special security code, or a non-special product and applied a non-special security code, to assist in carrying out a two-factor authentication process supported at the POS-based checkout system, where coded products are purchased and theft activity might be pursued.

Another object is to provide a POS-based system, wherein the product identification code reading subsystem is operably connected to the database, for reading product identification codes on coded products that are passed through a point of sale (POS), and generating code data for each product identification code read for the purpose of identifying the coded product, and determining the purchase price of the coded product.

Another object is to provide such a POS-based system, wherein the security classification code reading subsystem is operably connected to the database, for detecting product security codes (e.g. EAS tags, RFID tags, etc) passing through the POS during product checkout operations.

Another object is to provide a POS-based system, wherein the data processing subsystem for processing data and determining whether or not each coded product being purchased satisfies the two-factor authentication process, and wherein the compliance indication module generates an indication when the two-factor authentication process is breached during the checkout of a product being purchased at the POS-based checkout system.

Another object is to provide a POS-based checkout system that supports a two-factor authentication process, wherein the first factor (i.e. product identification code) is realized as a unique bar code symbol on each product, while the second factor (i.e. product security code) is realized an EAS tag or label assigned to each high priced or high-security-risk class of products sold within a retail environment.

Another object is to provide a POS-based checkout system that supports a two-factor authentication process, where the first factor (i.e. product identification code) is realized as an EPC-encoded RFID tag or label (i.e. electronic code), provide product level identification to the POS-based checkout system, while the second factor (i.e. product security code) is realized an EAS tag or label assigned to each high priced or high-security-risk class of products sold within a retail environment.

Another object is to provide a POS-based checkout system that supports a two-factor authentication process, wherein the first factor (i.e. product identification code) is realized as a unique bar code symbol on each product, while the second factor (i.e. product security code) is realized an RFID tag or label (with appropriate coding) applied to high-priced products involved in the two-factor authentication process.

Another object is to provide such a POS-based checkout system equipped with a bar code symbol reader and an EAS tag detector and deactivator at the POS station so that the EAS tag detector can electromagnetically probe the area around the bar code reader for EAS tags when the bar code reader reads a bar code label on a product being scanned at the POS station.

Another object is to provide such a POS-based checkout system that automatically generates visual and/or audible security alerts (i.e. messages) to the checkout operator whenever the checkout system automatically detects a failure (i.e. breach) of the two-factor authentication process, based on real-time analysis of the product identification code and security code records maintained in a database supporting the POS-based checkout system.

Another object is to provide a POS-based checkout system that supports a two-factor authentication process, which reduces the likelihood of successful "sweet-hearting" attempted between a cashier and a customer in a retail checkout station.

These and other objects will become apparent hereinafter and in the Claims appended hereto.

BRIEF DESCRIPTION OF THE DRAWINGS

In order to more fully understand the objects of the present disclosure, the following Detailed Description of the Illustrative Embodiments should be read in conjunction with the accompanying figure Drawings in which:

FIG. 1 is a table listing the two-factor authentication scenarios (i.e. Scenario Nos. 1 through 8) supported by the POS-based checkout system illustrated in the generalized embodiment shown in FIGS. 1A1 through 1A8;

FIG. 1A1 is a schematic representation of the two-factor authentication process of the present disclosure being carried out at a point of sale (POS) in a retail environment using the POS-based checkout system of the present disclosure, illustrating Scenario No. 1, where a product has been assigned to the "special" product class (implying the product requires "special" security and/or handling measures) and where a special bar code symbol (e.g. label) is applied to the special product and detected at the POS station, while a special security tag is applied to the special product and detected at the POS station, and the POS checkout system correctly generates a two-factor authentication compliance signal;

FIG. 1A2 is a schematic representation of the two-factor authentication process of the present disclosure being carried out at a point of sale (POS) in a retail environment using the POS-based checkout system, illustrating Scenario No. 2, when a product has been assigned to the special product class, and where a special bar code symbol is applied to a special product and detected at POS station, while a security tag is not applied to the special product or detected at the POS station, and the POS checkout system correctly generates a two-factor authentication non-compliance signal;

FIG. 1A3 is a schematic representation of the two-factor authentication process of the present disclosure being carried out at a point of sale (POS) in a retail environment using the POS-based checkout system, illustrating Scenario No. 3, when a product has been assigned to the special product class, and where a non-special bar code symbol is applied to a special product and detected at the POS station, while a special security tag is applied to the special product and detected at the POS station, and the POS checkout system correctly generates a two-factor authentication non-compliance signal;

FIG. 1A4 is a schematic representation of the two-factor authentication process of the present disclosure being carried out at a point of sale (POS) in a retail environment using the POS-based checkout system, illustrating Scenario No. 4, when a product has been assigned to the special product class, and where a non-special bar code symbol is applied to a special product and detected at the POS station, while a special security tag is not applied to the product or detected at the POS station, and the POS checkout system incorrectly generates a two-factor authentication compliance signal (because the two-factor authentication process has been successfully thwarted by the thief);

FIG. 1A5 is a schematic representation of the two-factor authentication process of the present disclosure being carried out at a point of sale (POS) in a retail environment using the POS-based checkout system, illustrating Scenario No. 5, when a product has been assigned to the "non-special" product class (implying the product does not require "special" security and/or handling measures) and where a non-special bar code symbol (e.g. label) is applied to the non-special product and detected at the POS station, while a special security tag is not applied to the product or detected at the POS station, and the POS checkout system correctly generates a two-factor authentication compliance signal;

FIG. 1A6 is a schematic representation of the two-factor authentication process of the present disclosure being carried out at a point of sale (POS) in a retail environment using the POS-based checkout system, illustrating Scenario No. 6, when a product has been assigned to the non-special product class, and where a special bar code symbol is applied to a "non-special" product and detected at the POS station, while a special security tag is applied to the non-special product and detected at the POS station, and the POS checkout system incorrectly generating a two-factor authentication compliance signal, as a result of store error, which may be detected by the customer in the event they believe they are being charged too much for the item;

FIG. 1A7 is a schematic representation of the two-factor authentication process of the present disclosure being carried out at a point of sale (POS) in a retail environment using the POS-based checkout system, illustrating Scenario No. 7, when a product has been assigned to the non-special product class, and where a special bar-code symbol is applied to the non-special product and detected at the POS station, while a special security tag is not applied to the product or detected at the POS station, and the POS checkout system correctly generate a two-factor authentication non-compliance signal;

FIG. 1A8 is a schematic representation of the two-factor authentication process of the present disclosure being carried out at a point of sale (POS) in a retail environment using the POS-based checkout system, illustrating Scenario No. 8, when a product has been assigned to the non-special product class, and where a non-special bar code symbol is applied to a non-special product and detected at the POS station, while a special security tag is applied to the product and detected at the POS station, and the POS checkout system correctly generates a two-factor authentication non-compliance signal;

FIGS. 1B1 and 1B2, taken together, present a flow chart describing the primary steps carried out during the method of two-factor authentication using the POS-based checkout system illustrated in FIGS. 1A1 through 1A8;

FIG. 2 is a perspective view of a retail point of sale (POS) based checkout station (i.e. system) according to a first illustrative of the present disclosure, showing a digital-imaging based bar code symbol reading subsystem, integrated with an EAS subsystem having an EAS tag detector and deactivator, for compact mounting in the countertop surface of the POS station;

FIGS. 2G1 and 2G2, taken together, presents a flow chart setting forth the major steps in the two-factor authentication process carried out at the retail POS checkout system of the first illustrative embodiment shown in FIG. 2;

FIG. 3 is a perspective view of a retail POS-based checkout station according to a second illustrative of the present disclosure, employing a laser-scanning bar code reading subsystem, electronic RFID tag reading/writing subsystem, and an EAS detection/deactivation subsystem, for compact mounting in the countertop surface of the POS station;

FIGS. 3E1 and 3E2, taken together, presents a flow chart setting forth the major steps in the two-factor authentication process carried out at the retail POS checkout station of the second illustrative embodiment;

FIG. 4 is a perspective view of a third illustrative embodiment of a hand-supportable POS checkout system, employing a digital imaging bar code symbol reader, an electronic RFID code reader, and an EAS tag detector/deactivator, and supporting the two-factor authentication process of the present disclosure;

Figure 2:
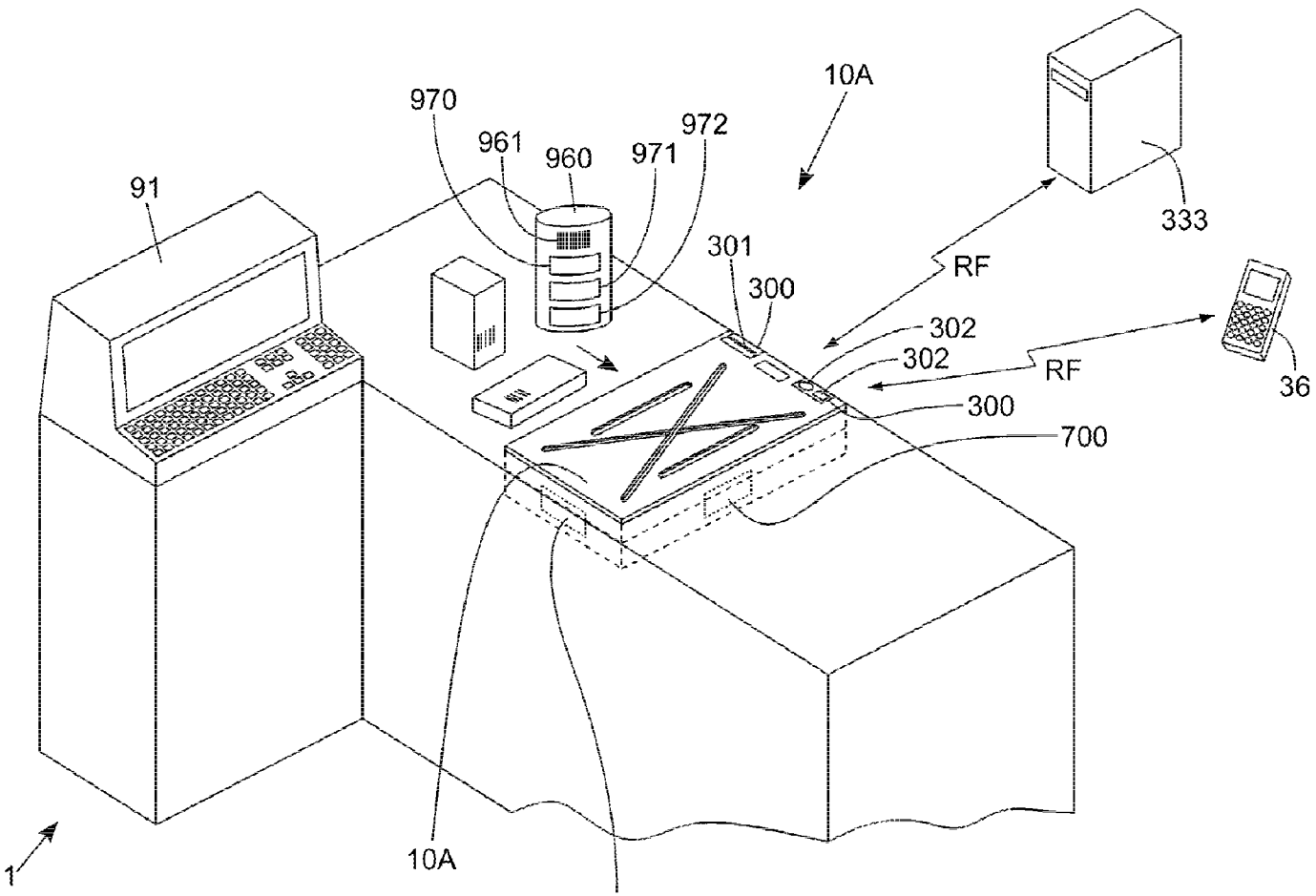
Figure 4:
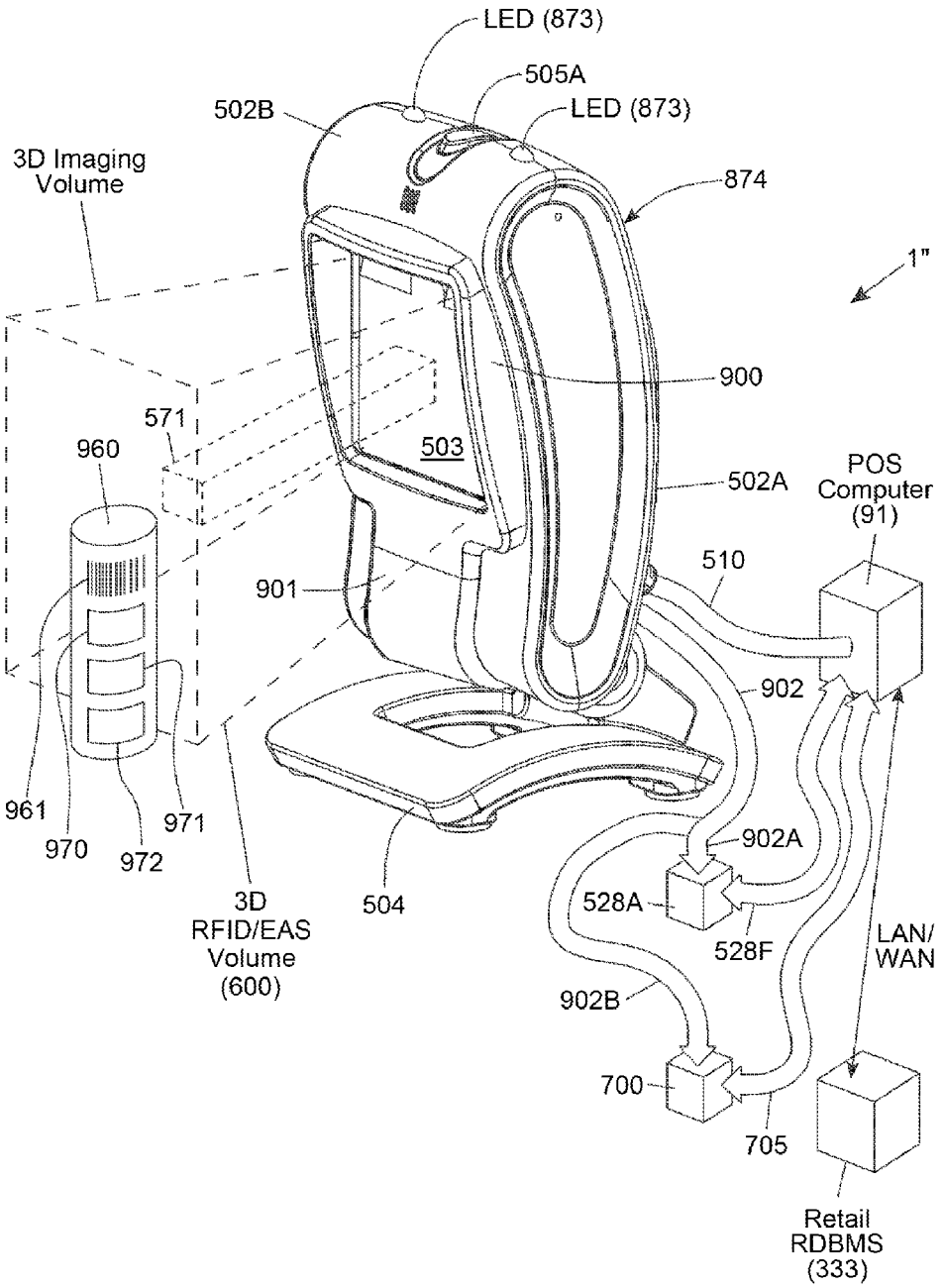
Figure 5A:
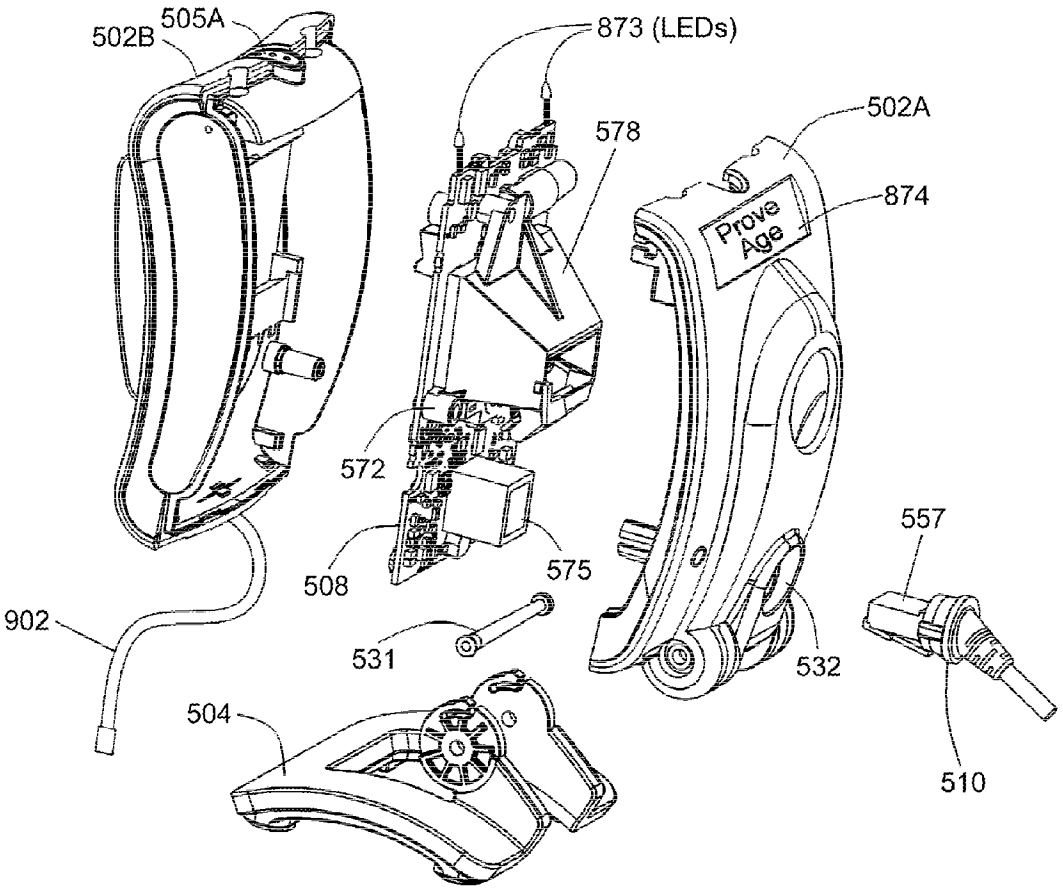
FIG. 5A is a first perspective exploded view of the hand-supportable POS checkout system of the illustrative embodiment depicted in FIG. 4, showing its printed circuit (PC)
Figure 5B:
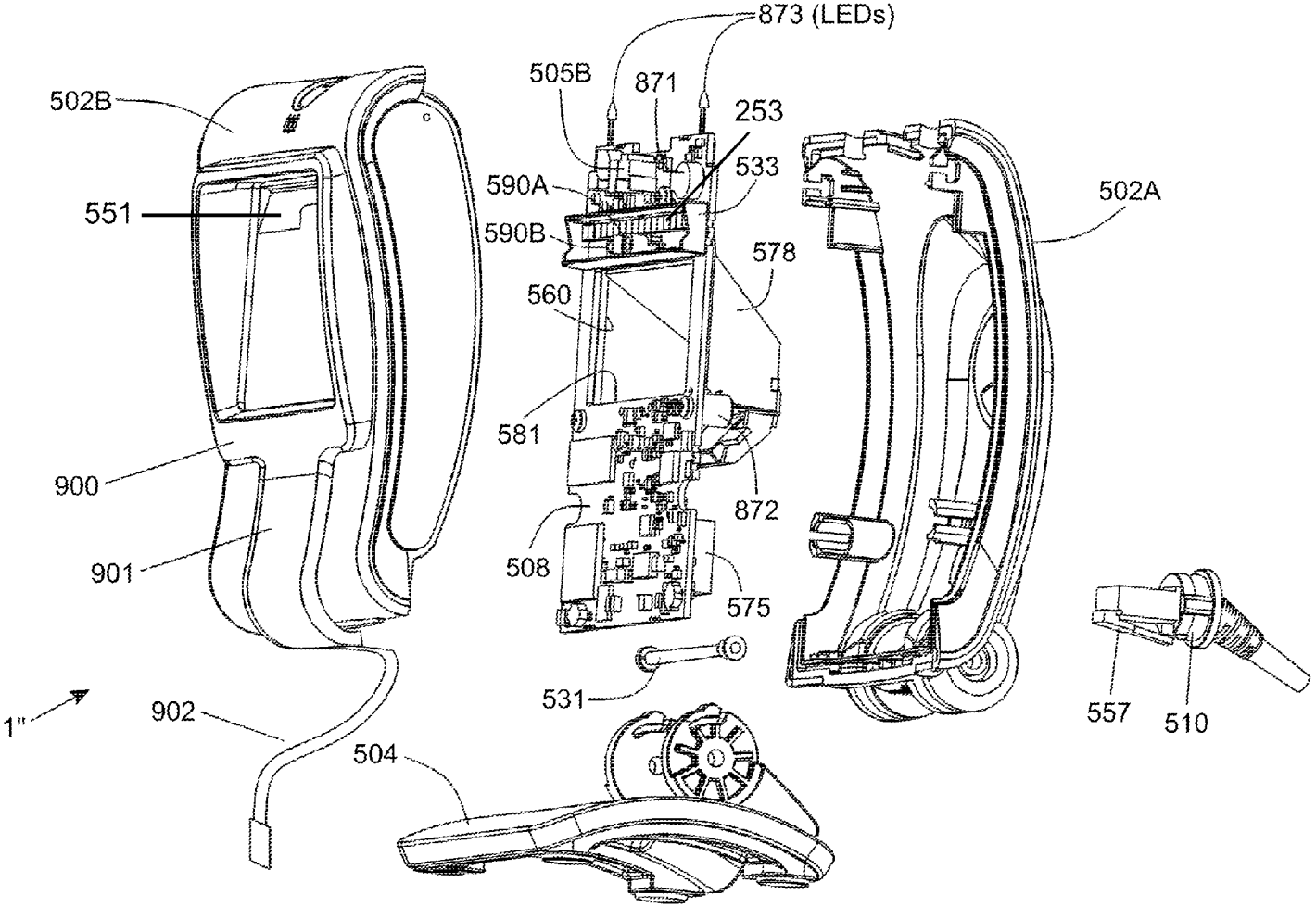
Figure 5C:
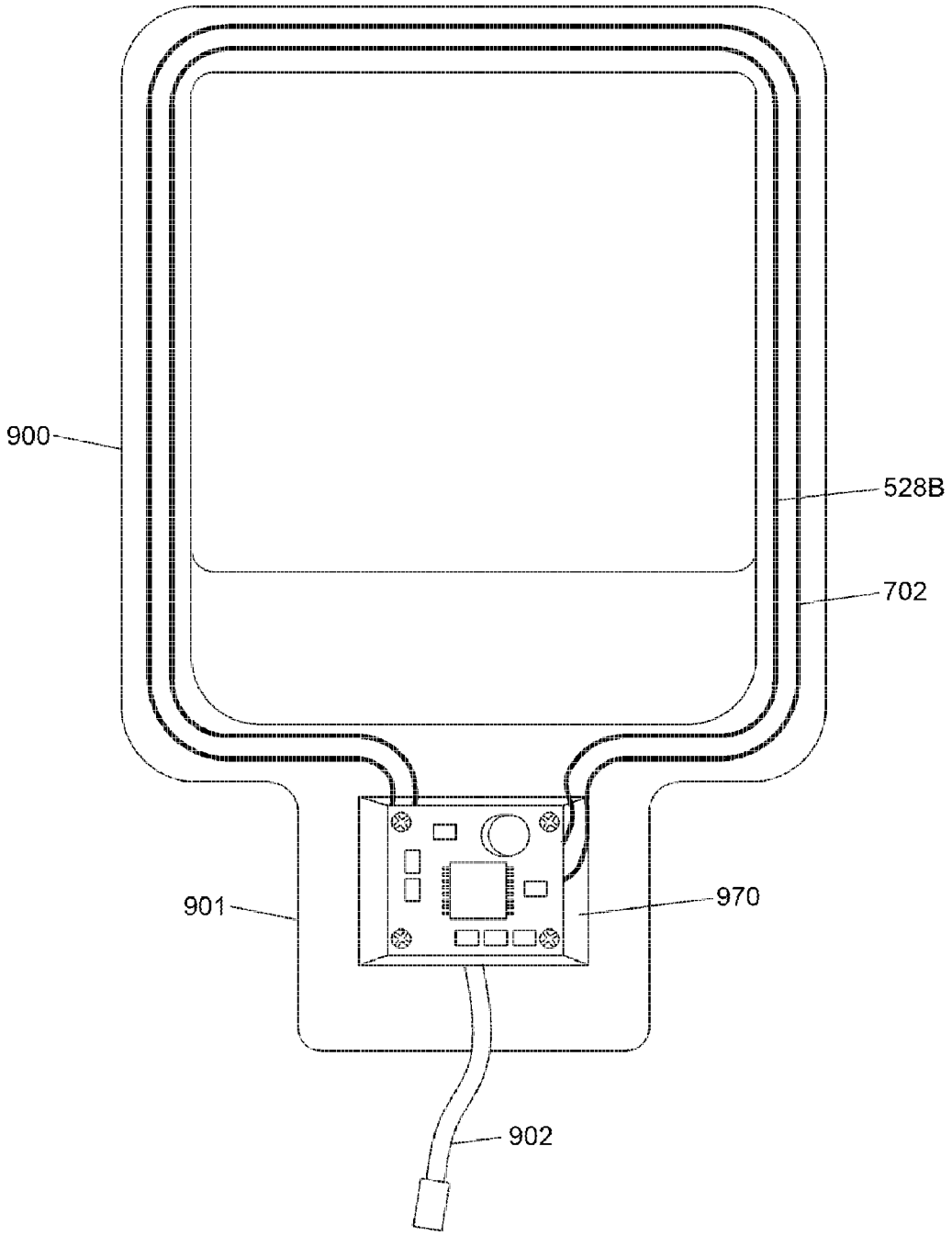
Figure 6B:
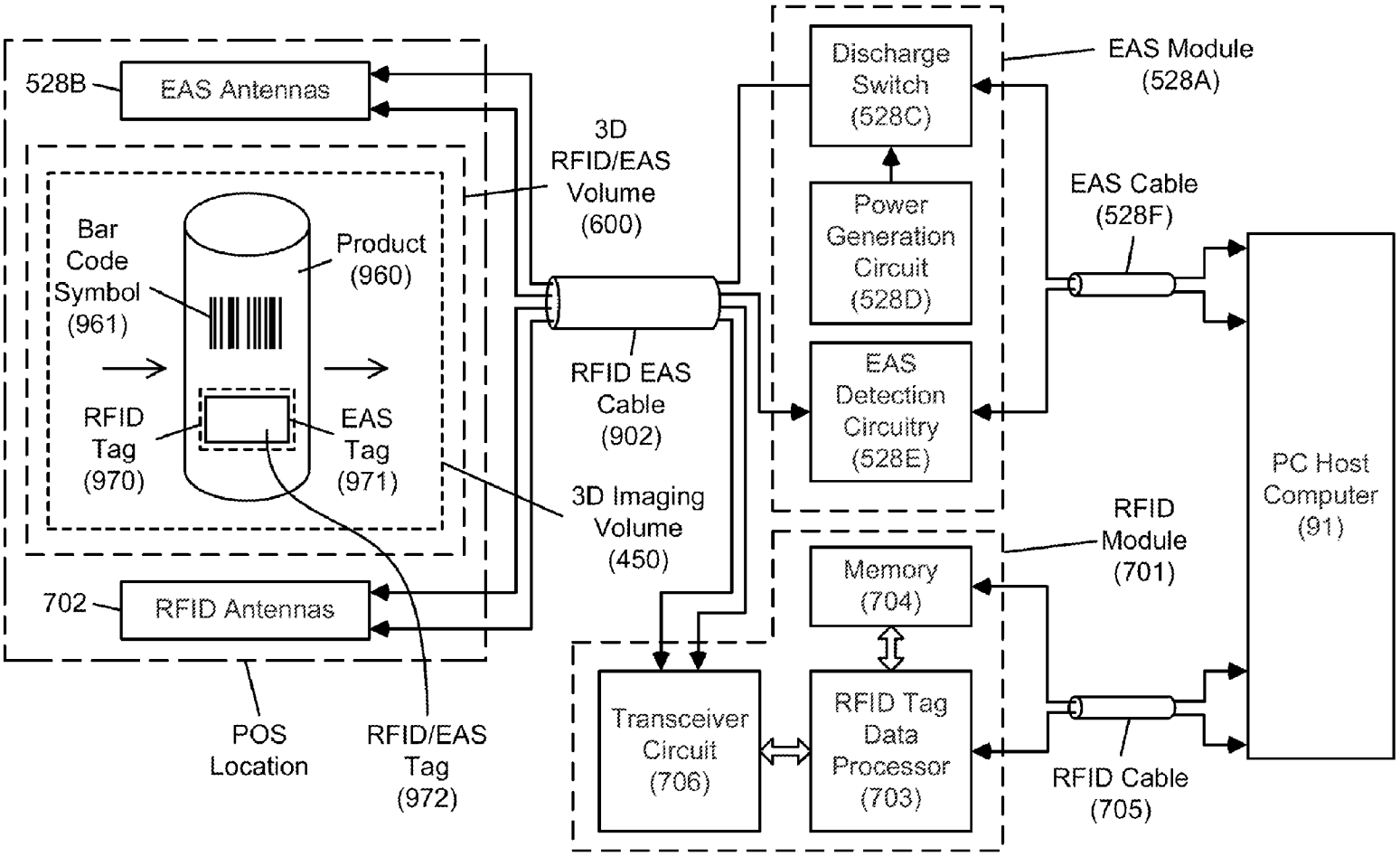
Figure 7A:
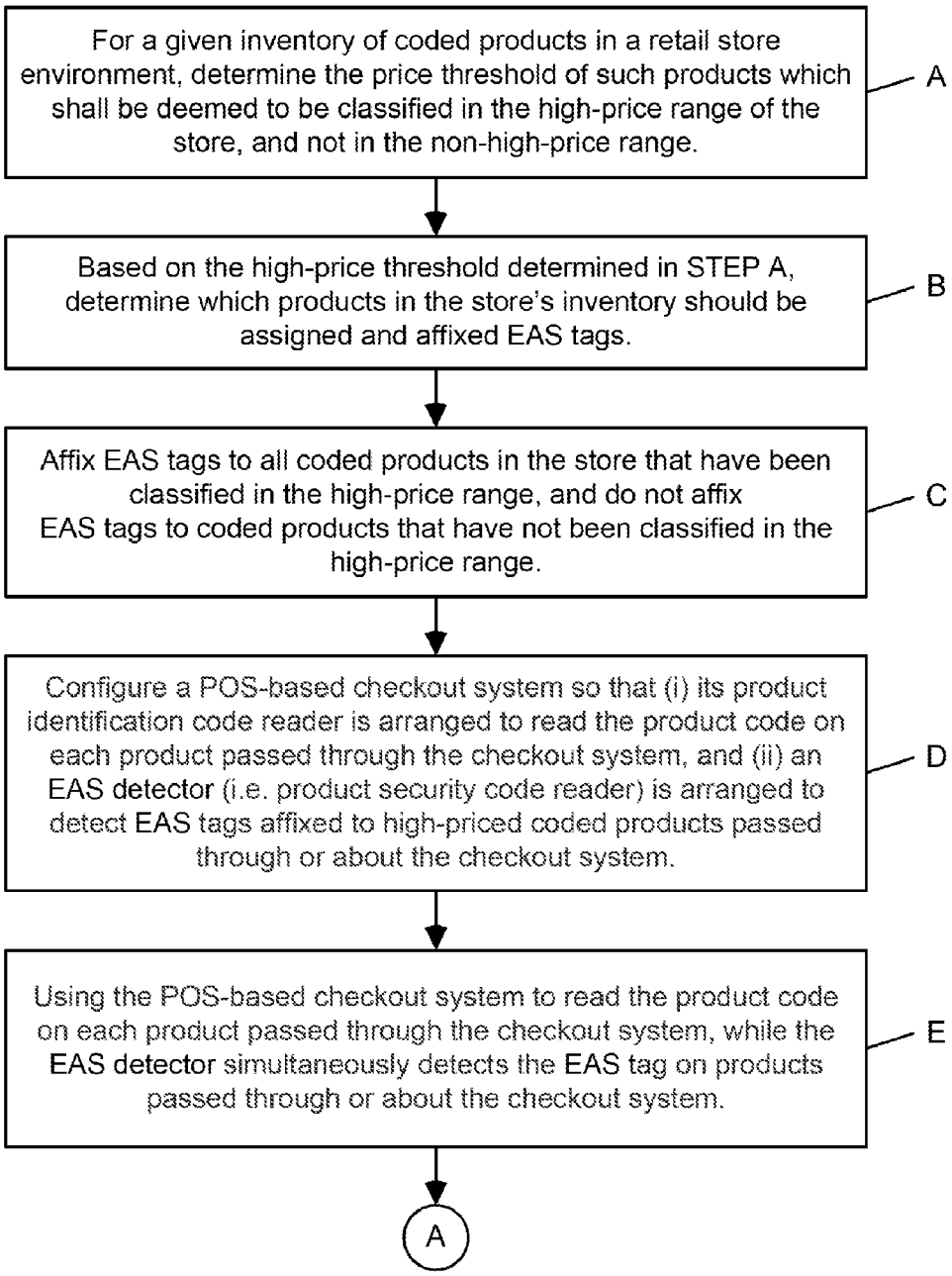
Figure 7B:
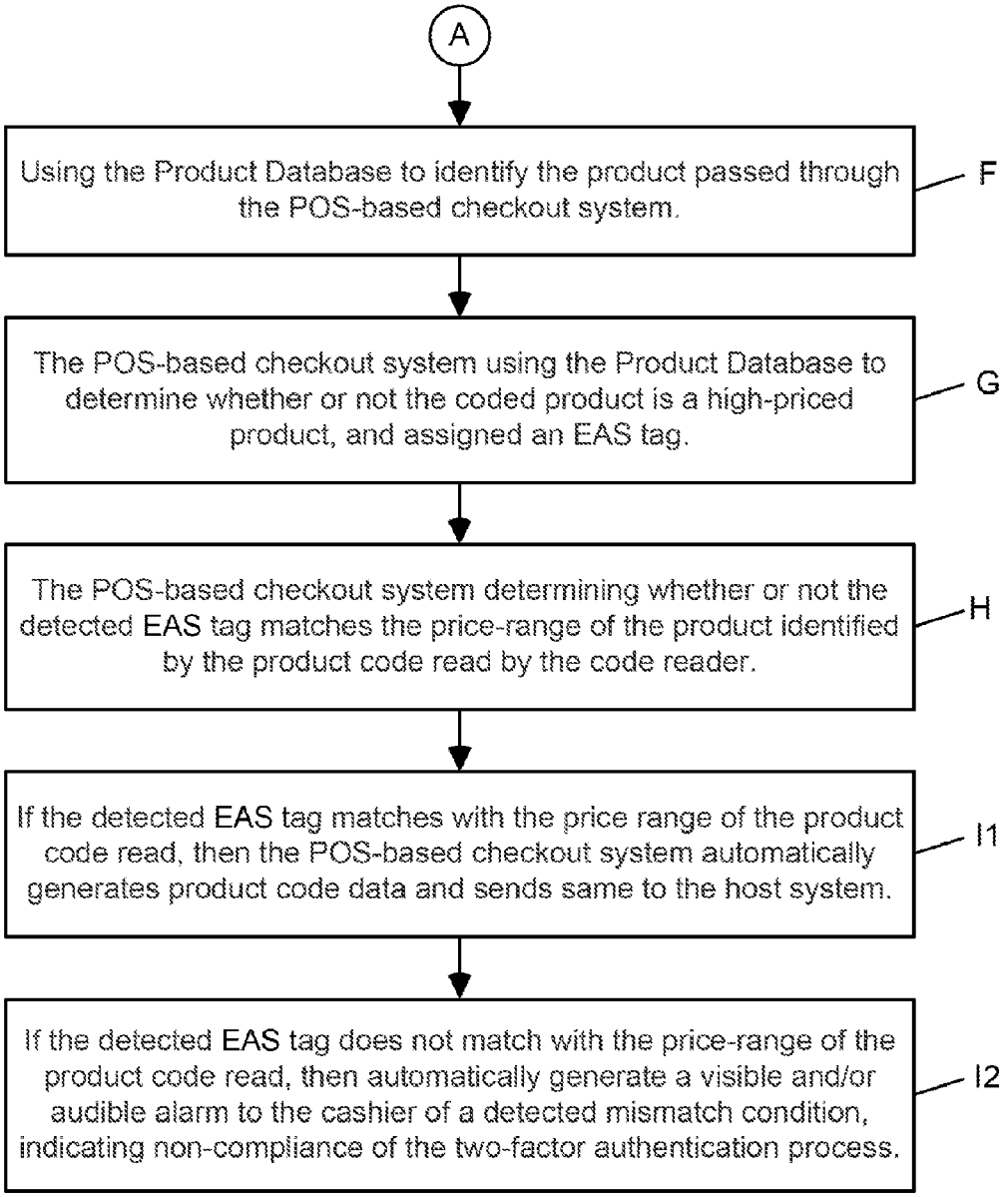
Figure 8:
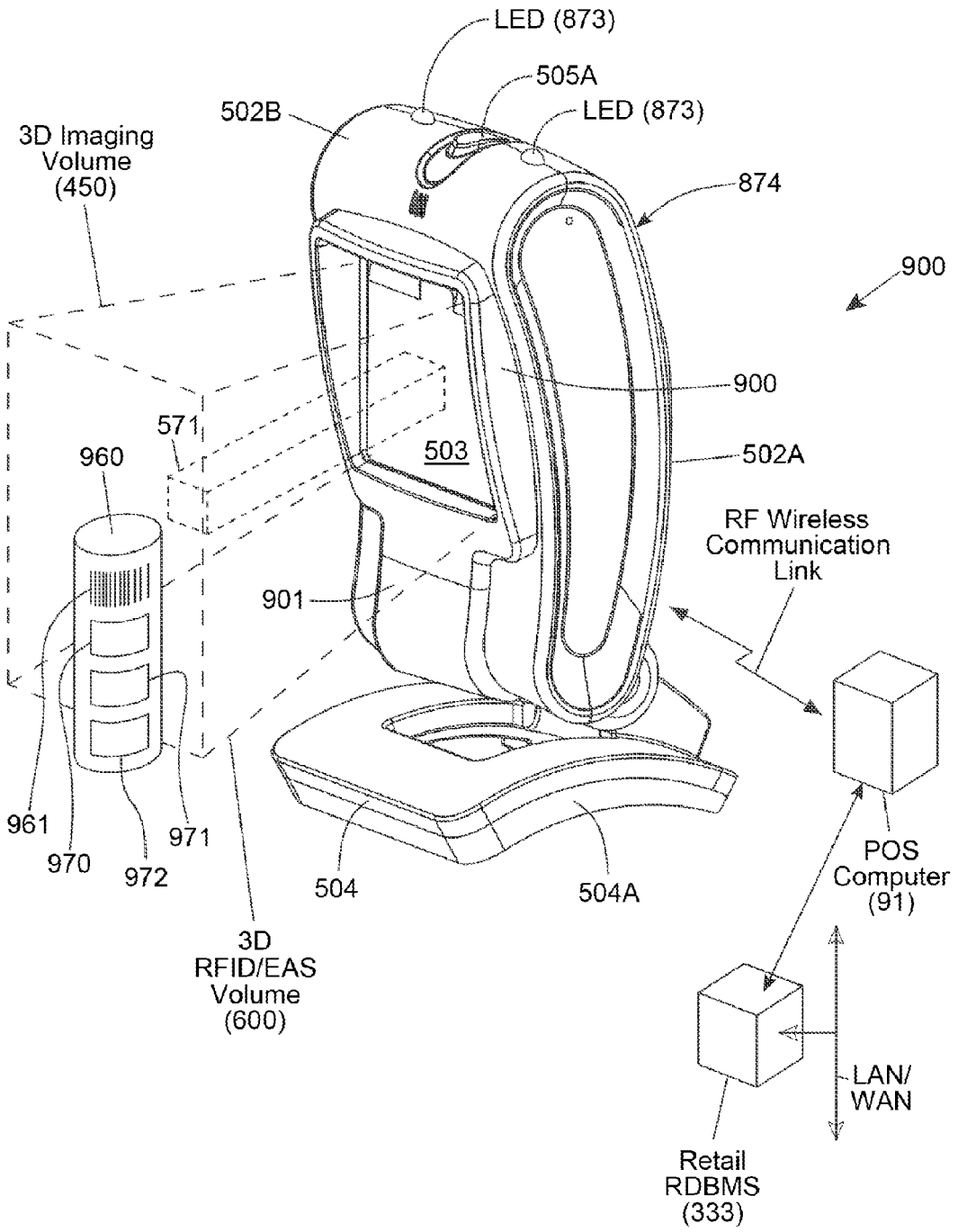
Figure 9A:
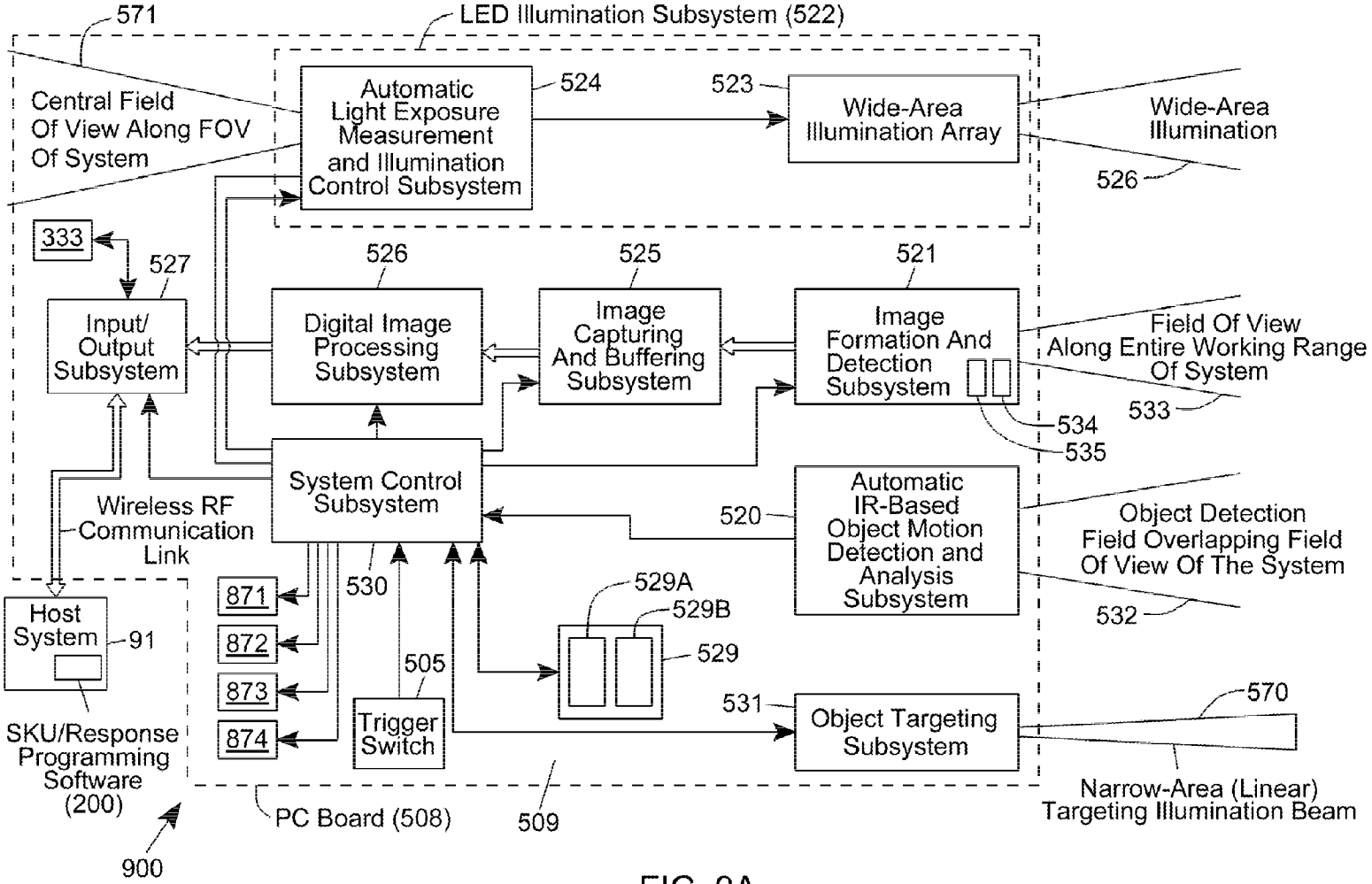
Figure 9B:
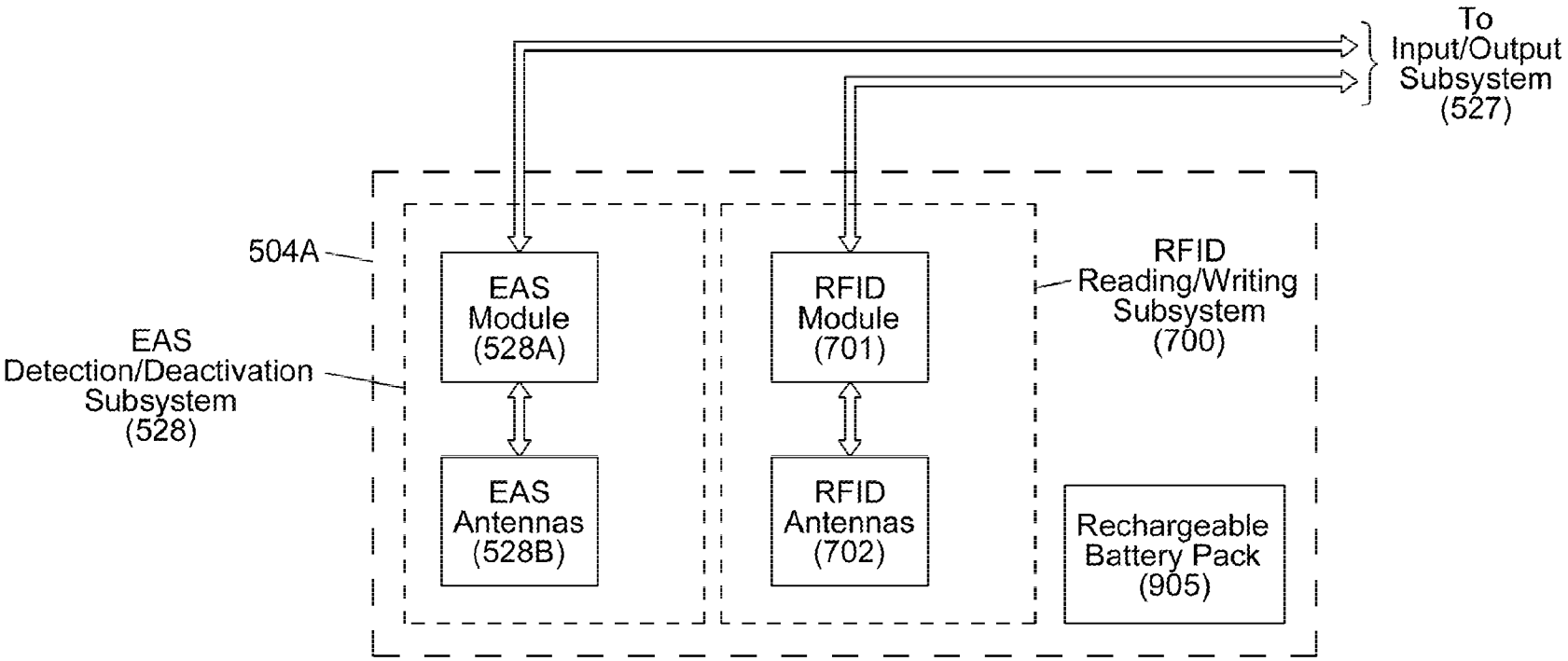

board assembly arranged between the front and rear portions of the system housing, with the hinged base being pivotally connected to the rear portion of the system housing by way of an axle structure;

FIG. 5B is a second perspective/exploded view of the hand-supportable POS checkout system of the illustrative embodiment shown in FIG. 4;

FIG. 5C is a plan view of the rear side of the RFID/EAS enabling faceplate bezel employed in the hand-supportable POS checkout system of FIG. 4, shown removed from the hand-supportable POS checkout system of FIG. 4;

FIGS. 6A1 and 6A2, taken together, show a schematic block diagram describing the major system components of the hand-supportable POS checkout system illustrated in FIGS. 4 through 5C, including the RFID subsystem and EAS subsystems embedded within the hand-supportable POS checkout system of FIG. 4;

FIG. 6B is a block schematic representation showing (i) the primary components comprising the EAS detection/deactivation subsystem and RFID reading/writing subsystem specified in FIG. 6A2 and employed in the POS-based checkout system of FIG. 2, and (ii) the spatial relationships between the 3D imaging volume and the 3D RFID/EAS volume of the system;

FIGS. 7A and 7B, taken together, presents a flow chart setting forth the major steps of the two-factor authentication process carried out at the POS-based checkout system of FIG. 4;

FIG. 8 is a perspective view of a fourth illustrative embodiment of a mobile POS-based system, supporting the two-factor authentication process of the present disclosure; and FIGS. 9A and 9B, taken together, show a schematic block diagram describing the major system components of the POS-based checkout system of FIG. 8.

DETAILED DESCRIPTION OF THE ILLUSTRATIVE EMBODIMENTS

Referring to the figures in the accompanying Drawings, the various illustrative embodiments of the apparatus and methodologies will be described in great detail, wherein like elements will be indicated using like reference numerals.

The Two-Factor Authentication Process Carried Out at a Point of Sale (POS) Using a Generalized Embodiment of the POS-Based Checkout System FIGS. 1 through 1A8 illustrate the two-factor authentication process of the present disclosure being carried out at a point of sale (POS) in a retail environment using a generalized embodiment of the POS-based checkout system of the present disclosure. The two-factor authentication process involves the use of first and second factors for authentication purposes at POS checkout system where products are being purchased and theft activity might be pursued. The first factor is a product identification code (i.e. special or non-special classification) applied to each coded product being sold in the retail environment. The second factor is a product classification code (i.e. special or non-special classification) applied to each special product being sold in the retail environment, and is used to carry out a security function in the retail environment.

FIG. 1 lists the eight (8) logically possible scenarios associated with the two-factor authentication process and system schematically illustrated in FIGS. 1A1 through 1A8. As shown in FIGS. 1A1 through 1A8, the POS-based checkout system comprises: a database; a product identification code reading subsystem; a product security code reading subsystem; a data processing subsystem; and a compliance indication module. Preferably, the database is a relational database management system (RDBMS) that maintains information relating to (i) the price of coded products offered for the retail environment and scanned at the POS-based checkout system, and also (ii) whether or not any scanned coded product has been classified as a special product and applied a security classification code to assist in carrying out a two-factor authentication process supported at the POS-based checkout system, where coded products are purchased and theft activity might be pursued.

As shown, the product identification code reading subsystem is operably connected to the database, and reads product identification codes on coded products that are passed through a point of sale (POS), and generates code data for each product identification code read for the purpose of identifying each coded product, and determining the purchase price of the coded product. The product security code reading subsystem is also operably connected to the database, and detects security codes (e.g. special or non-special classification) passing through the POS during product checkout operations. The data processing subsystem processes product identification code data and security classification code data collected at the POS during product checkout operations, and determines whether or not each coded product satisfies the two-factor authentication process. The compliance indication module generates an indication of whether the product two-factor authentication process is breached during the checkout of each product being purchased at the POS-based checkout system.

In general, the two-factor authentication process and system of the present disclosure supports eight (8) unique scenarios described in detail below.

FIG. 1A1 illustrates the two-factor authentication process of the present disclosure carried out at a POS in a retail environment using the POS-based checkout system of the present disclosure, operating in Scenario No. 1, where a product has been assigned to the "special" product class (implying the product requires "special" security and/or handling measures) and where a special bar code symbol (e.g. label) is applied to the special product and detected at the POS station, while a special security tag is applied to the special product and detected at the POS station. During this scenario, the POS checkout system correctly generates a two-factor authentication compliance signal. This scenario describes to the situation where a special classified product is properly bar-coded and security tagged.

FIG. 1A2 illustrates the two-factor authentication process of the present disclosure being carried out at a POS in a retail environment using the POS-based checkout system, operating in Scenario No. 2, where (i) a product has been assigned to the special product class, (ii) a special bar code symbol is applied to a special product and detected at POS station, and (iii) a security tag is not applied to the special product or detected at the POS station. During this scenario, the POS checkout system correctly generates a two-factor authentication non-compliance signal. This scenario describes to the situation where a special classified product is properly bar-coded but never had its security tag attached due to store error, or because the security tag was removed by a customer before presentation to the POS station.

Figure 3:
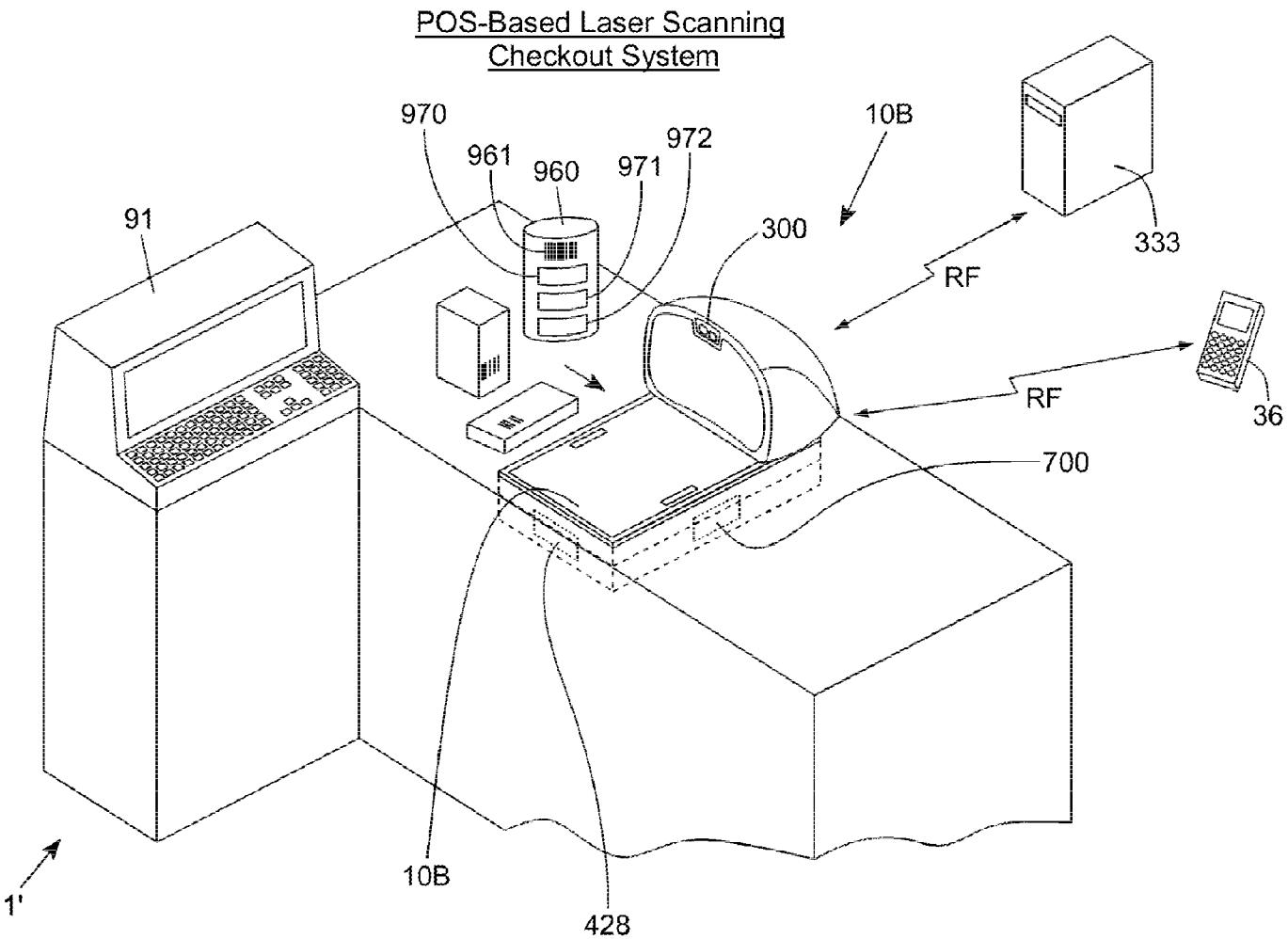

FIG. 1A3 illustrates the two-factor authentication process of the present disclosure being carried out at a POS in a retail environment using the POS-based checkout system, operating in Scenario No. 3, where (i) a product has been assigned to the special product class, (ii) a non-special bar code symbol is applied to a special product and detected at the POS station, and (iii) a special security tag is applied to the special product and detected at the POS station. During this scenario, the POS checkout system correctly generates a two-factor authentication non-compliance signal. This scenario describes to a potential theft situation where the bar code label on a special classified product has been altered by a customer, but who failed to remove its security tag.

FIG. 1A4 illustrates the two-factor authentication process of the present disclosure being carried out at a POS in a retail environment using the POS-based checkout system, operating in Scenario No. 4, where (i) a product has been assigned to the special product class, (ii) a non-special bar code symbol is applied to a special product and detected at the POS station, and (iii) a special security tag is not applied to the product or detected at the POS station. During this scenario, the POS checkout system incorrectly generates a two-factor authentication compliance signal (because the two-factor authentication process has been successfully thwarted by the thief). This scenario describes the situation where a customer thief has defeated both authentication factors or where a special product has been improperly bar-coded and improperly security coded (i.e. tagged), and the two-factor authentication process has failed in error.

FIG. 1A5 illustrates the two-factor authentication process of the present disclosure being carried out at a POS in a retail environment using the POS-based checkout system, operating in Scenario No. 5, where (i) a product has been assigned to the "non-special" product class (implying the product does not require "special" security and/or handling measures), (ii) a non-special bar code symbol (e.g. label) is applied to the non-special product and detected at the POS station, and (iii) a special security tag is not applied to the product or detected at the POS station. During this scenario, the POS checkout system correctly generates a two-factor authentication compliance signal. This scenario describes to the situation where a non-special classified product is properly bar-coded and properly security coded (i.e. not tagged).

FIG. 1A6 illustrates the two-factor authentication process of the present disclosure being carried out at a POS in a retail environment using the POS-based checkout system, operating in Scenario No. 6, where (i) a product has been assigned to the non-special product class, (ii) a special bar code symbol is applied to a "non-special" product and detected at the POS station, and (iii) a special security tag is applied to the non-special product and detected at the POS station. During this scenario, the POS checkout system incorrectly generates a two-factor authentication compliance signal. This scenario describes to the situation where a non-special classified product is improperly bar-coded and improperly security coded (i.e. tagged), but may be detected by the customer at the POS station (e.g. because the item price is apparent too high).

FIG. 1A7 illustrates the two-factor authentication process of the present disclosure being carried out at a POS in a retail environment using the POS-based checkout system, operating in Scenario No. 7, where (i) a product has been assigned to the non-special product class, (ii) a special bar-code symbol is applied to the non-special product and detected at the POS station, and (iii) a special security tag is not applied to the product or detected at the POS station. During this scenario, the POS checkout system correctly generates a two-factor authentication non-compliance signal. This scenario describes to the situation where a non-special classified product is improperly bar-coded and properly security coded (i.e. not tagged), and the two-factor authentication process correctly generates a non-compliance signal.

FIG. 1A8 illustrates the two-factor authentication process of the present disclosure being carried out at a POS in a retail environment using the POS-based checkout system, operating in Scenario No. 8, where (i) a product has been assigned to the non-special product class, (ii) a non-special bar code symbol is applied to a non-special product and detected at the POS station, and (iii) a special security tag is applied to the product and detected at the POS station. During this scenario, the POS checkout system correctly generates a two-factor authentication non-compliance signal. This scenario describes to the situation where a non-special classified product is properly bar-coded but improperly security tagged at the POS station, due to store error.

While the two-factor authentication process described above is not 100% fool proof, it does provide a superior way to detect POS theft detection, than provided by conventional 1-factor authentication techniques. Also, there are many possible ways of and means for implementing the two-factor authentication process described above at retail POS stations. Several different kinds of POS-based checkout systems with the capacity to carry out the two-factor authentication process above will be described in detail below.

In the illustrative embodiments, shown in FIGS. 2 through 9B, the product identification code (i.e. the first factor) is shown realized as a unique optically-encoded bar code symbol (e.g. UPC, EAN) and/or a unique electronically-encoded RFID tag or label (e.g. EPC) applied to each product being sold in a retail environment regardless of price level or security level in the retail store environment. Also, the product security code (i.e. the second factor) is shown realized as an electronic article security tag, label or code, such as an EAS tag or a (specially encoded) RFID tag applied to each special product (e.g. high-priced product) being sold in the retail environment, to achieve particular security objectives in the retail environment. It is understood, however, that alternative embodiments of the two-factor authentication process and system are possible, as described hereinafter.

The flow chart set forth in FIGS. 1B1 and 1B2 describes the primary steps carried out during the method of two-factor authentication using the generalized POS-based checkout system illustrated in FIGS. 1A1 through 1A8.

As indicated at Block A in FIG. 1B, the method involves providing a POS-based checkout system as described above at a point of sale (POS) in a retail environment.

As indicated at Block B in FIG. 1B, the method involves, for a given inventory of coded products in the retail environment, determining which coded products shall be determined to be special products, requiring a special level of security in the retail environment.

As indicated at Block C, the method involves entering product identification code information into a database, identifying each special product and non-special product in the inventory.

As indicated at Block D, the method involves affixing a special security code to each special product.

As indicated at Block E, the method involves, for each coded product being purchased at the POS, using the product identification code reader to read the product identification code on each coded product passed through the POS, and simultaneously using the security code detector (i.e. product security code reader) to attempt to detect a special security code on the coded product passed through the POS.

As indicated at Block F, the method involves using the database to identify the coded product passed through the POS, and determining whether or not a special security code has been detected while a product identification code is read on each coded product being passed through the POS, and determining whether or not the coded product being checked out is in compliance with the two-factor authentication process.

As indicated at Block G, the logic presented in the table of FIG. 1 is then used to process product identification and security code data captured at the POS-based checkout station, and generate a non-compliance signal, or compliance signal, as the case may be, for notification of the status of two-factor authentication compliance of each product being purchased at the POS station.

An Overview of the Illustrative Embodiments of the POS-Based Checkout System Supporting the Two-Factor Authentication Process In the illustrative embodiments shown throughout FIGS. 2 through 9B, each POS-based checkout system is equipped with (i) an optical bar code symbol reader for reading bar code symbols on products, (ii) an electronic RFID code reader for reading RFID tags or labels on products, and (iii) an electronic EAS tag detector and deactivator for electromagnetically probing the area around for EAS tags when the bar code reader reads a bar code label on a product, and/or the RFID code reader reads a RFID code on a product, being purchased or checked out at the POS station, and deactivating an EAS tag when controlled to do so by the system controller. The equipment employed in each illustrative embodiment implements or realizes the product identification code reading subsystem, product security code reading subsystem, and data processing subsystem schematically depicted in the POS-based checkout system of in FIGS. 1A through 1A8, illustrating eight scenarios during which the two-factor authentication process is being carried out using the POS-based checkout system.

Preferably, the EAS tag detector and deactivator are integrated with the bar code symbol reader, and/or the RFID code reader, so that the two-factor authentication process is carried out in a transparent manner, unknown to customers and thieves within the retail environment. Each POS-based checkout system can be easily programmed and configured to carry out various illustrative embodiments of the two-factor POS checkout authentication process of the present disclosure, as required by any particular application. Such configurations provide flexibility in carrying out the two-factor authentication process of the present disclosure.

Figure 2A:
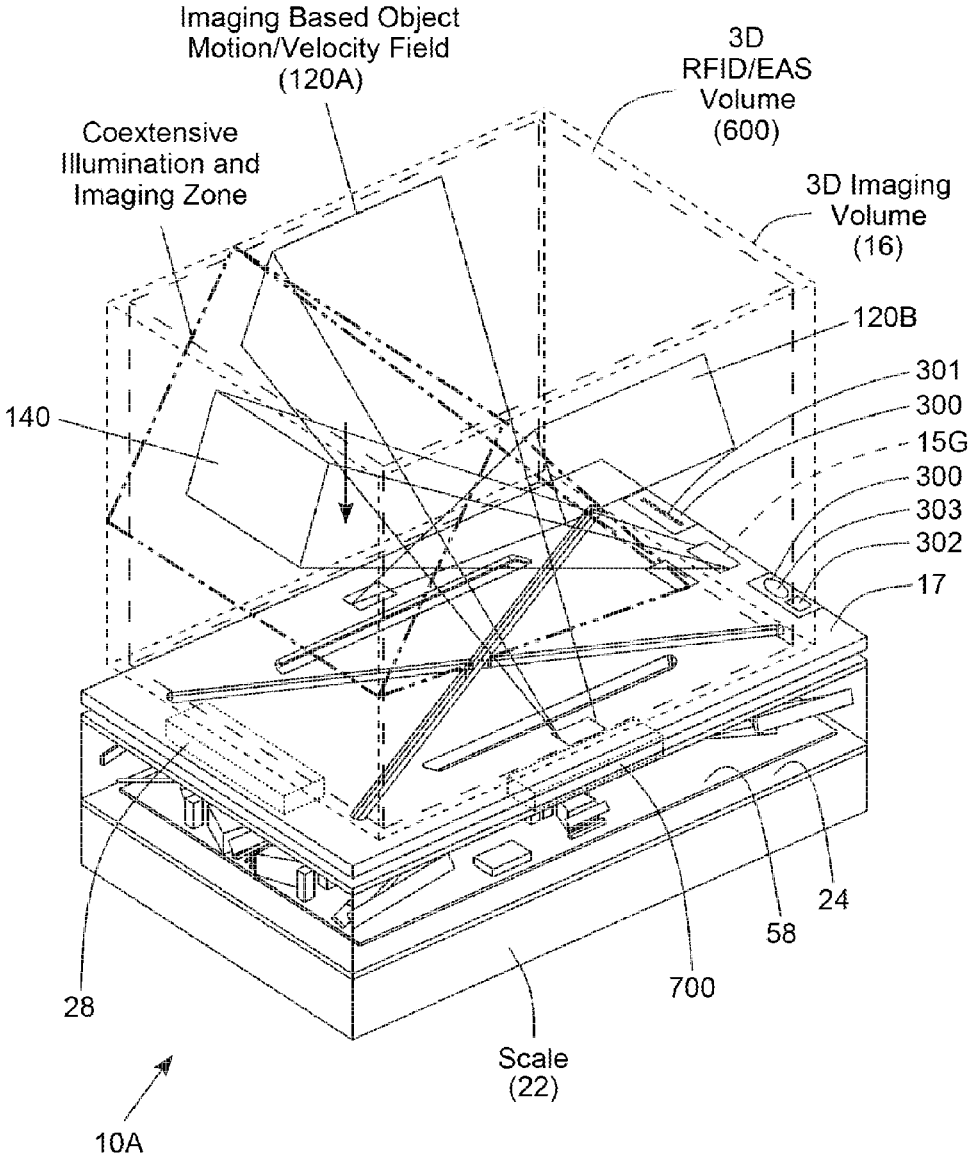
FIG. 2A is a first perspective view of the POS checkout system removed from its POS environment in FIG. 2, and showing its digital-imaging based bar code symbol reading subsystem supporting (i) a 3D imaging volume containing a plurality of coplanar illumination and imaging planes from a complex of coplanar illumination and imaging stations mounted beneath the imaging window of the system, and (ii) a 3D RFID/EAS volume that spatially encompasses the 3D imaging volume at the POS environment (i.e. implementing the product identification code reading subsystem and the product security code reading subsystem shown in FIG. 2)
Figure 2B:
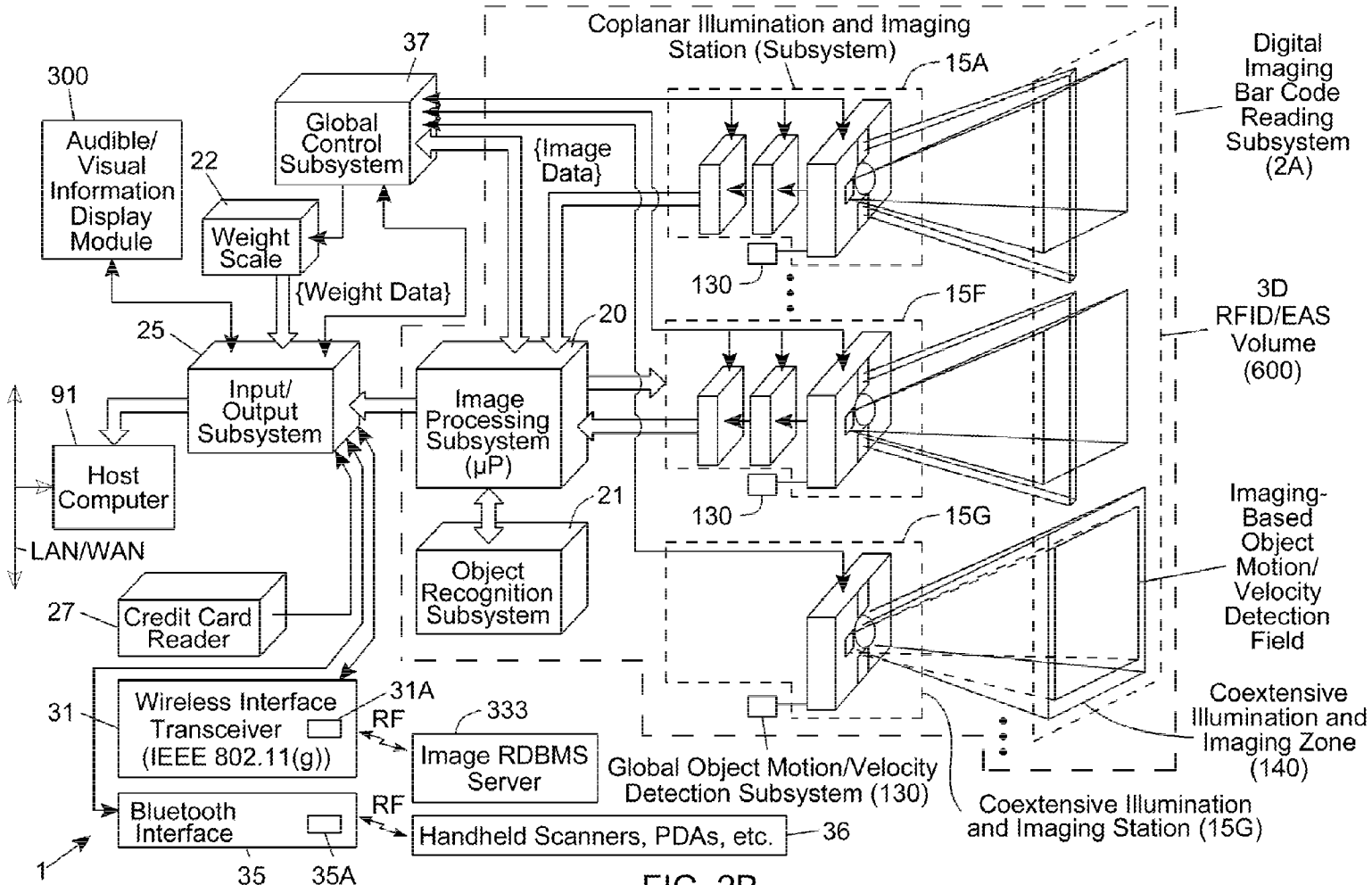
FIG. 2B is a block schematic representation of the POS-based checkout system of FIG. 2, wherein a complex of coplanar illuminating and imaging stations employed in the digital-imaging based bar code symbol reading subsystem of FIG. 2A, support (i) automatic reading of bar code symbols or labels on products passed through the 3D imaging volume, (ii) automatic reading of RFID tags or labels on products passed through the 3D RFID/EAS volume, and (iii) automatic reading and deactivation of EAS tags (i.e. special security codes) on bar-coded items transported through the 3D imaging volume during the automated two-factor authentication process carried out at the POS-based checkout station.
Figure 2C:
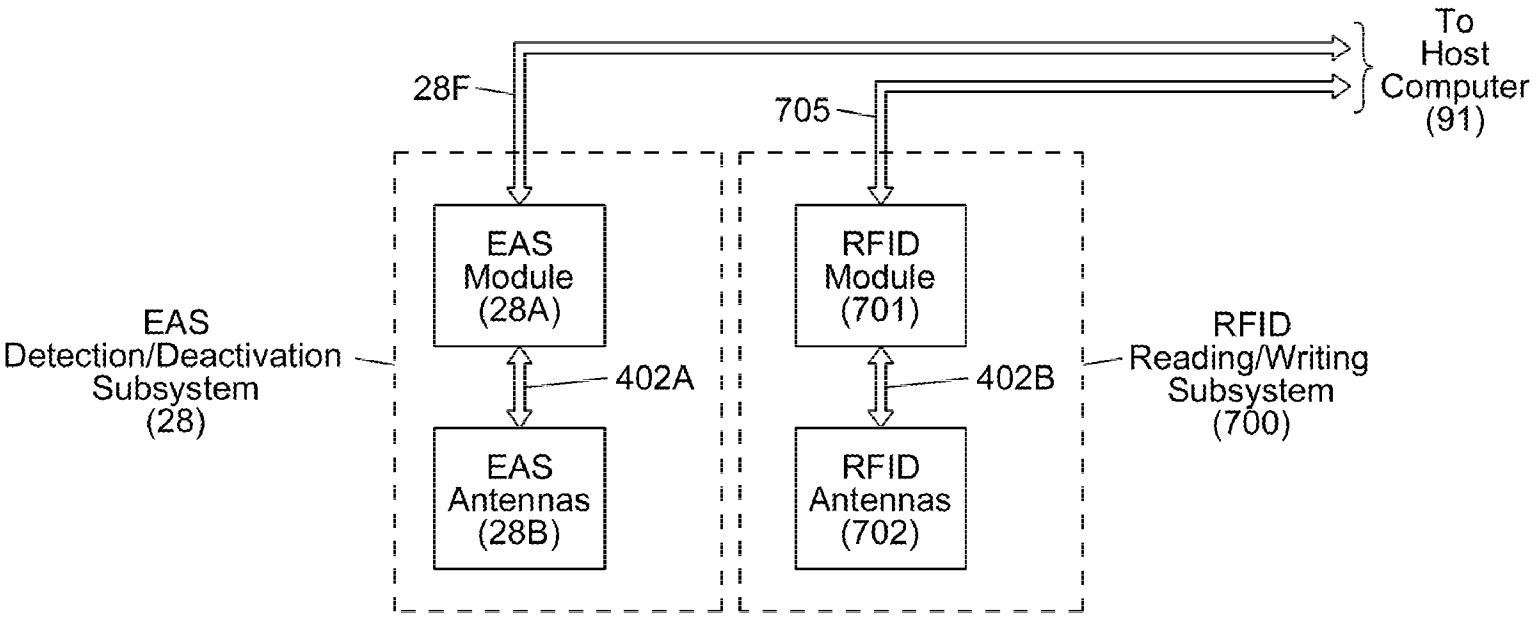
FIG. 2C is a block schematic representation of the EAS detection/deactivation subsystem and RFID reading/writing subsystem employed in the POS-based checkout system of FIG. 2.
Figure 2D:
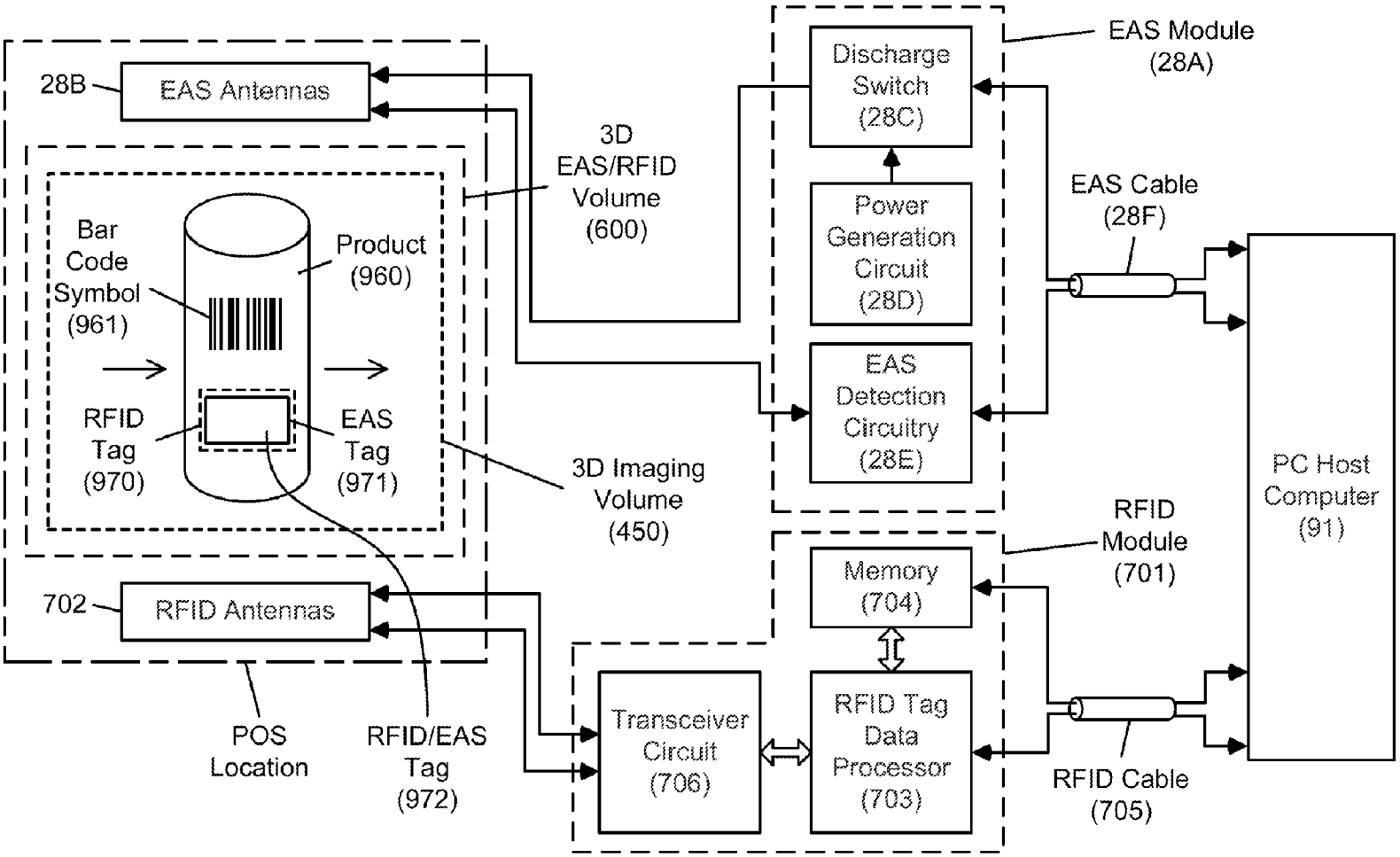
FIG. 2D is a block schematic representation showing (i) the primary components comprising the EAS detection/deactivation subsystem and RFID reading/writing subsystem specified in FIG. 2C and employed in the POS-based checkout system of FIG. 2, and (ii) the spatial relationships between the 3D imaging volume and the 3D RFID/EAS volume of the system.
Figure 2E:
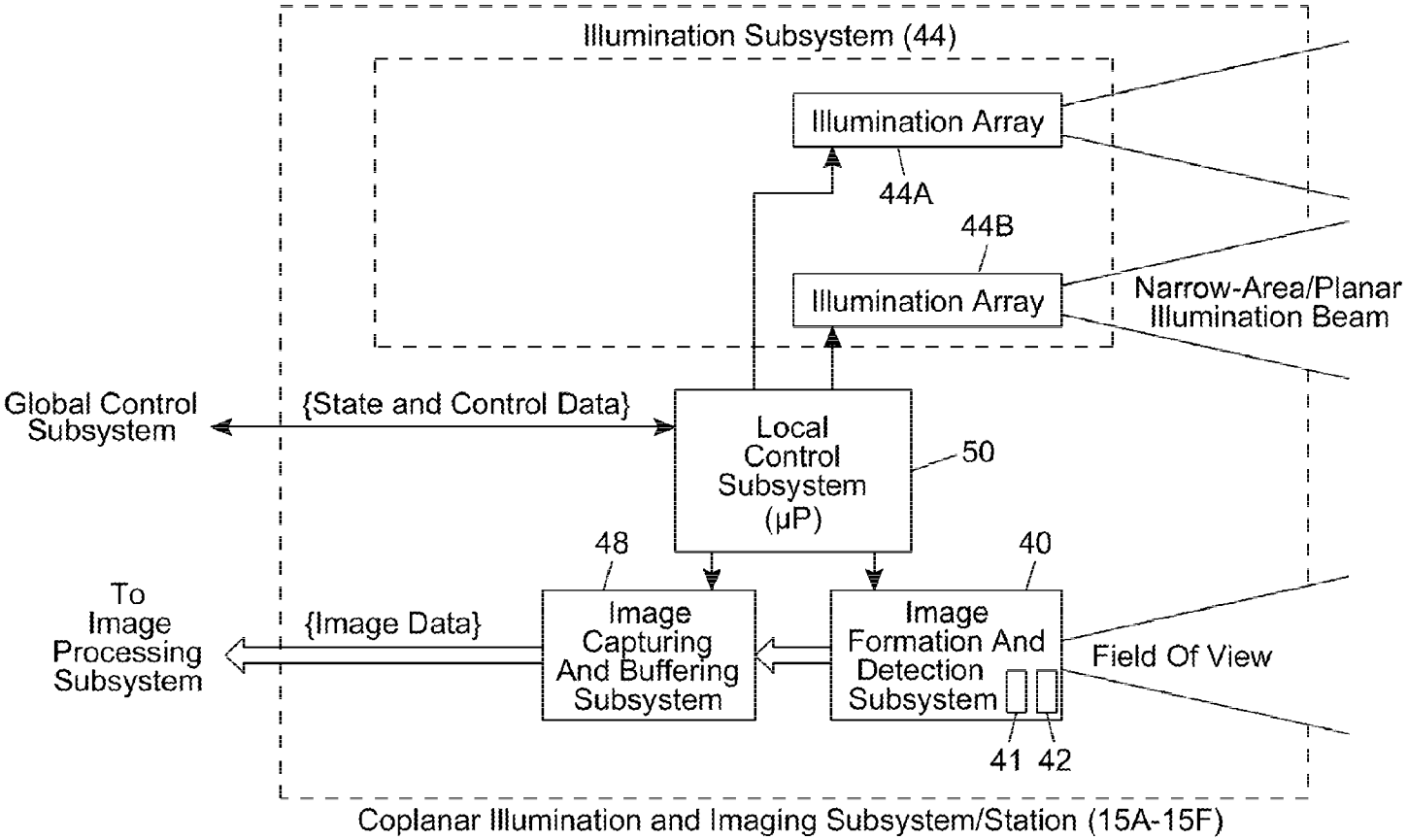
FIG. 2E is a block schematic representation of one of the coplanar illumination and imaging stations employed in the digital-imaging bar code symbol reading subsystem of the POS-based checkout system of FIGS. 2 and 2B, showing its planar illumination array (PLIA), its linear image formation and detection subsystem, image capturing and buffering subsystem, high-speed imaging based object motion/velocity detecting (i.e. sensing) subsystem, and local control subsystem.
Figure 2F:
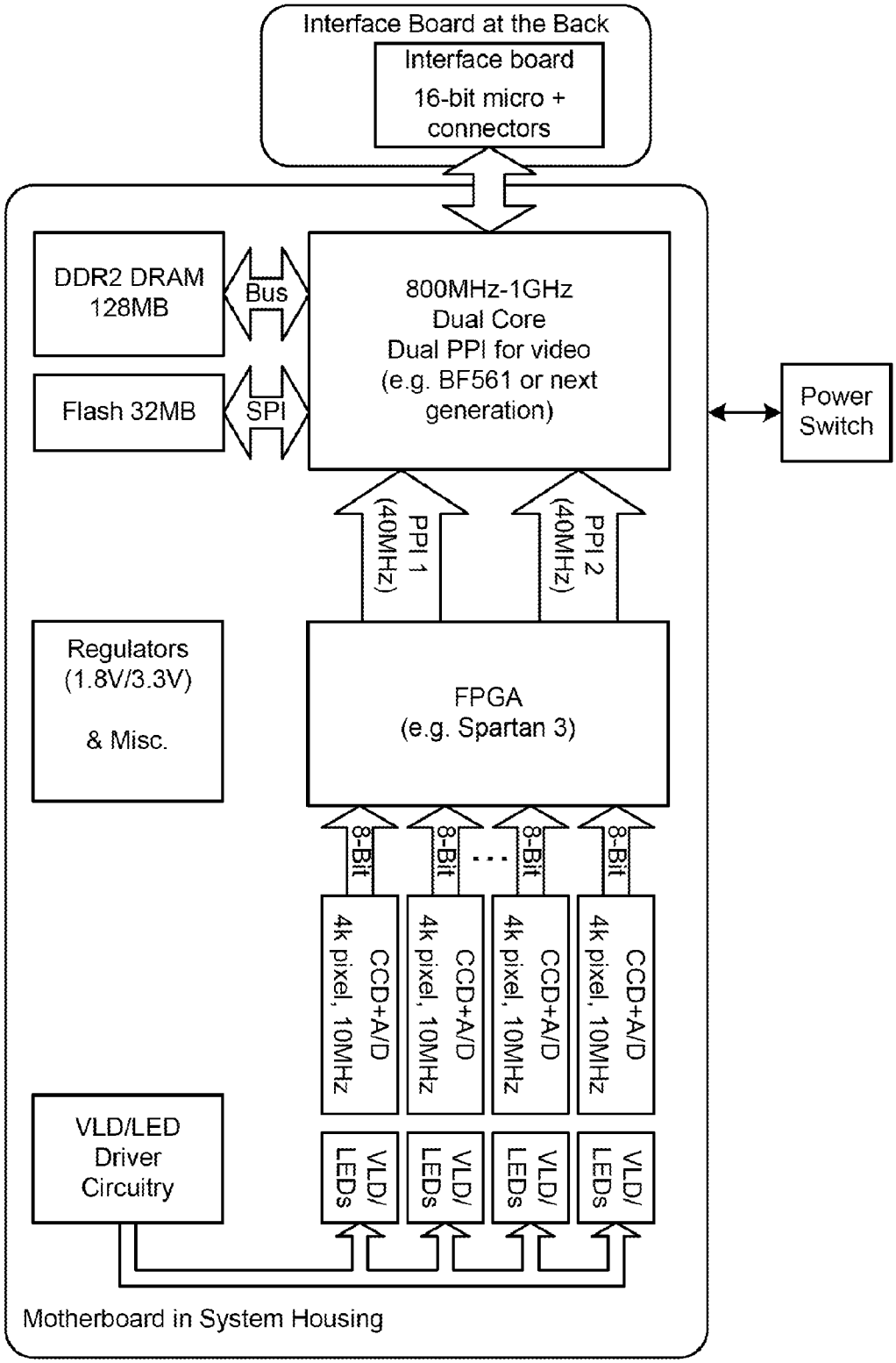
FIG. 2F is a schematic diagram described exemplary embodiment of a computing and memory architecture platform for implementing the checkout system described in FIGS. 2, 2A, 2B and 2C.

In FIGS. 2 through 2F2, a retail point of sale (POS) checkout system of the first illustrative embodiment 1 is shown, employing: (i) digital-imaging techniques for reading bar code symbols 961, functioning as product identification codes, on products 960 presented at a POS station; (ii) electronic RFID reading/writing techniques for reading and writing to the memory of RFID tags 970 (and to the RFID component of hybrid RFID/EAS devices 972), functioning as product security codes, on products 960 presented at the POS station; and (iii) EAS tag detecting and deactivation techniques for detecting and deactivating EAS tags 971, functioning as product security codes, at the POS station, in accordance with the two-factor authentication process of the present disclosure.

In FIGS. 3 through 3E2, a POS checkout system of the second illustrative embodiment 1' is shown, employing: (i) laser-scanning techniques for reading bar code symbols, functioning as product identification codes, at a POS station; (ii) electronic RFID reading/writing techniques for reading and writing to the memory of RFID tags (and to the RFID component of hybrid RFID/EAS devices), functioning as product identification codes and/or product security codes, on products presented at the POS station; and (iii) EAS tag detecting and deactivation techniques for detecting and deactivating EAS tags, functioning as product security codes, at the POS station, in accordance with the two-factor authentication process of the present disclosure.

In FIGS. 4 through 7B, a POS checkout system of the third illustrative embodiment 1" is shown, employing: (i) digital-imaging techniques for reading bar code symbols, functioning as product identification codes, at a POS station; (ii) electronic RFID reading/writing techniques for reading and writing to the memory of RFID tags (and to the RFID component of hybrid RFID/EAS devices), functioning as product identification and/or product security codes, on products 960 presented at the POS station; and (iii) EAS tag detecting and deactivation techniques for detecting and deactivating EAS tags, functioning as product security codes, at the POS station, in accordance with the two-factor authentication process of the present disclosure.

In FIGS. 8 though 9B, a POS checkout system of the fourth illustrative embodiment 900 is shown, employing: digital-imaging techniques for reading bar code symbols, functioning as product identification codes, at a POS station; (ii) electronic RFID reading/writing techniques for reading and writing to the memory of RFID tags (and to the RFID component of hybrid RFID/EAS devices) functioning as product identification codes and/or product security codes, at the POS station; and (iii) EAS tag detecting and deactivation techniques for detecting and deactivating EAS tags, functioning as product security codes, at the POS station, in accordance with the two-factor authentication process of the present disclosure.

In general, each of these retail POS-based systems 1, 1', 1" and 900 is particularly adapted for installation in a point of sale (POS) environment or station. Typically, the POS station includes a countertop-surface in which, or on which, the bar code symbol reading system can be installed and connected to a PC-based host system 91 and/or information processing and database (RDBMS) server 333, and other input/output devices 26, 27, 31, 35 and 36 as shown and described in greater detail below. However, the two-factor authentication based POS checkout system of the present disclosure can be installed in other types of retail POS environments, as shown in FIGS. 4 through 9B.

In the first two illustrative embodiments, each POS-based checkout subsystem 1 and 1' is equipped with audible and visual display capabilities, through an audible/visual information display module 300, shown in FIGS. 2, 2B, 3A and 3B. In the third and fourth illustrative embodiments 1" and 900, each POS-based checkout system is also equipped with audible and visual display capabilities, through an audible/visual information display devices 871, 872, 873 and 874, shown in FIGS. 4, 5A, 8 and 9A.

EAS subsystem 28 (528) can be realized in any number of different ways using different types of EAS tag and system technologies described in the Background of Disclosure, including but not limited to: magnetic, also known as magneto-harmonic; acousto-magnetic, also known as magneto-strictive; radio frequency; and microwave electronic article surveillance technologies. In the illustrative embodiments, magneto-harmonic based EAS tag technology is used to illustrate the principles of the present disclosure, but it is understood that other types of EAS tag technologies can be used with excellent results.

While the complete two-factor authentication operation of the POS-based checkout system 1 is described in FIGS. 1A1 through 1A8, it will be helpful to briefly describe below operation of the POS-based checkout system in terms of its particular equipment.

For example, during Scenario No. 1, indicated in FIG. 1A2, when the bar code symbol reader and/or RFID code reader reads a product identification (bar) code symbol or label on a product for a high-priced (i.e. special) product, and does not detect the EAS tag of a high-priced product (i.e. assigned "special" product security code) at the POS-based station, then the POS checkout system of the illustrative embodiment automatically generates an audible and/or visual alert for the cashier or management, to recognize and take proper action in accordance with the policies set for an event of non-compliance of two-factor authentication process (i.e. due to store management failing to attach a special product security code, e.g. EAS tag, to the special classified product).

During Scenario No. 1A3, when the bar code reader and/or RFID code reader reads a product identification (bar) code for a low-priced or low-security (i.e. non-special) product, and the product security code detector detects the EAS tag of a high-priced or high-security (i.e. special) product at the POS station, then the POS-based checkout system of the illustrative embodiment automatically generates an audible and/or visual alert for the cashier, or management, to recognize and take proper action in accordance with the policies set for an event of non-compliance with the two-factor authentication process (i.e. due to a customer/thief removing the high-priced bar code label from a high-priced special product, but failing to remove the security tag).

Whenever the checkout system automatically detects a failure (i.e. breach) of the two-factor authentication process defined by the table of FIG. 1, based on real-time analysis of the bar and/or RFID code product identification records and EAS/RFID tag security assignment records maintained in the database (RDBMS) server 333 supporting the authentication process, the POS-based checkout system automatically generates visual and/or audible security alerts (i.e. messages) and/or notifications to the checkout operator, clerk and/or management to take necessary and proper action. Optionally, the POS-based checkout system can be programmed and configured to generate control signals that activate the store security system to capture and store video at the POS station, while sending alert messages to store management to be advised of the security breach at the particular POS station. Such records can be used to resolve any issues that may arise during product checkout operations.

First Illustrative Embodiment of the POS-Based Checkout System Supporting a Two-Factor Authentication Process As shown in FIGS. 2 and 2A, the POS checkout system of the first illustrative embodiment 1 includes a system housing having an optically transparent (glass) imaging window, preferably covered by an imaging window protection plate which is provided with a pattern of apertures. These apertures permit the projection of a plurality of coplanar illumination and imaging planes from the complex of coplanar illumination and imaging stations 15A through 15F, into a 3D imaging volume 16 defined external to the system housing. As shown in FIG. 2A, these coplanar illumination and imaging planes are projected into the 3D imaging volume 16, through which bar and/or RFID coded products are passed, the bar code symbols and/or RFID codes on the products automatically read, and the products automatically identified, and purchase prices automatically looked up for retail sales purposes, using product code and price information maintained in database 333 within the retail store environment.

As shown in FIGS. 2A and 2D, the POS checkout system 1 also includes a RFID tag reading/writing subsystem (i.e. "RFID code reader") 700 and an EAS tag detection/deactivation subsystem (i.e. "EAS tag detector and deactivator") 28 which supports a 3D RFID/EAS volume 600 which spatially encompasses the 3D imaging volume 16 at the POS environment, and automatically reads from and writes to the memory of RFID tags and labels, and detects EAS tags (i.e. product security codes) applied to high-priced product items when such product items are passed through the 3D imaging volume spatially encompassing 3D RFID/EAS volume 600. Also, as will be described in greater detail hereinafter, the EAS subsystem 28 is used to deactivate the EAS tag on a high-priced product item after the product has satisfied the authentication rules and policies set within the POS-based checkout station, specified in the table of FIG. 1 described hereinabove.

As shown in the system diagram of FIG. 2B, system 10A generally comprises: a complex of coplanar illuminating and linear imaging stations (15A through 15F), each constructed using the illumination arrays and linear image sensing array technology; one or more coextensive illuminating and imaging stations (15G), each constructed using the illumination arrays and area-type image sensing array technology; an multi-processor multi-channel image processing subsystem 20 for supporting automatic image processing based bar code symbol reading and optical character recognition (OCR) along each coplanar illumination and imaging plane, and corresponding data channel within the system; a software-based object recognition subsystem 21, for use in cooperation with the image processing subsystem 20, and automatically recognizing objects (such as vegetables and fruit) at the retail POS while being imaged by the system; an electronic weight scale module 22 for bearing and measuring substantially all of the weight of objects positioned on the window or window protection plate, and generating electronic data representative of measured weight of such objects; an input/output subsystem 25 for interfacing with the image processing subsystem 20, the electronic weight scale 22, credit-card reader 27; electronic article surveillance (EAS) subsystem 28 for generating EAS tag detection and deactivation fields under the supervision of host system 91; RFID subsystem 700 for generating RFID tag reading and writing fields under the supervision of host system 91; and an audible/visual information display subsystem (i.e. module) 300 for visually and/or audibly displaying indications of whether the product two-factor authentication process is being satisfied or breached during the checkout of each product being purchased at the POS station.

The primary function of each coplanar illumination and imaging station 15A through 15F is to capture digital linear (1D) images or narrow-area images along the field of view (FOV) of its coplanar illumination and imaging planes, using laser or LED-based illumination, depending on the system design, as taught in Applicants' U.S. Pat. Nos. 6,898,184 and 7,490,774. These captured digital images are then buffered, and decode-processed using linear (1D) type image capturing and processing based bar code reading algorithms, or can be assembled together and buffered to reconstruct 2D images for decode-processing using 1D/2D image processing based bar code reading techniques, as taught in Applicants' U.S. Pat. No. 7,028,899 B2, incorporated herein by reference.

As shown in FIGS. 2B and 2C, each coplanar illumination and imaging station 15A through 15F comprises: an illumination subsystem 44 including a linear array of VLDs or LEDs 45 and associated focusing and cylindrical beam shaping optics (i.e. planar illumination arrays PLIAs), for generating a planar illumination beam (PLIB) 61 from the station; a linear image formation and detection (IFD) subsystem 40 having a camera controller interface (e.g. realized as a field programmable gate array or FPGA) for interfacing with the local control subsystem 50, and a high-resolution linear image sensing array 41 with optics 42 providing a field of view (FOV) 43 on the image sensing array that is coplanar with the PLIB produced by the linear illumination array 45, so as to form and detect linear digital images of objects within the FOV of the system; a local control subsystem 50 for locally controlling the operation of subcomponents within the station, in response to control signals generated by global control subsystem 37 maintained at the system level, shown in FIG. 2B; and an image capturing and buffering subsystem 48 for capturing linear digital images with the linear image sensing array 41 and buffering these linear images in buffer memory so as to form 2D digital images for transfer to image-processing subsystem 20 maintained at the system level, as shown in FIG. 2B, and subsequent image processing according to bar code symbol decoding algorithms, OCR algorithms, and/or object recognition processes. Details regarding the design and construction of planar illumination and imaging module (PLIIMs) can be found in Applicants' U.S. Pat. No. 7,028,899 B2, incorporated herein by reference.

In order to support automated object recognition functions (e.g. vegetable and fruit recognition) at the POS environment, image capturing and processing based object recognition subsystem 21 (i.e. including Object Libraries etc.) cooperates with the multi-channel image processing subsystem 20 so as to (i) manage and process the multiple channels of digital image frame data generated by the coplanar illumination and imaging stations 15, (ii) extract object features from processed digital images, and (iii) automatically recognize objects at the POS station which are represented in the Object Libraries of the object recognition subsystem 21.

The bar code symbol reading module employed along each channel of the digital image processing subsystem 20 can be realized using SwiftDecoder® Image Processing Based Bar Code Reading Software from Omniplanar Corporation, New Jersey, or any other suitable image processing based bar code reading software. Also, the system provides full support for (i) dynamically and adaptively controlling system control parameters in the digital image capture and processing system, as disclosed and taught in Applicants' U.S. Pat. Nos. 7,607,581 and 7,464,877 as well as (ii) permitting modification and/or extension of system features and functions, as disclosed and taught in U.S. Pat. No. 7,708,205, each said patent being incorporated herein by reference.

In general, different types of EAS technology can be used to implement the EAS subsystem, including magnetic-based systems, also known as magneto-harmonic based systems; acousto-magnetic-based systems, also known as magneto-strictive based systems; radio-frequency based systems; and microwave-based systems. However, for purposes of illustration, the EAS subsystem 28 is based on magneto-harmonic technology.

In FIG. 2D, the primary components of the EAS subsystem 28 and RFID subsystem 700 are shown.

As shown, RFID subsystem 700 comprises: RFID antennas (e.g. reading/writing coil) 702 for generating an RFID tag reading and writing field within a 3D RFID/EAS tag reading/writing/detection/deactivation volume (i.e. 3D RFID/EAS volume) 600 which, preferably, spatially encompasses, in whole or in part, the 3D imaging volume 450 shown in FIG. 1; an RFID tag processor (e.g. microprocessor) 703 for executing programs within system memory 704; system memory 704 for storing programs directing (i) the processing of data read from memory within an RFID tag so as to read/recognize code(s) (e.g. UPC, EAN, SKU, or EPC) stored within RFID tag memory and typically identifying the product or object to which the RFID tag is applied, and (ii) the processing of data to be written into memory within an RFID tag so as to identify particular product attributes, conditions, or other events that might have taken place (e.g. product has been successfully purchased at POS); and a signal transceiver circuit 706 interfaced with programmed RFID data processor 703, and in data communication with the RFID antennas 702, as shown in FIG. 2D, to transmit and receive digitally modulated signals driving the RFID antennas in accordance with the modulation scheme that may be employed in any given RFID application (e.g. transmitting and receiving UHF modulated signals between an RFID tag and the signal transceiver circuit 706).

During RFID tag reading operations, the signal transceiver 706 supports the transmission and reception of data communication signals between the RFID tag 970 (or RFID/EAS tag 972) and the RFID data processor 703, under the control of host computer 91, to read data from memory within the RFID tag, as required for the type of RFID technology employed in any given application. During RFID tag writing operations, the signal transceiver 706 supports the transmission and reception of data communication signals between the RFID tag 970 and the RFID data processor 703, under the control of host computer 91, to write data into memory within the RFID tag 970, as required for the type of RFID technology employed in any given application.

In general, different types of EAS technology can be used to implement the EAS subsystem, including magnetic, also known as magneto-harmonic; acousto-magnetic, also known as magnetostrictive; radio frequency; microwave; and video surveillance systems. However, for purposes of illustration, the EAS subsystem 28 is based on magneto-harmonic technology.

As shown, EAS subsystem 28 comprises: EAS antennas 28B (e.g. detection/deactivation coil) for generating an EAS tag detection and deactivation fields within the 3D RFID/EAS volume 600 spatially encompassing the 3D imaging volume 450, as shown in FIG. 2, but can extend outside and about the 3D imaging volume as required in any particular application; an EAS signal supply and processing unit or module 28A containing a discharge switch 28C, a power generation circuit 28D and an EAS tag detection circuit 28E, in a compact manner. The EAS signal supply and processing module 28A further comprises a standard AC power input and power supply circuit well known in the art. The primary function of the EAS tag detection field is to automatically detect EAS tags applied to priced product items, when such product items are passed through the 3D RFID/EAS volume 600. The primary function of the EAS tag deactivation field is to automatically deactivate EAS tags applied to purchased product items, when such items are passed through the 3D RFID/EAS volume 600.

During EAS tag detection operations, power generation circuit 28D supplies coil 28B with electrical current through discharge switch 28C, under the control of host computer 91, to generate an EAS tag detection field (within RFID/EAS volume 600) having a magnetic field intensity sufficient to illuminate an EAS tag within the field, so that EAS tag detection circuit 28E can sense changes in field intensity (due to the EAS tag) by processing electrical signals detected by coil 28D, and generates a signal indicative of the detected EAS tag presence in the field. During EAS tag deactivation operations, power generation circuit 28D supplies coil 28B with electrical current through discharge switch 28C, under the control of host computer 91, to generate an EAS tag deactivation field (within RFID/EAS volume 600) having a magnetic field intensity sufficient to deactivate an EAS tag within the field.

The primary function of the EAS subsystem 28 within the POS-based checkout system is two-fold: (1) automatically detect EAS tags on bar coded product, and/or RFID coded products, while the coded products are being passed through, about or around the 3D imaging volume at the POS-based checkout station, and send this EAS tag information to the global control subsystem 37; and (2) automatically deactivate an EAS tag on the coded product being passed through the 3D imaging volume after the bar and/or RFID coded product has been identified, purchased (i.e. paid for), and the two-factor authentication process has been fully satisfied. Function (1) above is carried out while a bar and/or RFID coded product is being passed through the 3D imaging zone. Function (2) is carried out simultaneously as the coded product is being purchased, and the global control subsystem 37 sends a control signal to discharge switch 28B, allowing electrical energy to flow from the power generation circuit 28C through the discharge switch, into the deactivation coil 28B, and generating an electromagnetic field having an intensity sufficient to deactivate the EAS tag on the purchased product present within the 3D imaging volume.

The primary function of control subsystem 37 is not only to orchestrate the various subsystems in the POS-based checkout system 1, but also to process data inputs and determine whether or not each product scanned at the POS-based checkout system 1 complies with the two-factor authentication process, and if this two-factor authentication process is not satisfied, then automatically generates the necessary security alerts and notifications for the sales clerk, cashier and/or management to make proper and necessary action to thwart potential theft in the retail store environment. Notably, such alerts could also include automated and controlled activation or focusing of security cameras in the store on the POS station, at which a failure of two-factor authentication compliance has been automatically detected by the POS-based system.

FIG. 2F describes an exemplary embodiment of a computing and memory architecture platform that can be used to implement the POS-based system described in FIGS. 1 through 2F. As shown, this hardware computing and memory platform can be realized on a single PC board, along with the electro-optics associated with the illumination and imaging stations and other subsystems, and therefore functioning as an optical bench as well. As shown, the hardware platform comprises: at least one, but preferably multiple high speed dual core microprocessors, to provide a multi-core or multi-processor architecture having high bandwidth video-interfaces and video memory and processing support; an FPGA (e.g. Spartan 3) for managing the digital image streams supplied by the plurality of digital image capturing and buffering channels, each of which is driven by a coplanar illumination and imaging station (e.g. linear CCD or CMOS image sensing array, image formation optics, etc) in the system; a robust multi-tier memory architecture including DRAM, Flash Memory, SRAM and even a hard-drive persistence memory in some applications; arrays of VLDs and/or LEDs, associated beam shaping and collimating/focusing optics; and analog and digital circuitry for realizing the illumination subsystem; interface board with microprocessors and connectors; power supply and distribution circuitry; as well as circuitry for implementing the others subsystems employed in the system.

Referring to FIGS. 2G1 and 2G2, a preferred method of authenticated product checkout, supported by the POS-based checkout system of the first illustrative embodiment, will now be described in detail.

As indicated at Block A in FIG. 2G1, the first step of the method involves, for a given inventory of bar and/or RFID coded products in a retail store environment, determining which class or classes or consumer products are to be classified as "special" products, either having a high price point, and/or security demand in the retail environment, and therefore, should be tagged with EAS tags for security measures. For purposes of illustration only, special products shall be high-priced products or products having a price exceeding a particular price threshold in the retail environment. Thus, at Block A in FIG. 2G1, the price threshold of such products shall be deemed to be classified in the high-price range of the store, and not in the non-high-price range. While this price threshold arbitrary, it needs to be entered into the product price database 333 so that products priced at or above the price threshold shall be indexed as high-priced items, and shall be affixed an EAS tag within the retail stored environment in a conventional manner known in the EAS tagging art. Products priced below the price threshold shall not be affixed any EAS tag, and shall only bear their UPC or UPC/EAN bar code symbol labels and/or EPC-encoded RFID tags, in a conventional manner. Preferably, the database 333 will be realized as a relational database management system (RDBMS) connected to the same network on which the POS-based checkout system 1 is connected using conventional networking techniques.

As indicated at Block B in FIG. 2G1, based on the high-price threshold determined at Block A, the second step of the method involves determining which products in the store's inventory should be assigned and affixed EAS tags. This involves analyzing data in the RDBMS 333 and making this determination.

As indicated at Block C in FIG. 2G1, the third step of the method involves affixing EAS tags near the bar code labels (and/or RFID labels if employed) on all coded products in the store that have been classified in the high-price range in Block B, and not affixing EAS tags to any coded product that has not been classified in the high-price range. This involves analyzing data in the RDBMS 333 and making this determination.

As indicated at Block D in FIG. 2G1, the fourth step of the method involves configuring the POS-based checkout system 1 so that (i) its bar code symbol reader is arranged to read the bar code symbols on bar-coded products passed through the 3D imaging volume 450, and/or (ii) the RFID reader is arranged to read RFID tags (i.e. functioning as product identification and/or security codes) on products passed through the RFID/EAS volume 600, while (iii) the EAS tag detector (i.e. product security code reader) is arranged to detect EAS tags (i.e. functioning as product security codes) affixed to high-priced products passed through the 3D RFID/EAS volume 600, Which spatially overlaps the 3D imaging volume 450 of the POS-based checkout system 1.

As indicated at Block E in FIG. 2G1, the fifth step of the method involves using the POS-Based checkout system 1 to read the bar code symbol (e.g. UPC, EAN or SKU) and/or the EPC-encoded RFID tag or label on each product passed through the 3D imaging volume, while the EAS tag detector simultaneously detects the presence of an EAS tag on high-priced products being moved through or about the checkout station.

As indicated at Block F in FIG. 2G2, the sixth step of the method involves using the RDBMS 333 to identify the product passed through the POS-based checkout system 1.

As indicated at Block G in FIG. 2G2, the seventh step of the method involves the POS-based checkout system 1 determining whether or not the coded product is a high-priced product and assigned an EAS tag.

As indicated at Block H in FIG. 2G2, the eighth step of the method involves the POS-based checkout system 1 determining whether or not the detected EAS tag matches with the price-range of the product identified by the product identification code read by the bar code reader and/or REID reader (i.e. product identification reader).

As indicated at Block I1 in FIG. 2G2, the ninth step of the method involves determining if the detected EAS tag matches with the price-range of the product code read, and if so, then the POS-based checkout system automatically generates product code data and sends same to the host system. Optionally, the POS-based system can be programmed to generate a compliance signal for informing the cashier and/or management about authentication compliance at the POS station.

As indicated at Block I2 in FIG. 2G2, the tenth step of the method involves determining if the detected EAS tag does not match with the price-range of the product code read, then automatically determining that the two-factor authentication process has not been satisfied and generating a visible and/or audible alert or alarm to the cashier, clerk and/or his or her manager, to inform about a detected mis-match condition, indicating non-compliance of the two-factor authentication based checkout process. In addition, the checkout system can generate control signals which automatically activate digital cameras to capture, time-stamp and record video at the particular POS station in the retail environment.

In general, there are many different ways in which to display indications of two-factor authentication non-compliance and compliance.

In the event that the information display subsystem 300 supports the display of a bar or line graph type of visual display at the POS station, then there are a variety of different ways to visually display two-factor authentication compliance. For example, consider the case of visually displaying three different degrees of two-factor authentication compliance, namely: (i) when two-factor authentication compliance fails, an LED of a particular color (e.g. RED) is driven to illuminated RED light, or an LED at a particular location driven to illuminate a particular color of light; (ii) when two-factor authentication compliance is satisfied, an LED of a particular color (e.g. GREEN) is driven to illuminated GREEN light, or an LED at a particular location driven to illuminate a particular color of light; and (iii) when two-factor authentication compliance is not clear (questionable for whatever reason), an LED of a particular color (e.g. YELLOW) is driven to illuminated YELLOW light, or an LED at a particular location driven to illuminate a particular color of light. This visual-type information display subsystem 300 can be realized using a single LED capable of generating three different colors of visible illumination, or by three discrete LEDs 301 located at different relative display positions, and possibly capable different colors of light. In this illustrative embodiment, a range of two-factor authentication compliance will be assigned to a corresponding LED color or LED position, supported by the three-state visual display indication the system, described above.

As an alternative, or in addition to color information, the information display subsystem can also employ different types of visual information such as, but not limited to, textures on a LCD display 302, and well as audio information to indicate two-factor authentication compliance.

In the event that information display subsystem 300 supports an audible/acoustical display at the POS station, then there are a variety of ways to acoustically display two-factor authentication compliance. For example, consider the case of audibly/acoustically displaying three different degrees of two-factor authentication compliance, namely: (i) when two-factor authentication compliance fails, the transducer is driven to produce a first discernible sound having a first pitch P1; (ii) when two-factor authentication compliance is satisfied, the transducer is driven to produce a second discernible sound having a second pitch P2; and (iii) when two-factor authentication compliance is questionable, an acoustical transducer is driven to produce a third discernible sound having a third pitch P3. This acoustical-type information display subsystem 300 can be realized using a single piezo-acoustic transducer 303 capable of generating three different sounds of different pitch, or by three discrete piezo-electric transducers 303 each designed to generate sounds of different pitch. In this illustrative embodiment, a range of two-factor authentication compliance (or non-compliance) will be assigned to a corresponding pitch, supported by the three-state acoustical display indication system, described above.

In yet other embodiments of the information display subsystem 300, both visual and acoustical display capabilities can be combined into a single information display subsystem having one or more modes of operation, in which either visual, or acoustical display capabilities are carried out, or both visual and acoustical display capabilities are carried out simultaneously, as desired or required by the particular application at hand.

Figure 3A:
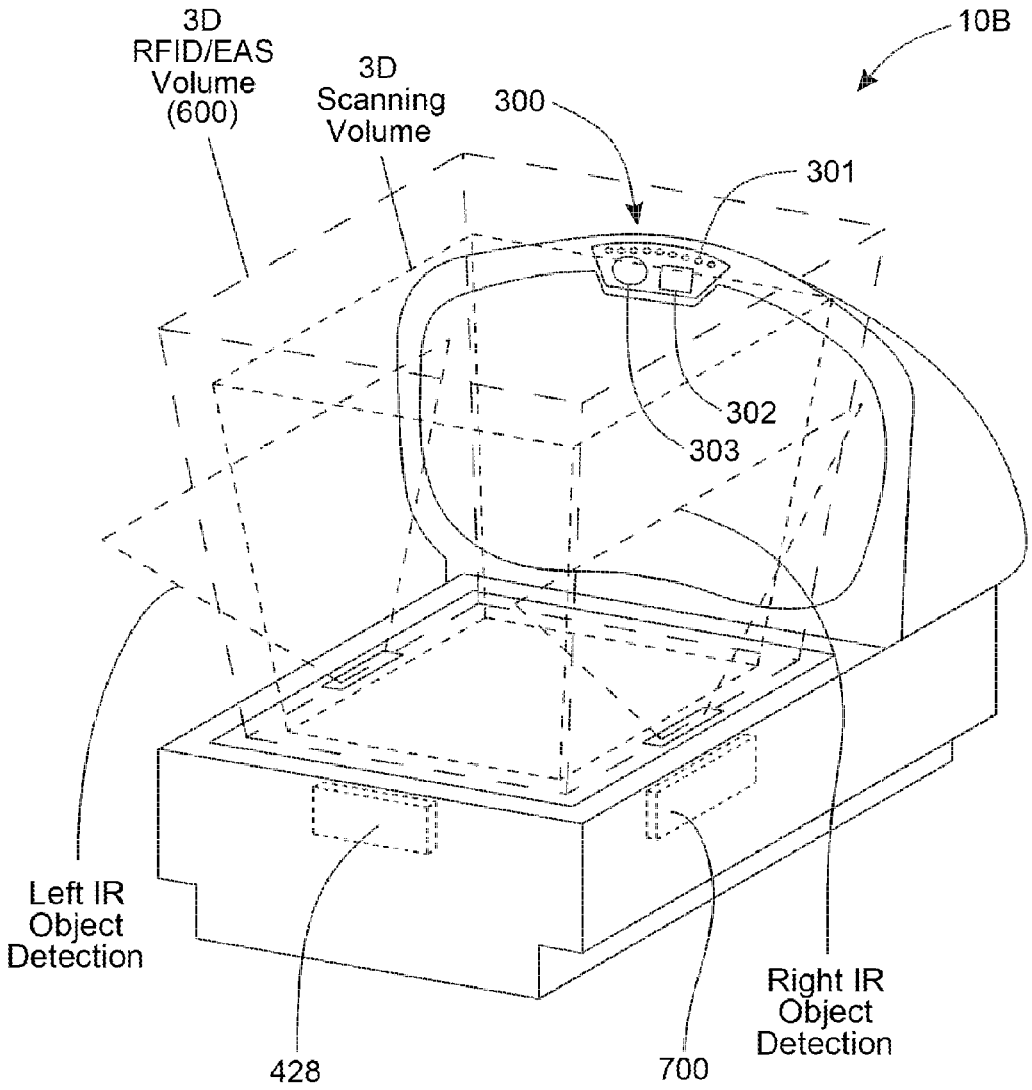
FIG. 3A is a perspective view of the laser-scanning bar code reading subsystem, and integrated electronic RFID tag reading/writing subsystem and EAS detection/deactivation subsystem, shown removed from the POS station of FIG. 3, and supporting (i) a 3D scanning volume, and (ii) a 3D RFID/EAS volume spatially encompassing the 3D scanning volume.

Second Illustrative Embodiment of the POS-Based Checkout System Supporting a Two-Factor Authentication Process In FIG. 3A, a second alternative embodiment of the POS checkout system 1' is shown in a retail store environment, in proximity with a host computing system 91.

As shown in FIG. 3A, the POS checkout system 1' is shown removed from the countertop space of the POS station, for purposes of illustration.

Figure 3B:
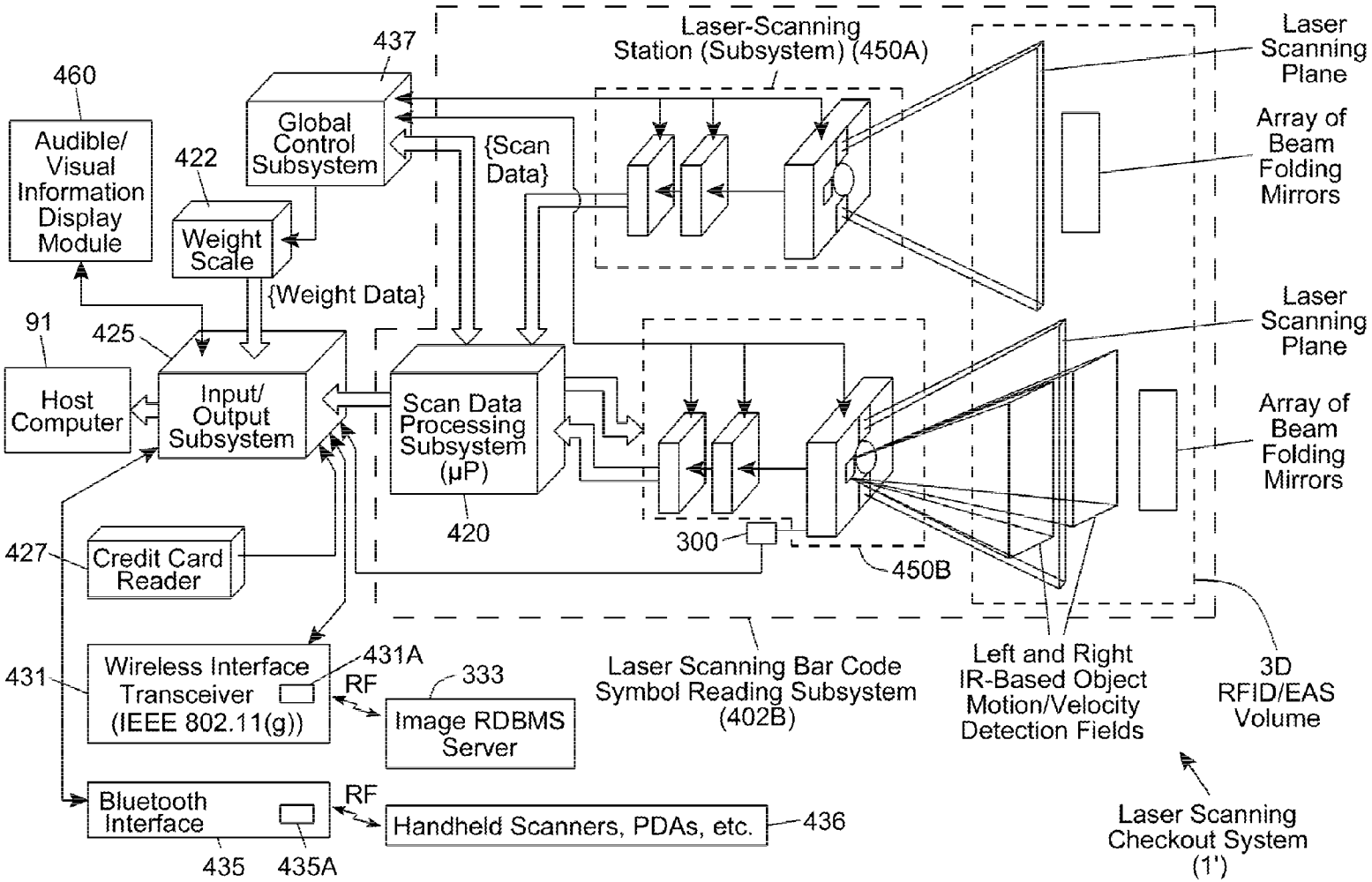
FIG. 3B is a block schematic representation of the POS checkout system of FIG. 3, showing a pair of laser scanning stations in the laser-scanning bar code reading subsystem supporting (i) automatic laser scanning of bar code symbols along a complex of scanning planes passing through the 3D scanning volume of the system, (ii) automatic reading and writing of RFID tags on bar coded product items transported through the 3D imaging volume, and (iii) automatic detection EAS tags applied to particular product items, during the automated two-factor authentication process carried out at the POS checkout system.

As shown in FIG. 3B, the POS-based subsystem 10B comprises: a bi-optic laser scanning bar code reading subsystem employing a pair of laser scanning stations (i.e. subsystems) 450A and 450B, for generating and projecting a complex of laser scanning planes into the 3D scanning volume of the subsystem; a scan data processing subsystem 420 for supporting automatic processing of scan data collected from each laser scanning plane in the system; an electronic weight scale 422 employing one or more load cells positioned centrally below the system housing, for rapidly measuring the weight of objects positioned on the window aperture of the system for weighing, and generating electronic data representative of measured weight of the object; an input/output subsystem 428 for interfacing with the image processing subsystem, the electronic weight scale 422, and credit-card reader 427; RFID code reading subsystem 700; and an audible/visual information display subsystem (i.e. module) 300 for visually and/or audibly displaying indications of whether the product two-factor authentication process is being satisfied or breached during the checkout of each product being purchased at the POS-based checkout system 1'.

In this illustrative embodiment, a pair of IR object detection fields 120A and 120B are projected outside of the limits of the horizontal and vertical scanning windows of the system housing, and spatially co-incident therewith, for sensing in real-time the motion of objects passing therethrough during system operation.

As shown in FIG. 3A, EAS subsystem 428 and RFID subsystem 700 together support a 3D RFID/EAS volume (i.e. 3D RFID/EAS volume 600) spatially encompassing, in whole or in part, the 3D scanning volume 460 at the POS environment. The 3D RFID/EAS zone 600 is used to automatically read and write RFID tags and labels (i.e. functioning as product identification and/or security codes), and detect and deactivate EAS tags (i.e. functioning as product security codes) applied to high-priced product items (i.e. products classified as "special") when such product items are passed through the 3D scanning volume spatially encompassing the 3D RFID/EAS volume. 600. Also, as will be described in greater detail hereinafter, the 3D RFID/EAS volume 600 is also used to deactivate the EAS tag on a high-priced product item only after the product has satisfied the security policies set at the POS-based checkout station.

Figure 3C:
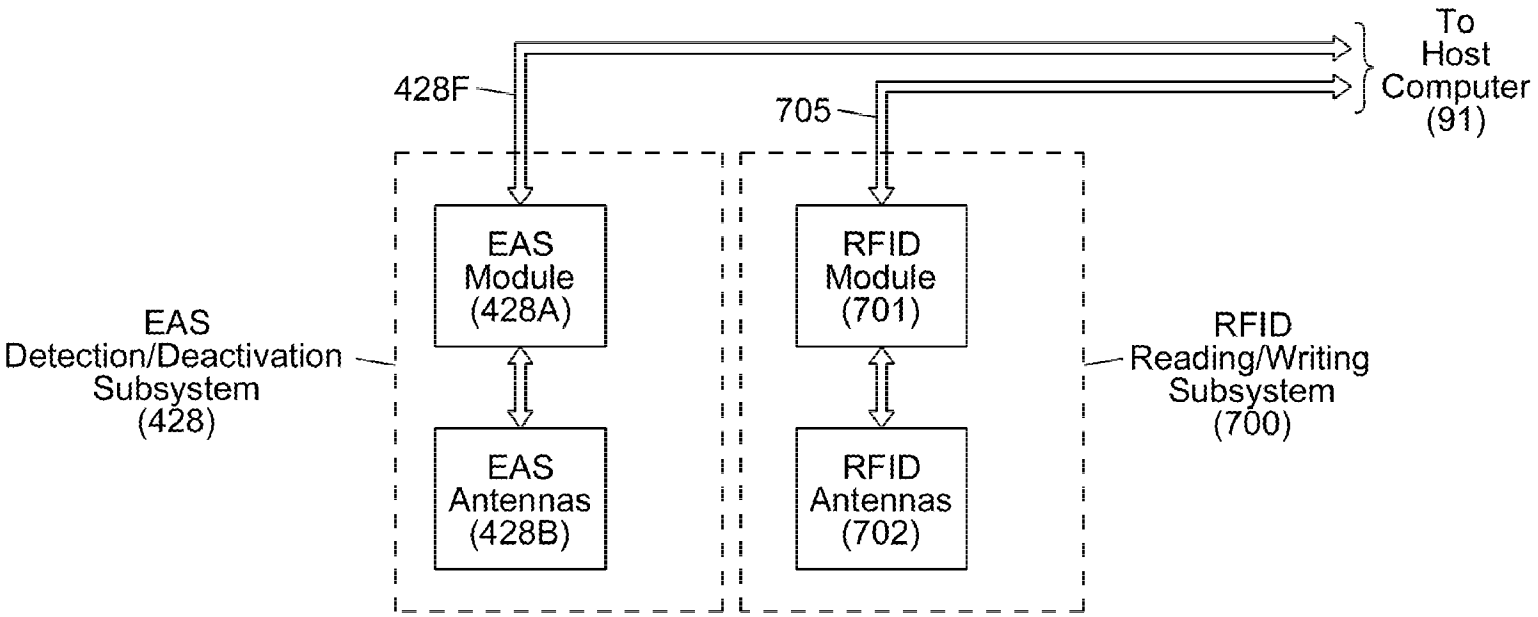
FIG. 3C is a schematic diagram of the RFID subsystem and EAS subsystem employed in the POS checkout system of FIG. 3B.
Figure 3D:
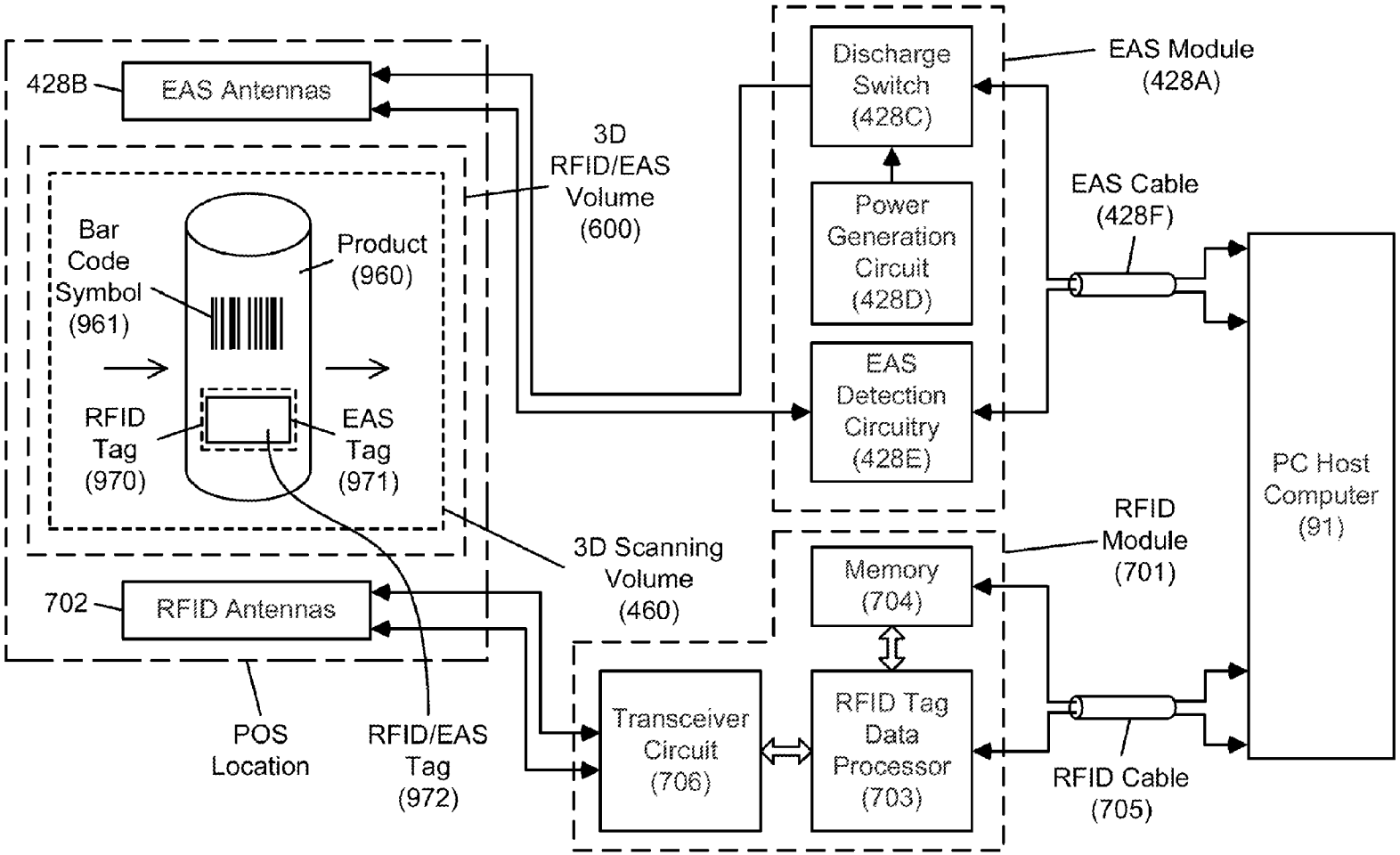
FIG. 3D is a block schematic representation showing (i) the primary components comprising the EAS detection/deactivation subsystem and RFID reading/writing subsystem specified in FIG. 2C and employed in the POS-based checkout system of FIG. 1, and (ii) the spatial relationships between the 3D imaging volume and the 3D RFID/EAS volume of the system in the illustrative embodiment.

In FIG. 3C, the primary components of the EAS subsystem 428 and RFID subsystem 700 are shown.

As shown, RFID subsystem 700 comprises: RFID antennas (e.g. reading/writing coil) 702 for generating an RFID tag reading and writing field within a 3D RFID/EAS tag detection/writing/detection/deactivation zone (i.e. 3D RFID/EAS volume 600") that spatially encompasses the 3D imaging volume 450 shown in FIG. 1, but can extend outside and about the 3D imaging volume as required in any particular application; an RFID tag processor (e.g. microprocessor) 703 for executing programs within system memory 704; system memory 704 for storing programs directing (i) the processing of data read from memory within an RFID tag so as to read/recognize code(s) (e.g. UPC, EAN, SKU, or EPC) stored within RFID tag memory and typically identifying the product or object to which the RFID tag is applied, and (ii) the processing of data to be written into memory within an RFID tag so as to identify particular product attributes, conditions, or other events that might have taken place (e.g. product has been successfully purchased at POS); and a signal transceiver circuit 706 interfaced with programmed RFID data processor 703, and in data communication with the RFID antennas 702, as shown in FIG. 2D, to transmit and receive digitally modulated signals driving the RFID antennas in accordance with the modulation scheme that may be employed in any given RFID application (e.g. transmitting and receiving UHF modulated signals between an RFID tag and the signal transceiver circuit 706).

During RFID tag reading operations, the signal transceiver 706 supports the transmission and reception of data communication signals between the RFID tag and the RFID data processor 703, under the control of host computer 91, to read data from memory within the RFID tag, as required for the type of RFID technology employed in any given application. During RFID tag writing operations, the signal transceiver 706 supports the transmission and reception of data communication signals between the RFID tag and the RFID data processor 703, under the control of host computer 91, to write data into memory within the RFID tag, as required for the type of RFID technology employed in any given application.

In general, different types of EAS technology can be used to implement the EAS subsystem, as including magnetic, also known as magneto-harmonic; acousto-magnetic, also known as magnetostrictive; radio frequency; microwave; and video surveillance systems. However, for purposes of illustration, the EAS subsystem 428 is based on magneto-harmonic technology.

As shown, EAS subsystem 428 comprises: EAS antennas (e.g. detection/deactivation coil) 428B for generating an EAS tag detection and deactivation fields within a 3D RFID/EAS volume 600 that spatially encompasses the 3D scanning volume 460, as shown in FIG. 3A, but can extend outside and about the 3D scanning volume as required in any particular application; an EAS signal supply and processing unit or module 428A containing a discharge switch 428C, a power generation circuit 428D and an EAS tag detection circuit 428E, in a compact manner. The EAS signal supply and processing module 428A further comprises a standard AC power input and power supply circuit well known in the art. The primary function of the EAS tag detection field is to automatically detect EAS tags applied to priced product items, when such product items are passed through the 3D EAS/RFID zone 600. The primary function of the EAS tag deactivation field is to automatically deactivate EAS tags applied to purchased product items, when such items are passed through the 3D RFID/EAS zone 600.

During EAS tag detection operations, power generation circuit 428D supplies coil 428B with electrical current through discharge switch 428C, under the control of host computer 91, to generate an EAS tag detection field (within the RFID/EAS zone 600) having a magnetic field intensity sufficient to illuminate an EAS tag within the field. The EAS tag detection/reading circuit 428E senses changes in field intensity (due to the EAS tag) by processing electrical signals detected by coil 428D, and generates a signal indicative of the detected EAS tag presence in the field. During EAS tag deactivation operations, power generation circuit 428D supplies coil 428B with electrical current through discharge switch 428C, under the control of host computer 91, to generate an EAS tag deactivation field (also within RFID/EAS volume 600) having a magnetic field intensity sufficient to deactivate an EAS tag within the field.

The primary function of the EAS subsystem 428 within the POS-based checkout system is two-fold: (1) to automatically read EAS tags on bar and/or RFID coded products while being passed through, about or around the 3D scanning volume 460, and send this EAS tag information to the global control subsystem 437; and (2) to automatically deactivate an EAS tag on the coded product being passed through the 3D imaging volume after (ii) the bar and/or RFID coded product has been identified, purchased (i.e. paid for), and the two-factor authentication process has been fully satisfied. Function (1) above is carried out while a bar and/or RFID coded product is being passed through the 3D scanning volume 460. Preferably, function (2) is carried out simultaneously as the coded product is being purchased, and the global control subsystem 437 sends a control signal to discharge switch 428B, allowing electrical energy to flow from the power generation circuit 428C through the discharge switch, into the deactivation coil 428B, generating an electromagnetic field having an intensity sufficient to deactivate the EAS tag on the purchased product present within the 3D imaging volume.

The primary function of control subsystem 437 is not only to orchestrate the various subsystems in the POS-based checkout system 1', but also to process data inputs and determine whether or not each bar-coded product scanned at the POS-based checkout system 1' satisfies or complies with the two-factor authentication process specified by the logic set forth in FIG. 1, and if the two-factor authentication process is not satisfied or complied with, then automatically generates the necessary security alerts and/or notifications for the sales clerk, cashier, and/or management to make proper and necessary action to thwart potential theft in the retail store environment.

In general, the IR-based object motion detection fields 120A and 120B can be generated in various ways, including from a plurality of IR Pulse-Doppler LIDAR motion/velocity detection subsystems 300 installed within the system housing. In the illustrative embodiments of FIG. 3A, multiple IR Pulse-Doppler LIDAR motion/velocity sensing chips (e.g. Philips PLN2020 Twin-Eye 850 nm IR Laser-Based Motion/Velocity Sensor System in a Package (SIP)) can be employed in the system. Details regarding this subsystem are described in US Publication No. 2008/0283611 A1.

While the two-factor authentication operation of the POS-based checkout system 1' is described in FIGS. 1A1 through 1A8, it will be helpful to briefly describe the general operation of this the POS-based checkout system in terms of its particular equipment.

Referring to FIGS. 3E1 and 3E2, a preferred method of authentication-based product checkout, supported by the POS-based checkout system of the second illustrative embodiment, will now be described in detail.

As indicated at Block A in FIG. 3E1, the first step of the method involves, for a given inventory of identity coded products in a retail store environment, determining which class or classes or consumer products are to be classified as "special" products, either having a high price point, and/or security demand in the retail environment, and therefore, should be tagged with EAS tags for security measures. For purposes of illustration only, special products shall be high-priced products or products having a price exceeding a particular price threshold in the retail environment. Thus, at Block A in FIG. 3E1, the price threshold of such products shall be deemed to be classified in the high-price range of the store, and not in the non-high-price range. While this price threshold may be arbitrary, it needs to be entered into the product price database 333 so that identity-coded products (i.e. products bearing UPC, EAN or SKU bar codes and/or EPC-encoded RFID tags) which are priced at or above the price threshold shall be indexed as high-priced items, and shall be affixed an EAS tag within the retail stored environment in a conventional manner known in the EAS tagging art. Similarly, coded products priced below the price threshold shall not be affixed any EAS tag, and shall only bear their UPC or UPC/EAN bar code symbol labels or RFID code tags, in a conventional manner. Preferably, the database 333 will be realized as a relational database management system (RDBMS) connected to the same network on which the POS-based checkout system 1' is connected using conventional networking techniques.

As indicated at Block B in FIG. 3E1, based on the high-price threshold determined at Block A, the second step of the method involves determining which products in the store's inventory should be assigned and affixed EAS tags. This involves analyzing data in the RDBMS 333 and making this determination.

As indicated at Block C in FIG. 3E1, the third step of the method involves affixing EAS tags to all bar and/or RFID coded products in the store that have been classified in the high-price range in Block B, and not affixing EAS tags to any coded product that have not been classified in the high-price range. This involves analyzing data in the RDBMS 333 and making this determination.

As indicated at Block D in FIG. 3E1, the fourth step of the method involves configuring the POS-based checkout system 1' so that (i) the bar code symbol reader is arranged to read the bar code symbols of each coded product passed through the 3D scanning volume, and/or the RFID reader 700 is arranged to read an EPC-encoded RFID tag on each coded product passed through the RFID/EAS volume 600, while (ii) the EAS tag detector is arranged to detect an EAS tag affixed to a high-priced coded product passed through the 3D RFID/EAS volume 600, spatially overlapping the 3D scanning volume of the POS-based checkout system.

As indicated at Block E in FIG. 3E1, the fifth step of the method involves using the POS-based checkout system 1' to read the product code on each product passed through checkout system, while the EAS tag detector simultaneously detects EAS tags on products through or about the checkout system.

As indicated at Block F in FIG. 3E2, the sixth step of the method involves using the RDBMS 333 to identify the product passed through the POS-based checkout system.

As indicated at Block G in FIG. 3E2, the seventh step of the method involves the POS-based checkout system 1' determining whether or not the coded product in the 3D RFID/EAS volume has been EAS-tagged as a high-priced product.

As indicated at Block H in FIG. 3E2, the ninth step of the method involves the POS-based checkout system 1' determining whether or not the detected EAS tag matches with the price-range of the product identified by the product code read by the bar code symbol reader, and/or the RFID code reader.

As indicated at Block I1 in FIG. 3E2, the ninth step of the method involves determining if the detected EAS tag matches with the product code read, indicating two-factor authentication process compliance, and if so, then the POS-based checkout system 1' automatically generates product code identification data and sends same to the host system.

As indicated at Block I2 in FIG. 3E2, the tenth step of the method involves determining if the detected EAS tag does not match the product code read, then automatically determines that the two-factor authentication process has not been satisfied and generates a visible and/or audible alert or alarm to the cashier and/or his or her manager, to inform about a detected mis-match condition. In addition, the checkout system can generate control signals which automatically activate digital cameras to capture, time-stamp and record video at the particular POS station in the retail environment.

In all respects, the information display subsystem 300 operates in system 10B as described in connection with the POS checkout system 1'.

Third Illustrative Embodiment of the POS-Based Checkout System Supporting a Two-Factor Authentication Process Referring now to FIGS. 4 through 6A2, a third illustrative embodiment of a hand-supportable POS-based checkout system 1" will be described in detail.

As shown in FIGS. 4, 5A and 5B, the POS-based checkout system 1" comprises: a hand-supportable housing 502 having (i) a front housing portion 502B with a window aperture 560 and an imaging window panel (i.e. faceplate) 503 installed therein; and (ii) a rear housing portion 502A. As shown, a single PC board based optical bench 508 (having optical subassemblies mounted thereon) is supported between the front and rear housing portions 502A and 502B which, when brought together, form an assembled unit. A base portion 504 is connected to the assembled unit by way of a pivot axle structure 531 that passes through the bottom portion of the housing and the base portion so that the hand-supportable housing and base portion are able to rotate relative to each other. The plug portion 557 of the communication interface cable 510 passes through a port 532 formed in the rear of the rear housing portion, and interfaces with connector 575 mounted on the PC board 508. Also, shown in FIG. 4, flexible EAS/RFID cable 902 is connected to interface cable 510 using clips or like fasteners all the way to the EAS subsystem module 528 and RFID subsystem module 700, both of which are interfaced to the host computer 91 by way of cables 528F and 705, respectively.

The hand-supportable POS-based checkout system 1" can be used in both hand-supportable and counter-top supportable modes of operation, in manually-triggered and automatically-triggered modes of operation, and for (i) reading optically-encoded symbols (e.g. bar code symbols) and electronically-encoded devices (e.g. RFID tags), and (ii) detecting and activating EAS tags that have been applied to objects such as high-valued consumer products.

As shown in FIG. 6A1, the POS-based system 1" comprises a number of subsystem components, namely: an image formation and detection (i.e. camera) subsystem 521 having image formation (camera) optics 534 for producing a field of view (FOV) upon an object to be imaged and a CMOS or like area-type image detection array 535 for detecting imaged light reflected off the object during illumination operations in an image capture mode in which at least a plurality of rows of pixels on the image detection array are enabled; a LED-based illumination subsystem 522 employing an LED illumination array 523 for producing a field of narrow-band wide-area illumination 526 within the entire FOV 533 of the image formation and detection subsystem 521, which is reflected from the illuminated object and transmitted through a narrow-band transmission-type optical filter 540 realized within the hand-supportable and detected by the image detection array 535, while all other components of ambient light are substantially rejected; an object targeting illumination subsystem 531 for generating a narrow-area targeting illumination beam 570 into the FOV to help allow the user align bar code symbols within the active portion of the FOV where imaging occurs; an IR-based object motion detection and analysis subsystem 520 for producing an IR-based object detection field 532 within the FOV of the image formation and detection subsystem 521; an automatic light exposure measurement and illumination control subsystem 524 for controlling the operation of the LED-based illumination subsystem 522; an image capturing and buffering subsystem 525 for capturing and buffering 2-D images detected by the image formation and detection subsystem 521: a digital image processing subsystem 526 for processing 2D digital images captured and buffered by the image capturing and buffering subsystem 525 and reading 1D and/or 2D bar code symbols represented therein; an input/output subsystem 527 for outputting processed image data and the like to an external host system or other information receiving or responding device; an electronic article surveillance (EAS) subsystem 528 for generating EAS tag detection and deactivation fields under the supervision of host system 91; an RFID subsystem 700 for generating RFID tag reading and writing fields under the supervision of host system 91; a system memory 529 for storing data implementing a configuration table 529A of system configuration parameters (SCPs); a system control subsystem 530 integrated with the subsystems above, for controlling and/or coordinating these subsystems during system operation; a retail RDBMS server 333 interfaced with the input/output subsystem 527, for supporting POS product pricing and related POS services described hereinafter; and a Bluetooth communication interface, interfaced with I/O subsystem 527, and hand-held scanners, PDAs and the like.

As shown in FIGS. 5C and 6A2, the POS-based checkout system 1" also comprises: an EAS-enabling faceplate bezel 900, disclosed in co-pending U.S. application Ser. No. 13/017,256 filed Jan. 13, 2011, and incorporated herein by reference, embodying the primary subcomponents of the EAS subsystem 528, and RFID subsystem 700 (e.g. EAS antennas 528B, RFID antennas 702 and interface circuit 970 allowing a flexible EAS/RFID cable 902 to pass the interfaces of the EAS module 528A and RFID module 701, as shown in FIG. 4).

The primary function of the object targeting subsystem 531 is to automatically generate and project a visible linear-targeting illumination beam across the central extent of the FOV of the system in response to either (i) the automatic detection of an object during hand-held imaging modes of system operation, or (ii) manual detection of an object by an operator when s/he manually actuates the manually-actuatable trigger switch 505 (505A, 505B). In order to implement the object targeting subsystem 531, the OCS assembly 578 also comprises a fourth support structure for supporting the pair of beam folding mirrors above a pair of aperture slots, which in turn are disposed above a pair of visible LEDs arranged on opposite sides of the FOV optics 534 so as to generate a linear visible targeting beam 570 that is projected off the second FOV folding 575 and out the imaging window 503, as shown and described in detail in US Publication No. US20080314985 A1, incorporated herein by reference in its entirety.

The primary function of the object motion detection and analysis subsystem 520 is to automatically produce an object detection field 532 within the FOV 533 of the image formation and detection subsystem 521, to detect the presence of an object within predetermined regions of the object detection field 532, as well as motion and velocity information about objects therewithin, and to generate control signals which are supplied to the system control subsystem 530 for indicating when and where an object is detected within the object detection field of the system. As shown in FIG. 5B, IR LED 590A and IR photodiode 590B are supported in the central lower portion of the optically opaque structure 533, below the linear array of LEDs 253. The IR LED 590A and IR photodiode 590B are used to implement the object motion detection subsystem 520 whose function is to automatically detect the presence of objects in the FOV of the system.

The image formation and detection subsystem 521 includes image formation (camera) optics 534 for providing a field of view (FOV) 533 upon an object to be imaged and a CMOS area-type image detection array 535 for detecting imaged light reflected off the object during illumination and image acquisition/capture operations.

The primary function of the LED-based illumination subsystem 522 is to produce a wide-area illumination field 36 from the LED array 523 when an object is automatically detected within the FOV. Notably, the field of illumination has a narrow optical-bandwidth and is spatially confined within the FOV of the image formation and detection subsystem 521 during modes of illumination and imaging, respectively. This arrangement is designed to ensure that only narrow-band illumination transmitted from the illumination subsystem 522, and reflected from the illuminated object, is ultimately transmitted through a narrow-band transmission-type optical filter subsystem 540 within the system and reaches the CMOS area-type image detection array 535 for detection and processing, whereas all other components of ambient light collected by the light collection optics are substantially rejected at the image detection array 535, thereby providing improved SNR, thus improving the performance of the system.

The narrow-band transmission-type optical filter subsystem 540 is realized by (1) a high-pass (i.e. red-wavelength reflecting) filter element embodied within at the imaging window 3, and (2) a low-pass filter element mounted either before the CMOS area-type image detection array 535 or anywhere after beyond the high-pass filter element, including being realized as a dichroic mirror film supported on at least one of the FOV folding mirrors 574 and 575, shown in FIGS. 5A and 5B.

As shown in FIG. 5B, the linear array of LEDs 253 is aligned with an illumination-focusing lens structure 551 embodied or integrated within the upper edge of the imaging window 503. Also, the light transmission aperture 560 formed in the PC board 508 is spatially aligned within the imaging window 503 formed in the front housing portion 502A. The function of illumination-focusing lens structure 551 is to focus illumination from the single linear array of LEDs 253, and to uniformly illuminate objects located anywhere within the working distance of the FOV of the system.

As shown in FIGS. 5B, an optically opaque light ray containing structure 533 is mounted to the front surface of the PC board 508, about the linear array of LEDs 253. The function of the optically-opaque light ray containing structure 533 is to prevent transmission of light rays from the LEDs to any surface other than the rear input surface of the illumination-focusing lens panel 503, which uniformly illuminates the entire FOV of the system over its working range. When the front and rear housing panels 502B and 502A are joined together, with the PC board 508 disposed therebetween, the illumination-focusing lens panel 503 sits within slanted cutaway regions formed in the top surface of the side panels, and illumination rays produced from the linear array of LEDs 253 are either directed through the rear surface of the illumination-focusing lens panel 503 or absorbed by the black colored interior surface of the structure 533.

The optical component support (OCS) assembly 578 may comprise a first inclined panel for supporting the FOV folding mirror above the FOV forming optics, and a second inclined panel for supporting the second FOV folding mirror above the light transmission aperture 560. With this arrangement, the FOV employed in the image formation and detection subsystem 521, and originating from optics supported on the rear side of the PC board, is folded twice, in space, and then projected through the light transmission aperture and out of the imaging window of the system.

The automatic light exposure measurement and illumination control subsystem 524 performs two primary functions: (1) to measure, in real-time, the power density [joules/cm] of photonic energy (i.e. light) collected by the optics of the system at about its image detection array 535, and to generate auto-exposure control signals indicating the amount of exposure required for good image formation and detection; and (2) in combination with the illumination array selection control signal provided by the system control subsystem 530, to automatically drive and control the output power of the LED array 523 in the illumination subsystem 522, so that objects within the FOV of the system are optimally exposed to LED-based illumination and optimal images are formed and detected at the image detection array 535.

The OCS assembly 578 may also comprise a third support panel for supporting the parabolic light collection mirror segment employed in the automatic exposure measurement and illumination control subsystem 524. Using this mirror a narrow light collecting FOV is projected out into a central portion of the wide-area FOV 533 of the image formation and detection subsystem 521 and focuses collected light onto photo-detector 581, which is operated independently from the area-type image sensing array, schematically depicted in FIG. 6A1 by reference numeral 535.

The primary function of the image capturing and buffering subsystem 525 is (1) to detect the entire 2-D image focused onto the 2D image detection array 535 by the image formation optics 534 of the system, (2) to generate a frame of digital pixel data for either a selected region of interest of the captured image frame, or for the entire detected image, and then (3) buffer each frame of image data as it is captured.

Notably, in the illustrative embodiment, the system has both single-shot and video modes of imaging. In the single shot mode, a single 2D image frame (31) is captured during each image capture and processing cycle, or during a particular stage of a processing cycle. In the video mode of imaging, the system continuously captures frames of digital images of objects in the FOV. These modes are specified in further detail in US Patent Application Publication No. US20080314985 A1, incorporated herein by reference in its entirety.

The primary function of the digital image processing subsystem 526 is to process digital images that have been captured and buffered by the image capturing and buffering subsystem 525, during modes of illumination and operation. Such image processing operations include image-based bar code decoding methods as described in U.S. Pat. No. 7,128,266, incorporated herein by reference.

In FIG. 6B, the primary components of the EAS subsystem 528 and RFID subsystem 700 are shown. As shown, EAS subsystem 528 comprises: EAS antennas 528B (e.g. detection/deactivation coil) for generating an EAS tag detection and deactivation fields within a 3D EAS tag detection/deactivation zone 600 that spatially encompasses the 3D imaging volume 450, as shown in FIGS. 4 and 6B, but can extend outside and about the 3D imaging volume as required in any particular application; an EAS signal supply and processing unit or module 528A containing a discharge switch 528C, a power generation circuit 528D and an EAS tag detection circuit 528E, in a compact manner. The EAS signal supply and processing module 528A further comprises a standard AC power input and power supply circuit well known in the art. The primary function of the EAS tag detection field is to automatically detect EAS tags applied to priced product items, when such product items are passed through the 3D EAS/RFID tag reading/writing/deactivation zone. The primary function of the EAS tag deactivation field is to automatically deactivate EAS tags applied to purchased product items, when such items are passed through the 3D EAS/RFID tag reading/writing/deactivation zone 600.

As shown in FIG. 6B, RFID subsystem 700 comprises: RFID antennas (e.g. reading/writing coil) 702 for generating an RFID tag reading and writing field within a 3D EAS/RFID tag detection/writing/deactivation zone 600 that spatially encompasses the 3D imaging volume 450, as shown in FIG. 4, but can extend outside and about the 3D imaging volume as required in any particular application; an RFID tag processor (e.g. microprocessor) 703 for executing programs within system memory 704; system memory 704 for storing programs directing (i) the processing of data read from memory within an RFID tag so as to read/recognize code(s) (e.g. UPC, EAN, SKU, or EPC) stored within RFID tag memory and typically identifying the product or object to which the RFID tag is applied, and (ii) the processing of data to be written into memory within an RFID tag so as to identify particular product attributes, conditions, or other events that might have taken place (e.g. product has been successfully purchased at POS); and a signal transceiver circuit 706 interfaced with programmed RFID data processor 703, and in data communication with the RFID antennas 702, by way of RFID/EAS cable 902, shown in FIG. 6B, to transmit and receive digitally modulated signals driving the RFID antennas in accordance with the modulation scheme that may be employed in any given RFID application (e.g. transmitting and receiving UHF modulated signals between an RFID tag and the signal transceiver circuit 706.

As shown in FIG. 5C, EAS antenna coils 528B and RFID antenna coils 702 are connected to the interface circuit 970 which is mounted within the base portion of the bezel structure 900, mounted about the faceplate (i.e. light transmission window) 503 of the system. In turn, flexible EAS/RFID cable 902 is connected to the interface circuit 970, which extends to EAS module 528A and RFID module 701 as shown in FIGS. 4 and 6B.

During EAS tag detection operations, power generation circuit 528D supplies coil 528B with electrical current through discharge switch 528C, under the control of host computer 91, to generate an EAS tag detection field having a magnetic field intensity sufficient to illuminate an EAS tag within the field, so that EAS tag detection/reading circuit 528E can sense changes in field intensity (due to the EAS tag) by processing electrical signals detected by coil 528B, and generates a signal indicative of the detected EAS tag presence in the field. During EAS tag deactivation operations, power generation circuit 528D supplies coil 528B with electrical current through discharge switch 528C, under the control of host computer 91, to generate an EAS tag deactivation field having a magnetic field intensity sufficient to deactivate an EAS tag within the field.

During RFID tag reading operations, the signal transceiver 706 supports the transmission and reception of data communication signals between the RFID tag and the RFID data processor 703, under the control of host computer 91, to read data from memory within the RFID tag, as required for the type of RFID technology employed in any given application. During RFID tag writing operations, the signal transceiver 706 supports the transmission and reception of data communication signals between the RFID tag and the RFID data processor 703, under the control of host computer 91, to write data into memory within the RFID tag, as required for the type of RFID technology employed in any given application.

The primary function of the input/output subsystem 527 is to support universal, standard and/or proprietary data communication interfaces with host system 91 and other external devices, and output processed image data and the like to host system 91 and/or devices, by way of such communication interfaces. Examples of such interfaces, and technology for implementing the same, are given in U.S. Pat. No. 6,619,549, incorporated herein by reference in their entirety.

The primary function of the system control subsystem 530 is to provide some predetermined degree of control, coordination and/or management signaling services to each subsystem component integrated within the system, as shown. While this subsystem can be implemented by a programmed microprocessor, in the preferred embodiments of the present disclosure, this subsystem is implemented by the three-tier software architecture supported on micro-computing platform, described in U.S. Pat. No. 7,128,266, incorporated herein by reference.

The primary function of the manually-actuatable trigger switch 505A integrated with the housing is to enable the user, during a manually-triggered modes, to generate a control activation signal (i.e. trigger event signal) upon manually depressing the same (i.e. causing a trigger event), and to provide this control activation signal to the system control subsystem 530 for use in carrying out its complex system and subsystem control operations, described in detail herein.

The primary function of the system configuration parameter (SCP) table 529A in system memory is to store (in non-volatile/persistent memory) a set of system configuration and control parameters (i.e. SCPs) for each of the available features and functionalities, and programmable modes of supported system operation, and which can be automatically read and used by the system control subsystem 530 as required during its complex operations. Notably, such SCPs can be dynamically managed as taught in great detail in co-pending US Publication No. US20080314985 A1, incorporated herein by reference.

As shown in FIGS. 4 and 5A, the POS-based system 1" supports several different ways of visually and/or audibly displaying information to its user or operator, during system operation, namely: (i) the generation of a distinctive audible response (e.g. signals that change tone, duration or count, or songs or speech-type audio messages produced from a suitable audio-transducer 871, and/or distinctive vibrations or razzle sounds produced from within the hand-supportable housing of the scanner by way of an electro-mechanical vibrator 872; and (ii) the generation of distinctive light patterns from LEDs 873 mounted on the system housing, or visual messages displayed on a LCD display 874 mounted in, on or through the scanner housing 502A, 502B and connected to the motherboard 508 via a flexible cable or circuit.

While the two-factor authentication operation of the POS-based checkout system 1" is described in FIGS. 1A1 through 1A8, it will be helpful to briefly describe the general operation of the POS-based checkout system in terms of its particular equipment.

Referring to FIGS. 7A and 7B, a preferred method of authentication-based product checkout, supported by the system of the second illustrative embodiment, will now be described in detail.

As indicated at Block A in FIG. 7A, the first step of the method involves, for a given inventory of bar and/or RFID encoded products in a retail store environment, determining which class or classes or consumer products are to be classified as "special" products, either having a high price point, and/or security demand in the retail environment, and therefore, should be tagged with EAS tags for security measures. For purposes of illustration only, special products shall be high-priced products or products having a price exceeding a particular price threshold in the retail environment. Thus, at Block A in FIG. 7A, the price threshold of such products shall be deemed to be classified in the high-price range of the store, and not in the non-high-price range. While this price threshold (i.e. "special" classification) is arbitrary, it needs to be entered into the product price database 333 so that bar-coded products priced at or above the price threshold shall be indexed as high-priced items, and shall be affixed an EAS tag within the retail stored environment in a conventional manner known in the EAS tagging art. Similarly, encoded products priced below the price threshold shall not be affixed any EAS tag, and shall only bear their UPC or UPC/EAN bar code symbol labels and/or EPC-encoded RFID tags or labels, in a conventional manner. Preferably, the database 333 will be realized as a relational database management system (RDBMS) connected to the same network on which the POS-based checkout system 1" is connected using conventional networking techniques.

As indicated at Block B in FIG. 7A, based on the high-price threshold determined at Block A, the second step of the method involves determining which products in the store's inventory should be assigned and affixed EAS tags. This involves analyzing the data in the RDBMS 333 and making this determination.

As indicated at Block C in FIG. 7A, the third step of the method involves affixing EAS tags to all coded products in the store that have been classified in the high-price range in Block B, and not affixing EAS tags to any coded products that have not been classified in the high-price range. This involves analyzing the data in the RDBMS 333 and making this determination.

As indicated at Block D in FIG. 7A, the fourth step of the method involves configuring the POS-based checkout system 1" so that (i) the bar code symbol reader is arranged to read the bar code symbol on each bar coded product passed through the 3D scanning volume, and/or RFID code reader is arranged to read the EPC-encode RFID tag or label on each product passed through the 3D volume 600, while (iii) the EAS tag detector is arranged to simultaneously detect the presence of an EAS tags affixed to high-priced bar-coded product passed through or about the POS-based checkout system.

As indicated at Block E in FIG. 7A, the fifth step of the method involves using the POS-Based checkout system 1" to read the product code on each product passed through the checkout station, while the EAS tag detector simultaneously detects the presence of an EAS-tag on products being passed through or about the checkout station.

As indicated at Block F in FIG. 7B, the sixth step of the method involves using the RDBMS 333 to identify the product through the POS-based checkout system.

As indicated at Block G in FIG. 7B, the seventh step of the method involves the POS-based checkout system 1" determining whether or not the coded product is a high-priced product, and assigned an EAS tag.

As indicated at Block H in FIG. 7B, the eighth step of the method involves the POS-based checkout system 1" determining whether or not the detected EAS tag matches with the price-range of the product identified by the product code read by the bar code symbol reader and/or the RFID code reader 700.

As indicated at Block I1 in FIG. 7B, the ninth step of the method involves determining if the detected EAS tag matches with the product code read, indicating two-factor authentication compliance, and if so, then the POS-based checkout system 1" automatically generates product code data and sends same to the host system.

As indicated at Block I2 in FIG. 7B, the tenth step of the method involves determining if the detected EAS-tag does not match with the product code read, indicating two-factor authentication non-compliance, has not been satisfied and then automatically generates a visible and/or audible alert or alarm to the cashier and/or his or her manager, to infirm about a detected mis-match condition. In addition, the checkout system can generate control signals which automatically activate digital cameras to capture, time-stamp and record video at the particular POS station in the retail environment.

Fourth Illustrative Embodiment of the POS-Based Checkout System Supporting a Two-Factor Authentication Process FIG. 8 shows a third illustrative embodiment of a mobile wireless POS-based checkout system 900 supporting automatic the two-factor authentication process of the present disclosure while maintaining wireless two-way digital data communication with host computer 91, or base station, connected to a network on which the product database 333 is connected.

While the two-factor authentication operation of the POS-based checkout system 900 is described in FIGS. 1A1 through 1A8, the general operation of mobile POS-based checkout system 900 is similar in many ways to the digital-imaging based POS checkout system 1" shown in FIGS. 4 though 7B, described hereinabove.

In this alternative embodiment, the EAS module 528, RFID module 700 and rechargeable battery pack 905 and a wireless RF data communication module (e.g. Bluetooth communication interface) with antennas, are integrated into the compact base module 504A, detachably mounted beneath base portion 504, without adding significantly to the size or weight of the mobile hand-supportable system As shown in FIGS. 8, 9A and 9B, the RFID/EAS cable 402 is eliminated, and the wireless RF data communication module, in communication with the input/output subsystem 527, provides the mobile system 900 with the capacity of supporting robust long-range two-way digital data communication with the remote host system 591, or with one or more base stations connected to the communication network in which the mobile system 900 is a mobile network node, and supporting the same wireless communication interface.

So equipped, mobile POS-based system 900 has the advantage of supporting the reading of 1D, 2D and datamatrix codes, as well as RFID codes, and also detecting and deactivating EAS tags and labels, virtually anywhere in diverse application environments, and carryout the two-factor authentication process of the present disclosure, illustrated in FIGS. 7A and 7B.

Modifications that Come to Mind

While the illustrative embodiments described above involves the use of bi-optic POS imagers, bi-optic laser scanners, hand-supportable and mobile digital imagers, it is understood that the systems and methods of the present disclosure can be implemented using code reading systems having other form factors, including hand-held lasers and imagers, mobility products, code symbol reading engines, hands-free devices, and the like.

In the illustrative embodiments described above, (i) bar codes and/or RFID codes were used to realize the first factor, or the product identification code, employed in the authentication process, while (ii) EAS tags or labels were used as the second factor, or the security classification code, employed in the two-factor POS checkout authentication process. However, it is understood that alternative combinations of such factors can be used to practice the two-factor authentication method.

For example, alternatively, the first factor (i.e. product identification code) could be realized as a unique bar code symbol on each product, while the second factor (i.e. security classification code) could be realized as an RFID tag or label (with appropriate coding) applied to high-priced products in the authentication process. In this alternative embodiment, data can be automatically written to the memory of the RFID tag or label on each high-priced product, and when the bar code symbol on the product also has an encoded RFID tag or label, consistent with data stored in the RDBMS, the system automatically "deactivates" the RFID tag or label from setting off an alarm or alert at a security point (e.g. exit) in the retail environment, by writing data to the memory of the RFID tag to effectively disable it from generating alarms or alerts in retail store environment. In this case, the specially-encoded RFID tag or label functions or emulates an EAS security tag, while also providing item-level intelligence to retailers operating the POS-based checkout system.

Another alternative embodiment of the two-factor authentication process, the first factor (i.e. product identification code) can be an EPC-encoded RFID tag or label (i.e. electronic code), providing product level identification to the POS-based checkout system, while the second factor (i.e. security classification code) is realized as an EAS tag or label assigned to each high priced or high-security-risk class of products sold within a retail environment. In this alternative embodiment, optically read types of bar code symbols or dataforms are not used to identify consumer products; and instead, only EPC-encoded RFID tags or labels are used as the first factor, in the two-factor authentication process of the present disclosure.

Several modifications to the illustrative embodiments have been described above. It is understood, however, that various other modifications to the illustrative embodiment will readily occur to persons with ordinary skill in the art. All such modifications and variations are deemed to be within the scope of the accompanying Claims.

The invention claimed is:

1. A system, comprising:

a barcode symbol reading subsystem for reading barcode symbols on products;

an electronic article surveillance (EAS) tag detector for detecting EAS tags on products and generating security data in response thereto;

an indication module for generating an indication;

a database comprising information associating each barcode symbol with a product and indicating whether the product should have an EAS tag;

a processing subsystem communicatively connected to the barcode symbol reading subsystem, the EAS tag detector, the indication module, and the database, the processing subsystem being configured to:

determine, based on the information in the database, whether a barcode symbol read on a given product by the barcode symbol reading subsystem and the security data generated for the given product by the EAS tag detector comply with a two-factor authentication process; and generate an indication via the indication module in response to the determination of compliance with the two-factor authentication process.

2. The system of claim 1, wherein the database comprises a relational database management system.

3. The system of claim 1, comprising an EAS tag deactivator for deactivating EAS tags on products in response to a determination by the processing subsystem that the given product complies with the two-factor authentication process.

4. The system of claim 1, wherein the processing subsystem is configured to, if the barcode symbol on a given product is associated in the database with a product that should have an EAS tag and the generated security data indicates the presence of an EAS tag, determine that the given product complies with the two-factor authentication process.

5. The system of claim 1, wherein the processing subsystem is configured to, if the barcode symbol on a given product is associated in the database with a product that should not have an EAS tag and the generated security data indicates the presence of an EAS tag, determine that the given product does not comply with the two-factor authentication process.

6. A system, comprising:

a radio-frequency identification (RFID) reading subsystem for reading RFID tags on products;

an electronic article surveillance (EAS) tag detector for detecting EAS tags on products and generating security data in response thereto;

an indication module for generating an indication;

a database comprising information associating each RFID tag with a product and indicating whether the product should have an EAS tag;

a processing subsystem communicatively connected to the RFID reading subsystem, the EAS tag detector, the indication module, and the database, the processing subsystem being configured to:

determine, based on the information in the database, whether an RFID tag read on a given product by the RFID reading subsystem and the security data generated for the given product by the EAS tag detector comply with a two-factor authentication process; and generate an indication via the indication module in response to the determination of compliance with the two-factor authentication process.

7. The system of claim 6, wherein the database comprises a relational database management system.

8. The system of claim 6, comprising an EAS tag deactivator for deactivating EAS tags on products in response to a determination by the processing subsystem that the given product complies with the two-factor authentication process.

9. The system of claim 6, wherein the processing subsystem is configured to, if the RFID tag on a given product is associated in the database with a product that should have an EAS tag and the generated security data indicates the presence of an EAS tag, determine that the given product complies with the two-factor authentication process.

10. The system of claim 6, wherein the processing subsystem is configured to, if the RFID tag on a given product is associated in the database with a product that should not have an EAS tag and the generated security data indicates the presence of an EAS tag, determine that the given product does not comply with the two-factor authentication process.

11. A system, comprising:

an identification code reading subsystem for reading identification codes on products;

a security code detection subsystem for detecting security codes on products and generating security data in response thereto;

an indication module for generating an indication;

a database comprising information associating each identification code with a product and indicating whether the product should have a security code;

a processing subsystem communicatively connected to the identification code reading subsystem, the security code detection subsystem, the indication module, and the database, the processing subsystem being configured to:

determine, based on the information in the database, whether an identification code read on a given product by the identification code reading subsystem and the security data generated for the given product by the security code detection subsystem comply with a two-factor authentication process; and generate an indication via the indication module in response to the determination of compliance with the two-factor authentication process.

12. The system of claim 11, wherein the database comprises a relational database management system.

13. The system of claim 11, wherein the identification code reading subsystem comprises a barcode symbol reading subsystem for reading barcode symbols on products that uniquely identify products.

14. The system of claim 11, wherein the identification code reading subsystem comprises a radio-frequency identification reading subsystem for reading radio-frequency identification tags on products that uniquely identify products.

15. The system of claim 11, wherein the security code detection subsystem comprises an electronic article surveillance tag detector for detecting electronic article surveillance tags on products.

16. The system of claim 11, comprising an electronic article surveillance tag deactivator for deactivating electronic article surveillance tags on products in response to a determination by the processing subsystem that the given product complies with the two-factor authentication process.

17. The system of claim 11, wherein the security code detection subsystem comprises a radio-frequency identification detector for detecting radio-frequency identification tags on products.

18. The system of claim 11, comprising a radio-frequency identification tag deactivator for deactivating a security alarm triggering function of the radio-frequency identification tag in response to a determination by the processing subsystem that the given product complies with the two-factor authentication process.

19. The system of claim 11, wherein the processing subsystem is configured to, if the identification code on a given product is associated in the database with a product that should have a security code and the generated security data indicates the presence of a security code, determine that the given product complies with the two-factor authentication process.

20. The system of claim 11, wherein the processing subsystem is configured to, if the identification code on a given product is associated in the database with a product that should not have a security code and the generated security data indicates the presence of a security code, determine that the given product does not comply with the two-factor authentication process.

* * * * *